US008979594B2

(12) United States Patent
Tsai

(10) Patent No.: US 8,979,594 B2
(45) Date of Patent: Mar. 17, 2015

(54) ELECTRICAL RECEPTACLE

(75) Inventor: Chou-Hsien Tsai, New Taipei (TW)

(73) Assignee: Chou-Hsien Tsai, New Taipei (TW)

( * ) Notice: Subject to any disclaimer, the term of this patent is extended or adjusted under 35 U.S.C. 154(b) by 0 days.

(21) Appl. No.: 13/243,072

(22) Filed: Sep. 23, 2011

(65) Prior Publication Data

US 2012/0077390 A1 Mar. 29, 2012

(30) Foreign Application Priority Data

Sep. 27, 2010 (TW) ..... 99218652 U
Jan. 14, 2011 (TW) ..... 100101407 A
Jan. 21, 2011 (TW) ..... 100102264 A

(51) Int. Cl.
*H01R 24/00* (2011.01)
*H01R 12/72* (2011.01)
*H01R 13/66* (2006.01)

(52) U.S. Cl.
CPC ..... *H01R 12/724* (2013.01); *H01R 13/6658* (2013.01)
USPC ..... 439/660

(58) Field of Classification Search
CPC ..... H01R 13/6658; H01R 23/025; H01R 13/658; H01R 23/7068; H01R 31/06; H01R 23/7073; H01R 23/02; H01R 23/725; H01R 13/26
USPC ..... 439/76.1, 660
See application file for complete search history.

(56) References Cited

U.S. PATENT DOCUMENTS 8,157,599 B2 * 4/2012 Wei ..... 439/660
8,480,435 B2 * 7/2013 Hsiao et al. ..... 439/660
2012/0071032 A1 * 3/2012 Tsai ..... 439/660

* cited by examiner

*Primary Examiner* — Phuong Dinh
(74) *Attorney, Agent, or Firm* — WPAT, PC; Justin King

(57) ABSTRACT

An electrical receptacle includes a first plastic main body, a tongue plate structure, plural signal interface structure segments, and a second plastic main body. The second plastic main body has at least one structure segment fixing space. At least a first portion of said plural signal interface structure segments are previously accommodated and fixed within the at least one structure segment fixing space. The second plastic main body with the first portion of said plural signal interface structure segments and the first plastic main body are combined together, and assembled with the first plastic main body, the tongue plate structure and a second portion of said plural signal interface structure segments so as to produce the electrical receptacle.

31 Claims, 46 Drawing Sheets

ELECTRICAL RECEPTACLE

FIELD OF THE INVENTION

The present invention relates to an electrical receptacle, and more particularly to an electrical receptacle with a signal interface, in which a portion of the signal interface structure segments (e.g. the fixture segments) the signal interface are previously installed on a rear cover.

BACKGROUND OF THE INVENTION

Nowadays, the functions of various electronic products become more powerful. Since handheld devices are increasingly popular, the demands on the data transmission between various electronic products or handheld devices are increased.

Generally, the electrical receptacle for the electronic product has a single signal interface such as a universal serial bus 2.0 (also referred as USB 2.0) signal interface, an external Serial ATA (also referred as eSATA) signal interface, a universal serial bus 3.0 (also referred as USB 3.0) signal interface. Moreover, the electrical receptacle may include an image transmission signal interface such as a display port signal interface or a high definition multimedia interface (HDMI) signal interface. Moreover, the electrical receptacle may include at least two of the above-mentioned signal interfaces. Recently, the manufacturers pay much attention to the integration of more terminals or conductive wires into the electrical receptacle.

Regardless of whether the electrical receptacle has a single signal interface, multiple signal interfaces, a display port signal interface and/or a HDMI signal interface, there is a need of providing an electrical receptacle with reduced assembling complexity and reduced fabricating cost in order to comply with various size specifications of the electronic products or the handheld devices.

Moreover, there is also a need of providing an electrical receptacle with reduced signal interference between adjacent high-speed signal interfaces.

SUMMARY OF THE INVENTION

The present invention provides an electrical receptacle for distributing some of the signal interface structure segments to the rear cover, so that the signal interface structures are not excessively centralized to the plastic main body.

The present invention also provides an electrical receptacle having a single type of signal interface or various types of signal interfaces and having a novel receptacle structure.

The present invention further provides an electrical receptacle with reduced signal interference between adjacent high-speed signal interfaces.

In accordance with an aspect of the present invention, there is provided an electrical receptacle. The electrical receptacle includes a first plastic main body, a tongue plate structure, plural signal interface structure segments, and a second plastic main body. At least two of the plural signal interface structure segments are located at a top side and a bottom side of the tongue plate structure, respectively. The second plastic main body has at least one structure segment fixing space. At least a first portion of the plural signal interface structure segments are previously accommodated and fixed within the at least one structure segment fixing space. After the second plastic main body with the first portion of the plural signal interface structure segments and the first plastic main body are combined together, the second plastic main body, the first plastic main body, the tongue plate structure and a second portion of the plural signal interface structure segments are assembled into the electrical receptacle.

In an embodiment, the tongue plate structure is combined with or integrally formed with the first plastic main body, and the tongue plate structure is a single tongue plate structure or a composite tongue plate structure including at least two plates.

In an embodiment, the composite tongue plate structure is at least composed of two plastic tongue plates. Alternatively, the composite tongue plate structure is at least composed of one plastic tongue plate and one circuit board. Alternatively, the composite tongue plate structure is at least composed of two plastic insert molding tongue plates with at least one signal interface structure segment each. Alternatively, the composite tongue plate structure is at least composed of one plastic tongue plate and one plastic insert molding tongue plate with at least one signal interface structure segment.

In an embodiment, the single tongue plate structure or the plastic tongue plate of the composite tongue plate structure is a fixed plastic tongue plate or a removable plastic tongue plate. In addition, the circuit board is a removable circuit board, and the plastic insert molding tongue plate is a fixed plastic insert molding tongue plate or a removable plastic insert molding tongue plate.

In an embodiment, the second portion of the plural signal interface structure segments are installed on the first plastic main body, or installed on the tongue plate structure, or installed in a first docking space beside a first surface of the tongue plate structure, or installed in a second docking space beside a second surface of the tongue plate structure, or installed on the second plastic main body, or installed in the at least one docking space including at least one of the first docking space and the second docking space.

In an embodiment, the at least two signal interface structure segments located at the top side and the bottom side of the tongue plate structure are respectively exposed to or arranged beside the first docking space and the second docking space. Moreover, the at least two signal interface structure segments are both metallic contact segments, or at least one of the at least two signal interface structure segments is a metallic contact segment, and the metallic contact segment belongs to the second portion of the plural signal interface structure segments.

In an embodiment, the plural signal interface structure segments includes at least one contact resilience arm segment, which is accommodated within at least one corresponding slot of the tongue plate structure, wherein a front end and a rear end of the contact resilience arm segment are respectively protruded from the first surface and the second surface of the tongue plate structure.

In an embodiment, an extension segment or an extension wire or a fixture segment of the plural signal interface structure segments electrically connected with the contact resilience arm segment belongs to the first portion of the plural signal interface structure segments and is previously accommodated and fixed within the at least one structure segment fixing space.

In an embodiment, an extension segment or a fixture segment belongs to the first portion of the plural signal interface structure segments. Moreover, a pin segment or a welding segment connected to a rear end of the extension segment or the fixture segment is not penetrated through or accommodated within any structural member or only penetrated through or accommodated within one of the first plastic main body and the second plastic main body.

In an embodiment, a first end of the pin segment or a first end of the welding segment is electrically connected with the extension segment or electrically connected with the fixture segment, and a second end of the pin segment or a second end of the welding segment is welded to a motherboard, so that none of the structural member is arranged between the first portion of the plural signal interface structure segments and the motherboard or the first portion of the plural signal interface structure segments are only installed on one of the first plastic main body and the second plastic main body.

In an embodiment, a contact pad or a contact resilience arm segment or a contact segment, or an extension wire or an extension segment, or a fixture segment, or a pin segment or a welding segment belongs to the second portion of the plural signal interface structure segments, wherein the second portion of the plural signal interface structure segments which are installed on the first plastic main body exclude the pin segment or the welding segment.

In an embodiment, the first portion of the plural signal interface structure segments and the second portion of the plural signal interface structure segments are collaboratively defined as plural signal interfaces. Each signal interface unit of the plural signal interfaces is composed of four structure segments: (1) a contact pad or a contact resilience arm segment or a contact segment, (2) an extension wire or an extension segment, (3) a fixture segment, and (4) a pin segment or a welding segment. Alternatively, each signal interface unit of the plural signal interfaces is composed of three structure segments: (1) a contact pad or a contact resilience arm segment or a contact segment, (2) an extension wire or an extension segment, and (3) a pin segment or a welding segment. Alternatively, each signal interface unit of the plural signal interfaces is composed of two structure segment: (1) a contact and extension segment or a contact and extension wire, and (2) a pin segment or a welding segment. Each of the signal interfaces includes plural conductive terminals, which are separated from each other and not electrically with each other.

In an embodiment, the second plastic main body is a rear cover, which is combined with the first plastic main body or the tongue plate structure or integrally formed with the tongue plate structure. The rear cover has at least one sidewall exposed to or arranged beside at least one docking space mating with an electrical plug. Alternatively, the rear cover has at least one position-limiting fixing recess for previously accommodating and fixing the first portion of the plural signal interface structure segments. Alternatively, the rear cover has at least one receiving hole for accommodating at least one pin segment of the first portion of the plural signal interface structure segments or the second portion of the plural signal interface structure segments. Alternatively, the rear cover has at least one fixing recess for previously accommodating and fixing the first portion of the plural signal interface structure segments and at least one receiving hole for accommodating at least one pin segment of the first portion of the plural signal interface structure segments or the second portion of the plural signal interface structure segments.

In an embodiment, the electrical receptacle further includes a metallic casing. The metallic casing is sheathed around the first plastic main body, or the metallic casing is sheathed around an outer periphery of a combination of the first plastic main body and the second plastic main body, wherein no signal interface structure segment is installed on the first plastic main body, or no any other protrusion plate parallel with and separated from the plastic tongue plate is arranged under the plastic tongue plate. Alternatively, the first plastic main body has two lateral walls extended toward a front side thereof, or the first plastic main body is not integrally formed with the tongue plate structure. Moreover, a shared profile mating with various signal interfaces of an electrical plug is defined by front peripheries of the two lateral walls.

In an embodiment, the plural signal interface structure segments are collaboratively defined as a signal interface complying with an USB 2.0 or USB 3.0 communication protocol and an eSATA communication protocol. Alternatively, the plural signal interface structure segments are collaboratively defined as a single-type USB signal interface complying with an USB 2.0 or USB 3.0 communication protocol. Alternatively, the plural signal interface structure segments are collaboratively defined as a signal interface complying with a high definition multimedia interface (HDMI) communication protocol. Alternatively, the plural signal interface structure segments are collaboratively defined as a signal interface complying with a display port communication protocol.

In accordance with another aspect of the present invention, there is provided an electrical receptacle having at least one docking space for accommodating an electrical plug. The electrical receptacle includes a plastic main body, a tongue plate structure, plural signal interface structure segments, and a rear cover. The tongue plate structure can be accommodated within a tongue plate receiving space of the electrical plug. The rear cover has at least one structure segment fixing space. At least a first portion of the plural signal interface structure segments are previously accommodated and fixed within the at least one structure segment fixing space. The tongue plate structure is combined with or integrally with the one of the plastic main body and the rear cover. The rear cover with the first portion of the plural signal interface structure segments, the plastic main body, the tongue plate structure and a second portion of the plural signal interface structure segments are assembled into the electrical receptacle.

In an embodiment, the tongue plate structure is combined with or integrally formed with the plastic main body, and the tongue plate structure is a single tongue plate structure or a composite tongue plate structure including at least two plates, wherein the single tongue plate structure or the composite tongue plate structure is an only tongue plate structure of the electrical receptacle.

In an embodiment, the composite tongue plate structure is at least composed of two plastic tongue plates. Alternatively, the composite tongue plate structure is at least composed of one plastic tongue plate and one circuit board. Alternatively, the composite tongue plate structure is at least composed of two plastic insert molding tongue plates with at least one signal interface structure segment each. Alternatively, the composite tongue plate structure is at least composed of one plastic tongue plate and one plastic insert molding tongue plate with at least one signal interface structure segment.

In an embodiment, the single tongue plate structure or the plastic tongue plate of the composite tongue plate structure is a fixed plastic tongue plate or a removable plastic tongue plate, and the circuit board is a removable circuit board, and the plastic insert molding tongue plate is a fixed plastic insert molding tongue plate or a removable plastic insert molding tongue plate.

In an embodiment, at least two of the plural signal interface structure segments are located at a top side and a bottom side of the tongue plate structure, respectively.

In an embodiment, the second portion of the plural signal interface structure segments are installed on the plastic main body, or installed on the tongue plate structure, or installed in a first docking space beside a first surface of the tongue plate structure, or installed in a second docking space beside a second surface of the tongue plate structure, or installed on the rear cover, or installed in the at least one docking space including at least one of the first docking space and the second docking space.

In an embodiment, the at least two signal interface structure segments located at the top side and the bottom side of the tongue plate structure are respectively exposed to or arranged beside the first docking space and the second docking space. Moreover, the at least two signal interface structure segments are both metallic contact segments, or at least one of the at least two signal interface structure segments is a metallic contact segment, and the metallic contact segment belongs to the second portion of the plural signal interface structure segments.

In an embodiment, the plural signal interface structure segments includes at least one contact resilience arm segment, which is accommodated within at least one corresponding slot of the tongue plate structure, wherein a front end and a rear end of the contact resilience arm segment are respectively protruded from the first surface and the second surface of the tongue plate structure.

In an embodiment, an extension segment or a fixture segment of the plural signal interface structure segments electrically connected with the contact resilience arm segment belongs to the first portion of the plural signal interface structure segments and is previously accommodated and fixed within the at least one structure segment fixing space.

In an embodiment, an extension segment or a fixture segment belongs to the first portion of the plural signal interface structure segments. Moreover, a pin segment or a welding segment connected to a rear end of the extension segment or the fixture segment is not penetrated through or accommodated within any structural member or only penetrated through or accommodated within one of the plastic main body and the rear cover.

In an embodiment, a first end of the pin segment or a first end of the welding segment is electrically connected with the extension segment or electrically connected with the fixture segment, and a second end of the pin segment or a second end of the welding segment is welded to a motherboard, so that none of the structural member is arranged between the first portion of the plural signal interface structure segments and the motherboard or the first portion of the plural signal interface structure segments are only installed on one of the plastic main body and the rear cover.

In an embodiment, a contact pad or a contact resilience arm segment or a contact segment, or an extension wire or an extension segment, or a fixture segment, or a pin segment or a welding segment belongs to the second portion of the plural signal interface structure segments, wherein the second portion of the plural signal interface structure segments which are installed on the first plastic main body exclude the pin segment or the welding segment.

In an embodiment, the first portion of the plural signal interface structure segments and the second portion of the plural signal interface structure segments are collaboratively defined as plural signal interfaces. Each signal interface unit of the plural signal interfaces is composed of four structure segments: (1) a contact pad or a contact resilience arm segment or a contact segment, (2) an extension wire or an extension segment, (3) a fixture segment, and (4) a pin segment or a welding segment. Alternatively, each signal interface unit of the plural signal interfaces is composed of three structure segments: (1) a contact pad or a contact resilience arm segment or a contact segment, (2) an extension wire or an extension segment, and (3) a pin segment or a welding segment. Alternatively, each signal interface unit of the plural signal interfaces is composed of two structure segment: (1) a contact and extension segment or a contact and extension wire, and (2) a pin segment or a welding segment. Each of the signal interfaces includes plural conductive terminals, which are separated from each other and not electrically with each other.

In an embodiment, the rear cover is combined with the plastic main body or the tongue plate structure or integrally formed with the tongue plate structure. The rear cover has at least one sidewall exposed to or arranged beside the at least one docking space, or the rear cover has at least one position-limiting fixing recess for previously accommodating and fixing the first portion of the plural signal interface structure segments, or the rear cover has at least one receiving hole for accommodating at least one pin segment of the first portion of the plural signal interface structure segments or the second portion of the plural signal interface structure segments, or the rear cover has at least one fixing recess for previously accommodating and fixing the first portion of the plural signal interface structure segments and at least one receiving hole for accommodating at least one pin segment of the first portion of the plural signal interface structure segments or the second portion of the plural signal interface structure segments.

In an embodiment, the plural signal interface structure segments are collaboratively defined as a first signal interface complying with an eSATA communication protocol, and collaboratively defined as a second signal interface having plural contact resilience arm segments and complying with a USB 2.0 communication protocol. Alternatively, the plural signal interface structure segments are collaboratively defined as the second signal interface and a third signal interface so as to comply with a USB 3.0 communication protocol.

In an embodiment, the electrical receptacle further includes a metallic casing. The metallic casing is sheathed around the plastic main body, or the metallic casing is sheathed around an outer periphery of a combination of the plastic main body and the rear cover, wherein no signal interface structure segment is installed on the plastic main body, or no any other protrusion plate parallel with and separated from the plastic tongue plate is arranged under the plastic tongue plate. Alternatively, the plastic main body has two lateral walls extended toward a front side thereof, or the plastic main body is not integrally formed with the tongue plate structure. Moreover, a shared profile mating with various signal interfaces of the electrical plug is defined by front peripheries of the two lateral walls.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
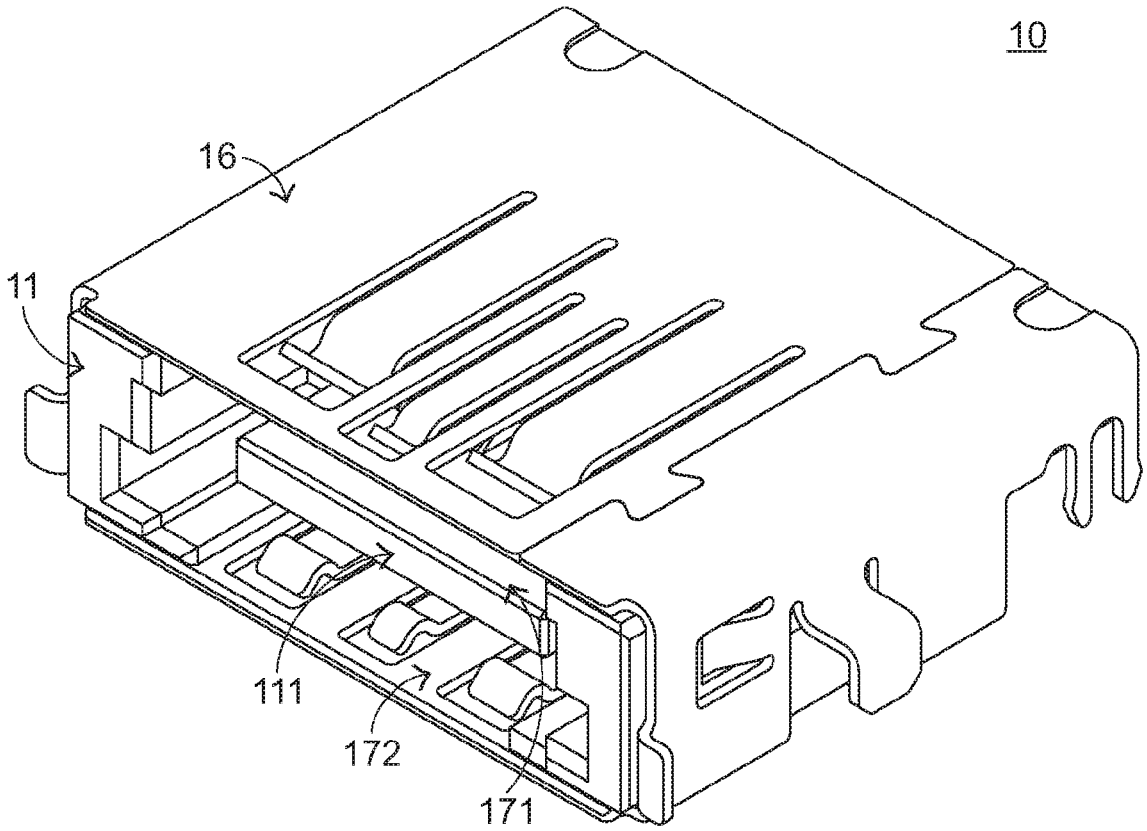
FIG. 1 is a schematic assembled view illustrating an electrical receptacle according to a first embodiment of the present invention.

The present invention provides an electrical receptacle. The concepts of the present invention may be applied to an electrical receptacle with a single kind of signal interface or an all-in-one signal interface. In addition, the concepts of the present invention may be applied to an electrical receptacle with a unidirectional or bidirectional conducting means. For example, the concepts of the present invention are at least applied to the electrical receptacle having a USB 2.0 or USB 3.0 signal interface and an eSATA signal interface to comply with an all-in-one signal interface protocol. Alternatively, the concepts of the present invention are at least applied to the electrical receptacle comprising a USB 2.0 or USB 3.0 signal interface with a unidirectional or bidirectional conducting means but without a foolproof profile. Alternatively, the concepts of the present invention may be applied to the electrical receptacle with a single type signal interface, for example the signal interface complying with a high definition multimedia interface (HDMI) protocol or the signal interface complying with a display port protocol.

Moreover, numerous modifications and alterations of the electrical receptacle may be made while retaining the teachings of the invention. For example, the structure of the electrical receptacle may comprise four individual components: (1) a plastic main body (or a hollow plastic main body) with an integral tongue plate or a plastic tongue plate of the composite tongue plate structure, (2) a circuit board of the composite tongue plate structure, (3) a rear cover (also referred as a covering member), and (4) a metallic casing. Alternatively, the structure of the electrical receptacle may comprise four individual components: (1) a plastic main body (or a hollow plastic main body), (2) a circuit board of the composite tongue plate structure, (3) a rear cover (also referred as a covering member) with an integral tongue plate of the composite tongue plate structure, and (4) a metallic casing. Alternatively, the structure of the electrical receptacle may comprise four individual components: (1) a plastic main body (or a hollow plastic main body), (2) a single tongue plate or a composite tongue plate structure, (3) a rear cover (also referred as a covering member), and (4) a metallic casing. It is to be noted that the following descriptions of preferred embodiments of this invention are presented herein for purpose of illustration and description only.

The plastic main body may be considered as a first plastic main body. The rear cover (also referred as a covering member), or an individual pressing plate (or pressing structure), or an integral combination of the rear cover (also referred as a covering member) and a pressing plate (or pressing structure) may be considered as a second plastic main body.

Moreover, according to the practical requirements, the manufacturer may determine whether a signal interface is installed on the plastic main body or not, whether two lateral walls are respectively extended from left/right sides of the plastic main body or not, whether there is any other protrusion plate parallel with and separated from the single tongue plate or the composite tongue plate structure to support the plastic main body, whether the plastic main body has a bottom part (base part) or not, or whether the plastic main body has a foolproof profile mating with different signal interfaces. Consequently, numerous modifications and alterations may be made while retaining the teachings of the invention.

Moreover, the plastic main body of the electrical receptacle of the present invention has two lateral walls, which are extended toward the front side. The two lateral walls and at least one of a bottom part of the plastic main body and the rear cover collectively define a docking recess. The electrical receptacle has at least one docking space including a first receptacle or a second docking space. The docking space is at least defined by the plastic tongue plate (or the composite tongue plate structure) within the docking recess and the plastic main body (or the rear cover). Alternatively, the docking space is further defined by a metallic casing. It is to be noted that the following descriptions of preferred embodiments of this invention are presented herein for purpose of illustration and description only.

The entrance of the docking recess at least comprises a shared profile mating with various signal interfaces of a corresponding electrical plug. It is preferred that the shared profile is located at the front peripheries of the two lateral walls.

Moreover, the tongue plate used in the electrical receptacle may be a plastic tongue plate. In views of the relationship between the tongue plate and the main body, the plastic tongue plate may be integrally formed with the plastic main body to be served as an extension structure (i.e. a fixed plate) of the plastic main body. Alternatively, the tongue plate is an individual component (e.g. a removable plastic tongue plate). Alternatively, the tongue plate and some other components may be combined as an individual component. It is to be noted that the following descriptions of preferred embodiments of this invention are presented herein for purpose of illustration and description only.

Moreover, the circuit board used in the electrical receptacle of the present invention is a removable circuit board. Of course, the circuit board may be accommodated within a receiving space of the plastic tongue plate or the removable plastic tongue plate. Alternatively, according to the practical requirements, the circuit board is not accommodated within the receiving space.

Moreover, a composite tongue plate structure used in the electrical receptacle of the present invention is at least composed of two plastic tongue plates. Alternatively, the composite tongue plate structure is at least composed of a plastic tongue plate and a circuit board. Alternatively, the composite tongue plate structure is at least composed of two plastic insert molding tongue plates, wherein each of the plastic insert molding tongue plate has at least one signal interface structure segment. Alternatively, the composite tongue plate structure is at least composed of a plastic tongue plate and a plastic insert molding tongue plate with at least one signal interface structure segment.

Moreover, the signal interface unit of any signal interface used in the electrical receptacle of the present invention may comprise a single conductive terminal or further comprise a contact pad and an extension wire. According to the specifications of the general electric connector, the signal interface unit is composed of four structure segments: (1) a metallic contact part such as a (metallic) contact resilience arm segment or a (metallic) contact pad or a (metallic) contact segment, (2) a (metallic) extension segment (or an extension wire), (3) a (metallic) fixture segment, and (4) a (metallic) pin segment (a welding segment). Due to these four structure segments, the signal interface unit is effective to completely transmit an interface signal. Of course, these structure segments may have different definitions, explanations or classifications. For example, by changing the definition and classification, the signal interface unit may be composed of two structure segments: (1) a (metallic) contact and extension segment (contact and extension wire), and (2) a (metallic) pin segment (a welding segment). Alternatively, the signal interface unit may be composed of three structure segments: (1) a (metallic) contact resilience arm part (a contact pad or a contact segment), (2) a (metallic) extension segment (or an extension wire), and (3) a (metallic) pin segment (a welding segment). Of course, the structure segments may have different explanations or classifications, which are well known to those skilled in the art.

Hereinafter, any signal interface used in the electrical receptacle of the embodiments as shown in FIGS. 1~14 will be illustrated by referring to the signal interface composed of four structure segments: (1) a metallic contact part such as a (metallic) contact resilience arm segment or a contact pad or a contact segment, (2) an extension segment (or an extension wire), (3) a fixture segment, and (4) a pin segment. Moreover, any signal interface used in the electrical receptacle of the embodiments as shown in other drawings will be illustrated by referring to a signal interface having an signal interface structure composed of three structure segments: (1) a metallic contact part such as a (metallic) contact resilience arm segment or a contact pad or a contact segment, (2) an extension segment (or an extension wire), and (3) a pin segment. That is, the features of the present invention are not restricted by the definition or classification of any signal interface.

Moreover, the structural relationship or spatial arrangement between the signal interfaces or the structure segments of various signal interfaces and other components or structures (e.g. the plastic main body, the single tongue plate, the composite tongue plate structure, or the rear cover) and the structural relationship or spatial arrangement between the single tongue plate, the composite tongue plate structure and above components or structures (e.g. the plastic main body or the rear cover) may be varied according to the practical requirements or according to the plastic insert molding process or the circuit board forming process. It is to be noted that the following descriptions of preferred embodiments of this invention are presented herein for purpose of illustration and description only.

Moreover, a metallic contact part of at least one signal interface is located at each of the top side and the bottom side of the single plastic tongue plate or the composite tongue plate structure of the electrical receptacle. Moreover, the two metallic contact parts on different positions of the top side and the bottom side of the plastic tongue plate are respectively exposed to or arranged beside different docking space. Alternatively, a metallic contact part of at least one signal interface is located at only the top side or the bottom side of the single plastic tongue plate or the composite tongue plate structure.

In a case that a metallic contact part of at least one signal interface is located at only the top side or the bottom side of the single plastic tongue plate or the composite tongue plate structure, the composite tongue plate structure of the present invention is not defined by a plastic tongue plate integrally formed with the plastic main body and another plastic tongue plate integrally formed with the rear cover.

In the following descriptions of preferred embodiments and clams of this invention, the concepts or mechanisms of arranging the components or structures may be implements by various specified embodiments. The specified embodiment includes but is not limited to the combination assembly (or detachable combination assembly), the integrally-formed assembly or the secondary processing assembly (including fastening or welding means).

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 2:
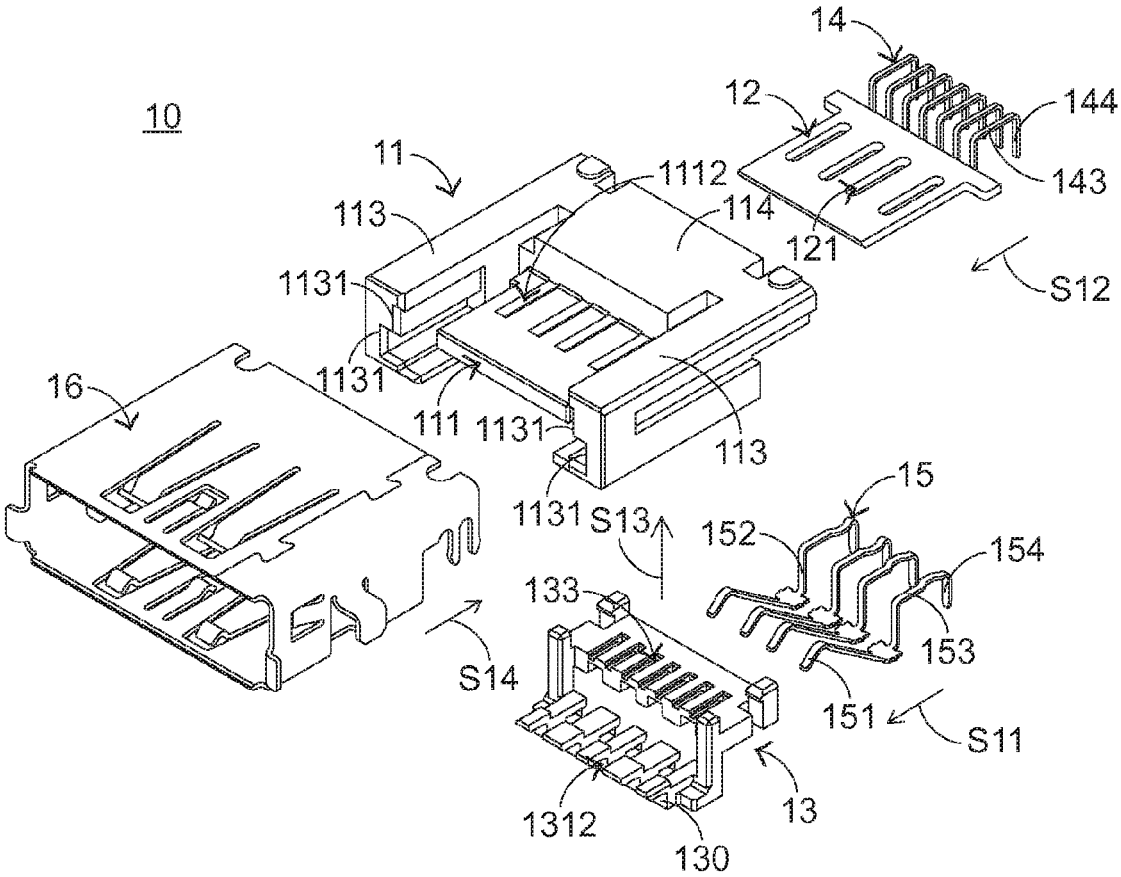
FIG. 2 is a schematic exploded view illustrating the electrical receptacle of the first embodiment.
Figure 3:
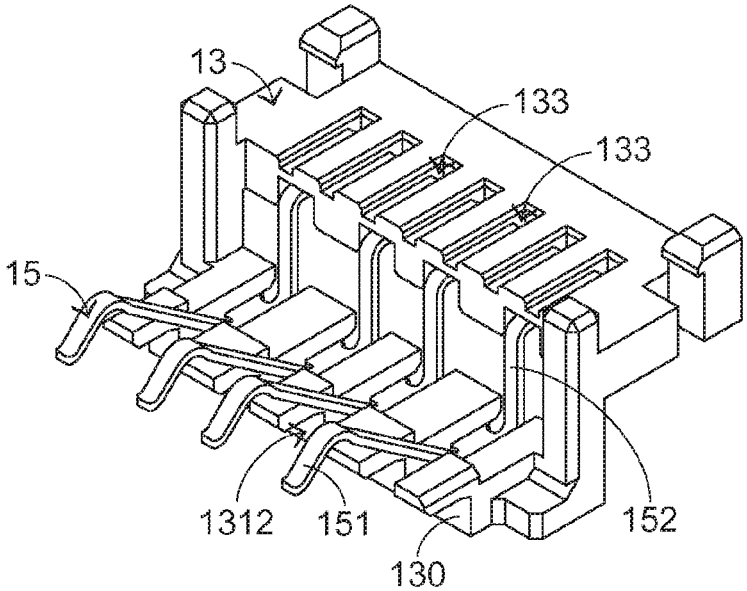
FIG. 3 is a schematic perspective view illustrating the combination of the USB 2.0 signal interface and the second plastic main body of the electrical receptacle of the first embodiment.
Figure 4:
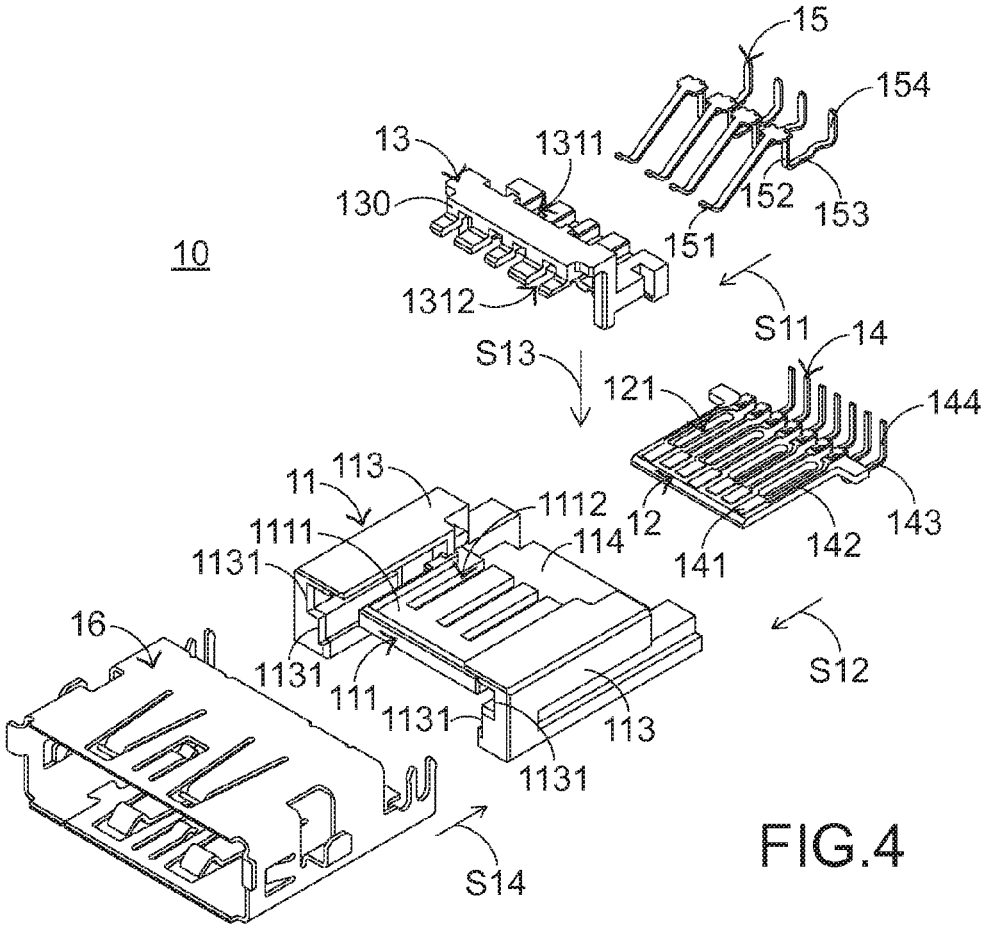
FIG. 4 is a schematic exploded view illustrating the electrical receptacle of the first embodiment and taken along another viewpoint.
Figure 5:
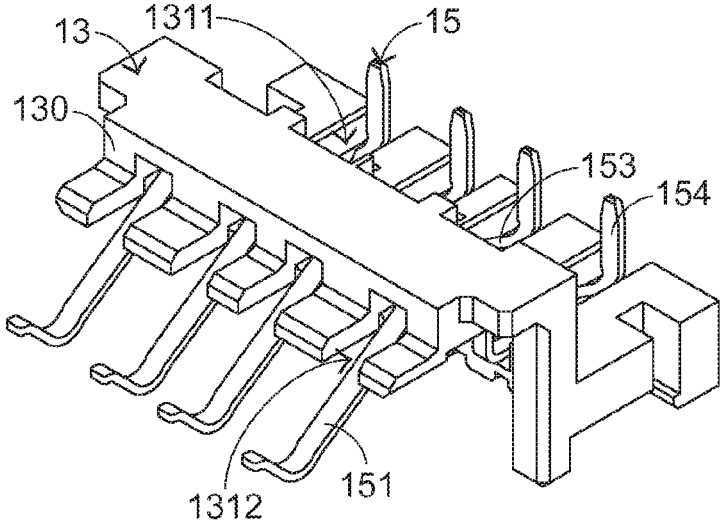
FIG. 5 is a schematic perspective view illustrating the combination of the USB 2.0 signal interface and the second plastic main body of the electrical receptacle of the first embodiment and taken along another viewpoint.
Figure 6:
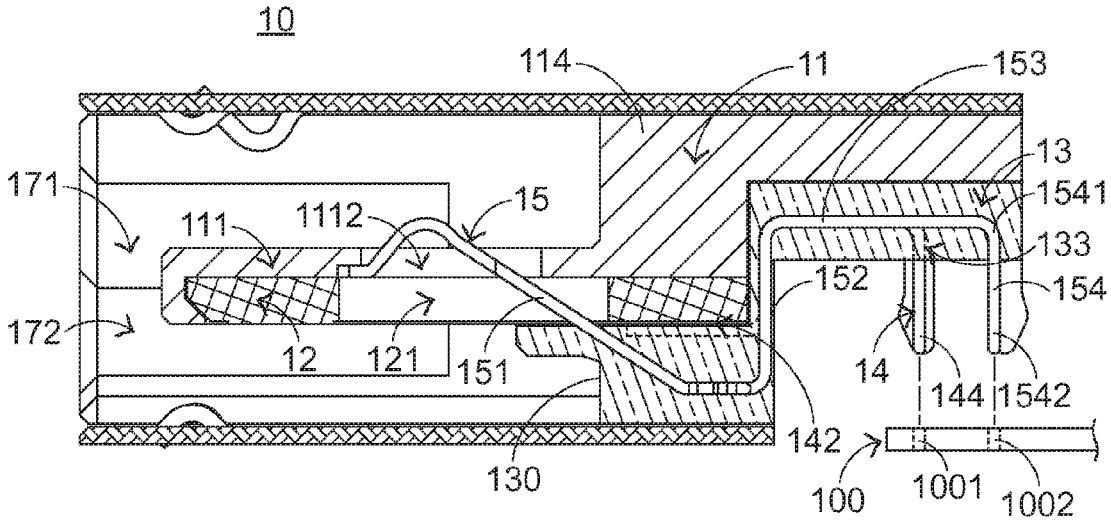
FIG. 6 is a schematic side view illustrating the electrical receptacle of the first embodiment.

Hereinafter, a composite tongue plate structure including a fixed plastic tongue plate or a removable plastic tongue plate and a circuit board will be illustrated in more detail with reference to FIGS. 1~6. FIG. 1 is a schematic assembled view illustrating an electrical receptacle according to a first embodiment of the present invention. FIG. 2 is a schematic exploded view illustrating the electrical receptacle of the first embodiment. FIG. 3 is a schematic perspective view illustrating the combination of the USB 2.0 signal interface and the second plastic main body of the electrical receptacle of the first embodiment. FIG. 4 is a schematic exploded view illustrating the electrical receptacle of the first embodiment and taken along another viewpoint. FIG. 5 is a schematic perspective view illustrating the combination of the USB 2.0 signal interface and the second plastic main body of the electrical receptacle of the first embodiment and taken along another viewpoint. FIG. 6 is a schematic side view illustrating the electrical receptacle of the first embodiment.

In this embodiment, the present invention will be illustrated by referring to an electrical receptacle including an eSATA signal interface and a USB 2.0 signal interface. As shown in FIGS. 1~6, the electrical receptacle 10 comprises a first plastic main body 11, a plastic tongue plate 111, a circuit board 12, and a second plastic main body 13. The first plastic main body 11 has a first docking space 171 and a second docking space 172. The plastic tongue plate 111 is fixed on a sidewall of a bottom part 114 of the first plastic main body 11 and extended toward the front side.

In this embodiment, the plastic tongue plate 111 is suspended toward the front side. Moreover, no any other protrusion plate parallel with and separated from the plastic tongue plate 111 is arranged under the plastic tongue plate 111 to support the first plastic main body 11. That is, two lateral walls 113 are disposed on the bottom part 114 of the first plastic main body 11 and extended toward the front side. Moreover, a shared profile 1131 mating with different signal interfaces of an electrical plug (see FIG. 61) is located at the front peripheries of the two lateral walls 113. Consequently, the two lateral walls 113 can support the first plastic main body 11 and provide the shared profile 1131 to achieve the all-in-one electrical receptacle.

In this embodiment, the circuit board 12 is accommodated within a receiving space 1111, which is located under the tongue plate 111 (see FIG. 4). Moreover, the circuit board 12 and the tongue plate 111 may be in close contact with each other. Alternatively, the circuit board 12 is separated from the tongue plate 111 by a spacing interval, so that another signal interface can be interposed between the circuit board 12 and the tongue plate 111 and will be illustrated later.

In the embodiment, the first plastic main body 11 is a hollow plastic main body 11 (also referred as a plastic main body), and the plastic tongue plate 111 is arranged between the first docking space 171 and the second docking space 172 of the plastic main body 11. In the embodiment, the first docking space 171 and the second docking space 172 are defined by the plastic tongue plate 111, the circuit board 12 and the first plastic main body 11.

Moreover, in this embodiment, the plastic tongue plate 111 and the circuit board 12 are both installed on the first plastic main body 11. Alternatively, in the following embodiments, either the plastic tongue plate or the circuit board is installed on the first plastic main body 11.

In the embodiment, any signal interface used in the electrical receptacle includes but is not limited to a first signal interface (e.g. an eSATA signal interface), or a second signal interface (e.g. a USB 2.0 signal interface), or a third signal interface (e.g. USB 3.0 signal interface).

The signal interface structure segment used in the electrical receptacle of the present invention is a part of the signal interface structure segments of any signal interface, for example a contact pad or a metallic contact resilience arm, an extension wire or an extension segment, a fixture segment, or a pin segment. According to the specifications of the general electric connector, any signal interface is composed of four kinds of the above-mentioned structure segments. Due to these four structure segments, the signal interface is effective to completely transmit interface signals. Of course, the signal interface structure may have different explanations or classifications, which are well known to those skilled in the art.

Please refer to FIGS. 1~6 again. From front to back, the signal interface structure segments of the eSATA signal interface 14 successively comprise a plurality of contact pads 141, a plurality of extension wires 142, a plurality of fixture segments 143, and a plurality of pin segments (or welding segments) 144. From front to back, the signal interface structure segments of the USB 2.0 signal interface 15 successively comprise a plurality of contact resilience arm segments 151, a plurality of extension segments 152, a plurality of fixture segments 153, and a plurality of pin segments (or welding segments) 154. That is, the USB 2.0 signal interface 15 comprises a plurality of USB 2.0 metallic terminals.

In this embodiment, the eSATA signal interface 14 is installed on the bottom surface of the circuit board 12. The extension segments 152, the fixture segments 153 and the pin segments 154 of the USB 2.0 signal interface 15 are arranged beside the eSATA signal interface 14. The contact resilience arm segments 151 are penetrated upwardly from the bottom surface of the circuit board 12 and through four grooves 121 of the circuit board 12 and four slots 1112 of the plastic tongue plate 111, and exposed to the first docking space 171 beside the plastic tongue plate 111.

The plastic tongue plate 111 and the circuit board 12 may be collaboratively defined as a composite tongue plate structure. In this embodiment, the contact resilience arm segments 151 of the USB 2.0 signal interface 15 are located at the top side of the composite tongue plate structure and exposed to the first docking space 171. The contact pads 141 of the eSATA signal interface 14 are located at the bottom side of the composite tongue plate structure and exposed to the second docking space 172.

In this embodiment, the electrical receptacle 10 further comprises a metallic casing 16, which is sheathed around the outer periphery of the combination of the first plastic main body 11 and the second plastic main body 13.

In accordance with a key feature, the second plastic main body 13 is a rear cover with a plurality of structure segment fixing spaces. For example, the structure segment fixing spaces are fixing recesses 1311, 1312 with position-limiting structures (see FIG. 4). The structure segment fixing spaces are used for accommodating and fixing the fixture segments 153 of the USB 2.0 signal interface 15 that are installed on the second plastic main body 13. The fixture segments 143 of the eSATA signal interface 14 are accommodated within and installed on the region between the first plastic main body 11 and the second plastic main body 13.

For assembling the electrical receptacle 10, the above components may be moved in the assembling directions S11~S14 as shown in FIG. 2 and FIG. 4. Firstly, the fixture segments 153 of the USB 2.0 signal interface 15 are previously installed on the second plastic main body 13 along the assembling direction S11. Then, the circuit board 12 is installed on the first plastic main body 11 along the assembling direction S12. Then, the combination of the second plastic main body 13 and the USB 2.0 signal interface 15 is moved upwardly to be installed on the first plastic main body 11 along the assembling direction S13. After the metallic casing 16 is sheathed around the outer periphery of the combination of the first plastic main body 11 and the second plastic main body 13 along the assembling direction S14, the electrical receptacle 10 is assembled.

Moreover, after the first plastic main body 11 and the second plastic main body 13 are combined together, the pin segments 144 of the first signal interface 14 (i.e. the eSATA signal interface) are respectively accommodated within the seven receiving holes 133 (see FIG. 2 and FIG. 3) of the second plastic main body 13. Whereas, the pin segments 154 of the second signal interface 15 (i.e. the USB 2.0 signal interface) are not accommodated within the second plastic main body 13.

In this embodiment, the second plastic main body 13 (i.e. the rear cover) comprises a plurality of fixing recesses 1311, 1312 and a plurality of receiving holes 133. Moreover, a sidewall 130 of the second plastic main body 13 (i.e. the rear cover) is exposed to or arranged beside the second docking space 172.

Moreover, a motherboard 100 is shown in FIG. 6 but not shown in FIGS. 1~5. The motherboard 100 has a plurality of insertion holes 1001 and 1002. The pin segments 144 of the first signal interface 14 (i.e. the eSATA signal interface) and the pin segments 154 of the second signal interface 15 (i.e. the USB 2.0 signal interface) are inserted into the insertion holes 1001 and 1002, respectively. After the pin segments 144 and 154 are welded to the insertion holes 1001 and 1002, the electrical receptacle 10 is welded on the motherboard 100.

Moreover, after the second signal interface 15 is fixed on the second plastic main body 13 (i.e. the rear cover), no additional structural member is arranged between the pin segments 154 of the second signal interface 15 and the motherboard 100. In other words, a first end 1541 of the pin segment 154 is connected to the fixture segment 153, and a second end 1542 of the pin segment 154 is inserted into the motherboard 100. Moreover, after the first signal interface 14 is installed on the first plastic main body 11, the pin segments 144 are penetrated through the receiving holes 133 of the second plastic main body 13 (i.e. the rear cover) and then inserted into the motherboard 100.

From the above discussions, some of the signal interface structure segments are previously distributed to the second plastic main body 13. Since the signal interface structure segments are not excessively centralized to the first plastic main body 11, the layout space is no longer crowded. Moreover, since the portions of the signal interface structure segments are previously installed on the second plastic main body 13, the speed and convenience of assembling the other mechanisms will be enhanced. In such way, the electrical receptacle can be quickly assembled.

Figure 7:
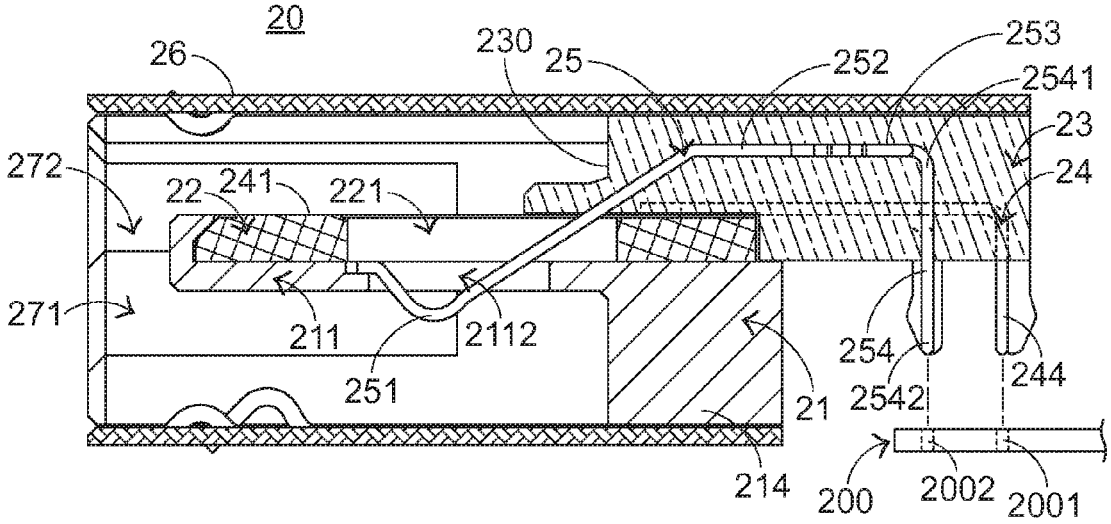
FIG. 7 is a schematic side view illustrating an electrical receptacle to be mounted on a motherboard according to a second embodiment of the present invention.

FIG. 7 is a schematic side view illustrating an electrical receptacle to be mounted on a motherboard according to a second embodiment of the present invention. As shown in FIG. 7, the electrical receptacle 20 comprises a first plastic main body 21, a plastic tongue plate 211, a circuit board 22, and a second plastic main body 23. The first plastic main body 21 has a first docking space 271 and a second docking space 272. The plastic tongue plate 211 is fixed on a sidewall of a bottom part 214 of the first plastic main body 21 and extended toward the front side. Moreover, the circuit board 22 is disposed over the plastic tongue plate 211.

From front to back, the signal interface structure segments first signal interface 24 (e.g. an eSATA signal interface) successively comprise a plurality of contact pads 241, a plurality of extension wires, a plurality of fixture segments 243, and a plurality of pin segments 244. From front to back, the signal interface structure segments of the second signal interface 25 (e.g. a USB 2.0 signal interface) successively comprise a plurality of contact resilience arm segments 251, a plurality of extension segments 252, a plurality of fixture segments 253, and a plurality of pin segments 254. That is, the USB 2.0 signal interface 25 also comprises a plurality of USB 2.0 metallic terminals.

In this embodiment, the eSATA signal interface 24 is located at the top side of the circuit board 22. The extension segments 252, the fixture segments 253 and the pin segments 254 of the USB 2.0 signal interface 25 are arranged beside the eSATA signal interface 24. The contact resilience arm segments 251 are penetrated downwardly from the top surface of the circuit board 22 and through four grooves 221 of the circuit board 22 and four slots 2112 of the plastic tongue plate 211, and exposed to the first docking space 271 beside the plastic tongue plate 211

In this embodiment, the circuit board 22 and the plastic tongue plate 211 may be collaboratively defined as a composite tongue plate structure. The contact pads 241 of the eSATA signal interface 24 are located at the top side of the composite tongue plate structure and exposed to the second docking space 272. Moreover, the contact resilience arm segments 251 of the USB 2.0 signal interface 25 are located at the bottom side of the composite tongue plate structure and exposed to the first docking space 271.

Moreover, in this embodiment, a sidewall 230 of the second plastic main body 23 (i.e. the rear cover) is exposed to or arranged beside the second docking space 272.

In this embodiment, the electrical receptacle 20 further comprises a metallic casing 26, which is sheathed around the outer periphery of the combination of the first plastic main body 21 and the second plastic main body 23.

In accordance with a key feature of the present invention, the second plastic main body 23 is a rear cover with a plurality of structure segment fixing spaces. For example, the structure segment fixing spaces are fixing recesses with position-limiting structures for accommodating and fixing the fixture segments 353 of the USB 2.0 signal interface 35 that are installed on the second plastic main body 23.

Moreover, a motherboard 200 is shown in FIG. 7. The motherboard 200 has a plurality of insertion holes 2001 and 2002. The pin segments 244 of the first signal interface 24 (i.e. the eSATA signal interface) and the pin segments 254 of the second signal interface 25 (i.e. the USB 2.0 signal interface) are inserted into the insertion holes 2001 and 2002, respectively. After the pin segments 244 and 254 are welded to the insertion holes 2001 and 2002, the electrical receptacle 20 is welded on the motherboard 200. Moreover, after the second signal interface 25 is fixed on the second plastic main body 23 (i.e. the rear cover), no additional structural member is arranged between the pin segments 254 of the second signal interface 25 and the motherboard 200. In other words, a first end 2541 of the pin segment 254 is connected to the fixture segment 253, and a second end 2542 of the pin segment 254 is inserted into the motherboard 200.

Figure 8:
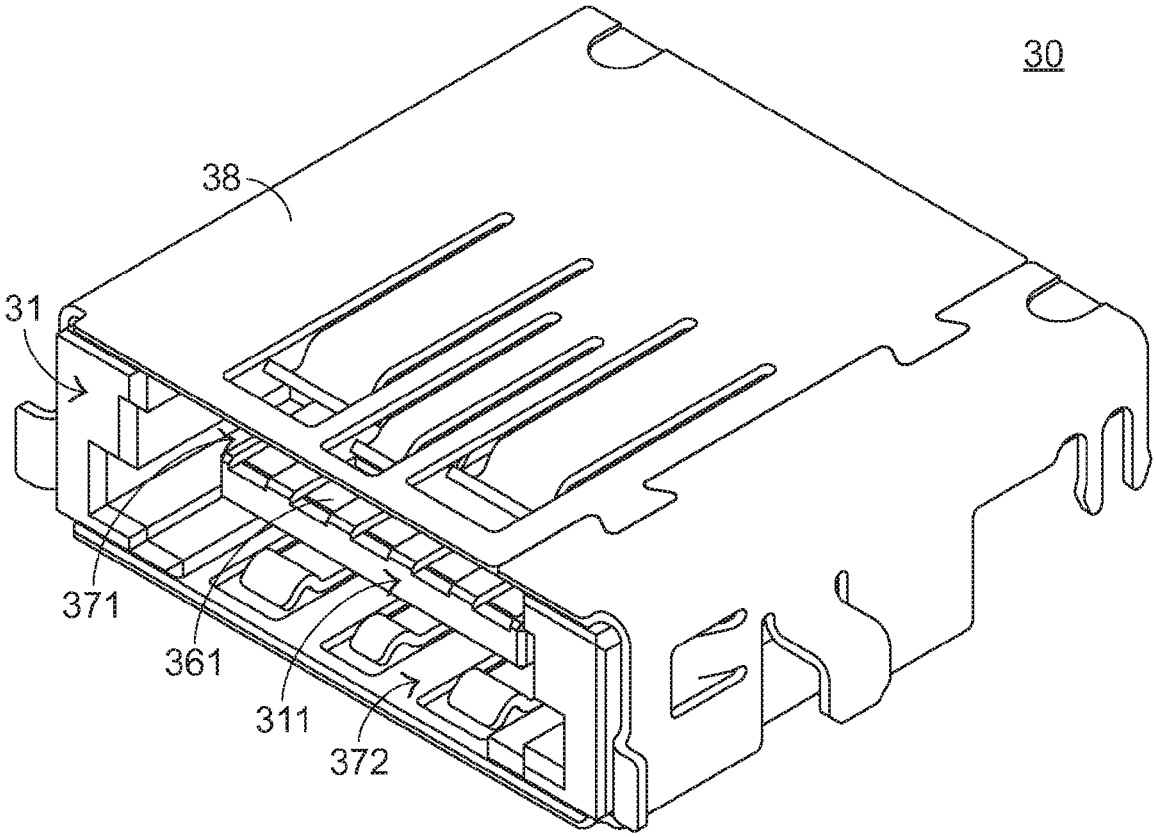
FIG. 8 is a schematic assembled view illustrating an electrical receptacle according to a third embodiment of the present invention.
Figure 9:
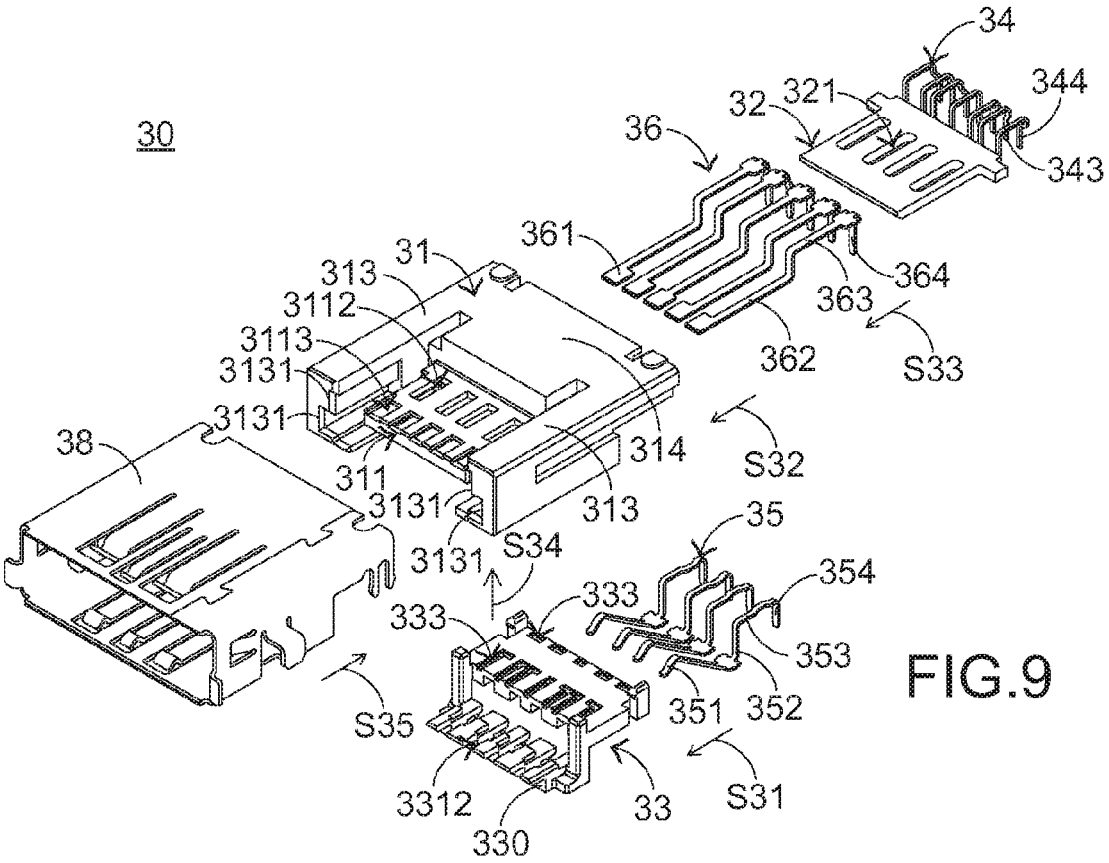
FIG. 9 is a schematic exploded view illustrating the electrical receptacle of the third embodiment.
Figure 10:
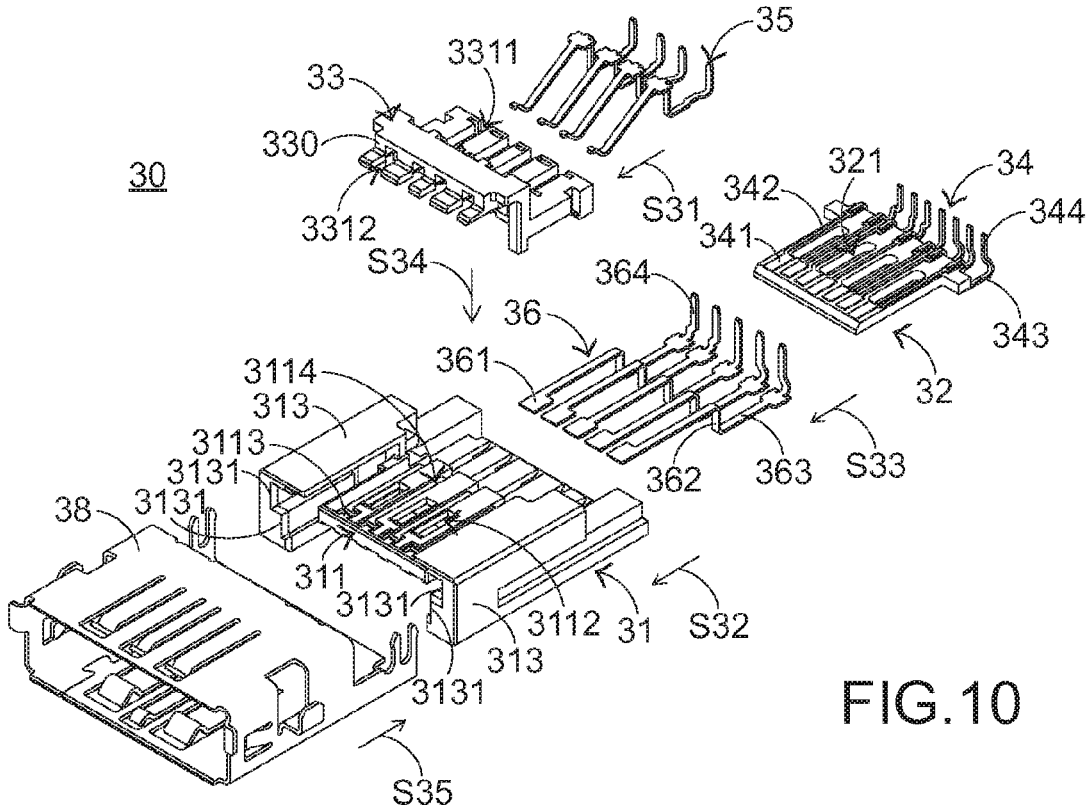
FIG. 10 is a schematic exploded view illustrating the electrical receptacle of the third embodiment and taken along another viewpoint.
Figure 11:
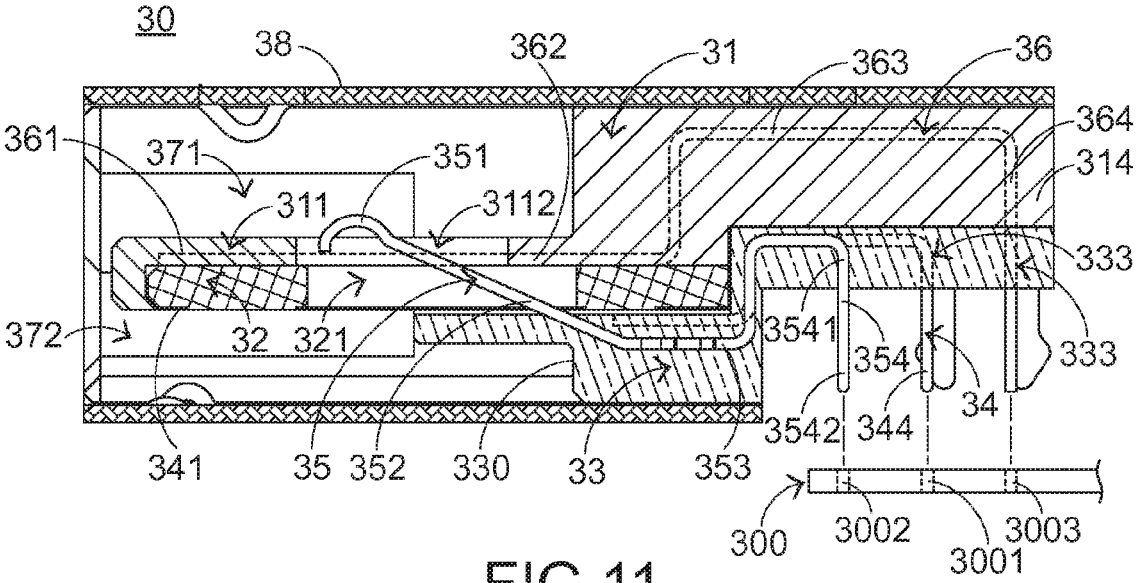
FIG. 11 is a schematic side view illustrating the electrical receptacle to be mounted on a motherboard according to the third embodiment of the present invention.

Please refer to FIGS. 8~11. FIG. 8 is a schematic assembled view illustrating an electrical receptacle according to a third embodiment of the present invention. FIG. 9 is a schematic exploded view illustrating the electrical receptacle of the third embodiment. FIG. 10 is a schematic exploded view illustrating the electrical receptacle of the third embodiment and taken along another viewpoint. FIG. 11 is a schematic side view illustrating the electrical receptacle to be mounted on a motherboard according to the third embodiment of the present invention.

As shown in FIGS. 8~11, the electrical receptacle 30 comprises a first plastic main body 31, a plastic tongue plate 311, a circuit board 32, and a second plastic main body 33. The first plastic main body 31 has a first docking space 371 and a second docking space 372. The plastic tongue plate 311 is fixed on a sidewall of a bottom part 314 of the first plastic main body 31 and extended toward the front side. Moreover, the circuit board 32 is disposed under the plastic tongue plate 311.

In this embodiment, the electrical receptacle 30 further comprises a metallic casing 38, which is sheathed around the outer periphery of the combination of the first plastic main body 31 and the second plastic main body 33.

In this embodiment, the plastic tongue plate 311 is suspended toward the front side. Moreover, no any other protrusion plate parallel with and separated from the plastic tongue plate 311 is arranged under the plastic tongue plate 311 to support the first plastic main body 31. That is, two lateral walls 313 are disposed on the bottom part 314 of the first plastic main body 31 and extended toward the front side. Moreover, a shared profile 3131 mating with different signal interfaces of an electrical plug (see FIG. 61) is located at the front peripheries of the two lateral walls 313. Consequently, the two lateral walls 313 can support the first plastic main body 31 and provide the shared profile 3131 to achieve the all-in-one electrical receptacle.

From front to back, the signal interface structure segments of the first signal interface 34 (e.g. an eSATA signal interface) successively comprise a plurality of contact pads 341, a plurality of extension wires 342, a plurality of fixture segments 343, and a plurality of pin segments 344. From front to back, the signal interface structure segments of the second signal interface 35 (e.g. a USB 2.0 signal interface) successively comprise a plurality of contact resilience arm segments 351, a plurality of extension segments 352, a plurality of fixture segments 353, and a plurality of pin segments 354. That is, the USB 2.0 signal interface 35 also comprises a plurality of USB 2.0 metallic terminals.

The arrangements of the eSATA signal interface 34 and the USB 2.0 signal interface 35 are similar to the arrangements of the eSATA signal interface 14 and the USB 2.0 signal interface 15 of the first embodiment, and are not redundantly described herein.

In comparison with the pin segment 144 of the eSATA signal interface 14 of the first embodiment, the bending angle of the pin segment 344 of the eSATA signal interface 34 is relatively larger. Moreover, for complying with the USB 3.0 communication protocol, the electrical receptacle 30 of this embodiment further comprises a USB 3.0 signal interface 36. That is, the four-terminal USB 2.0 signal interface 35 and the 5-terminal USB 3.0 signal interface 36 may collaboratively support the USB 3.0 communication protocol.

From front to back, the signal interface structure segments of the USB 3.0 signal interface 36 successively comprise a plurality of contact segments 361, a plurality of extension segments 362, a plurality of fixture segments 363, and a plurality of pin segments (or welding segments) 364. That is, the USB 3.0 signal interface 36 comprises a plurality of USB 3.0 metallic terminals.

In accordance with a key feature of the present invention, the second plastic main body 33 is a rear cover with a plurality of structure segment fixing spaces. For example, the structure segment fixing spaces are a plurality of fixing recesses 3311, 3312 with position-limiting structures (see FIG. 10). The structure segment fixing space is used for accommodating and fixing the fixture segments 353 of the USB 3.0 signal interface 35 that are installed on the second plastic main body 33. Moreover, the fixture segments 343 of the eSATA signal interface 34 are accommodated within and installed on the region between the first plastic main body 31 and the second plastic main body 33. The fixture segments 363 of the USB 3.0 signal interface 36 are installed on the first plastic main body 31.

For assembling the electrical receptacle 30, the above components may be moved in the assembling directions S31~S34 as shown in FIG. 9 and FIG. 10. Firstly, the fixture segments 353 of the USB 2.0 signal interface 35 are previously installed on the second plastic main body 33 along the assembling direction S31. Then, after the USB 3.0 signal interface 36 is inserted and placed within the terminal recesses 3114 of the plastic tongue plate 311 along the assembling direction S32, the contact segments 361 of the USB 3.0 signal interface 36 are penetrated through a plurality of contact holes 3113 of the plastic tongue plate 311 to be exposed to the first docking space 371. Then, the circuit board 32 is installed on the first plastic main body 31 along the assembling direction S33. Then, after the combination of the second plastic main body 35 and the USB 2.0 signal interface 35 is moved upwardly to be installed on the first plastic main body 31 along the assembling direction S34, and the contact resilience arm segments 351 of the USB 2.0 signal interface 35 are penetrated through the grooves 321 of the circuit board 32 and the slots 3112 of the plastic tongue plate 311. After the metallic casing 38 is sheathed around the outer periphery of the combination of the first plastic main body 31 and the second plastic main body 33 along the assembling direction S35, the electrical receptacle 30 is assembled.

In this embodiment, the plastic tongue plate 311 and the circuit board 32 may be collaboratively defined as a composite tongue plate structure. The contact resilience arm segments 351 of the USB 2.0 signal interface 35 are located at the top side of the composite tongue plate structure and exposed to the first docking space 371. Moreover, the contact pads 341 of the eSATA signal interface 34 are located at the bottom side of the composite tongue plate structure and exposed to the second docking space 372.

Moreover, after the first plastic main body 31 and the second plastic main body 33 are combined together, the seven pin segments 344 of the eSATA signal interface 34 and the five contact segments 364 of the USB 3.0 signal interface 36 are accommodated within respective ones of twelve receiving holes 333 of the second plastic main body 33 (see FIG. 9). It is noted that the four pin segments 354 of the USB 2.0 signal interface 35 are not accommodated within the second plastic main body 33.

In this embodiment, the second plastic main body 33 (i.e. the rear cover) comprises a plurality of fixing recesses 3311, 3312 and a plurality of receiving holes 333. Moreover, a sidewall 330 of the second plastic main body 33 (i.e. the rear cover) is exposed to or arranged beside the second docking space 372.

Moreover, a motherboard 300 is shown in FIG. 11 but not shown in FIGS. 8~10. The motherboard 300 has a plurality of insertion holes 3001, 3002 and 3003. The pin segments 344 of the first signal interface 34 (i.e. the eSATA signal interface), the pin segments 354 of the second signal interface 35 (i.e. the USB 2.0 signal interface) and the pin segments 364 of the USB 3.0 signal interface 36 are inserted into the insertion holes 3001, 3002 and 3003, respectively. After the pin segments 344, 354 and 364 are welded to the insertion holes 3001, 3002 and 3003, the electrical receptacle 30 is welded on the motherboard 300.

Moreover, after the second signal interface 35 is fixed on the second plastic main body 33 (i.e. the rear cover), no additional structural member is arranged between the pin segments 354 of the second signal interface 35 and the motherboard 300. In other words, a first end 3541 of the pin segment 354 is connected to the fixture segment 353, and a second end 3542 of the pin segment 354 is inserted into the motherboard 300. Moreover, after the first signal interface 34 is arranged between the first plastic main body 31 and the second plastic main body 33 and the third signal interface 36 is installed on first plastic main body 31, the pin segments 344 and 364 are penetrated through the receiving holes 333 of the second plastic main body 33 (i.e. the rear cover), and then welded on the motherboard 300.

The electrical receptacle of the third embodiment has benefits identical to those of the first embodiment. Moreover, since portions of the signal interface structure segments of the USB 2.0 signal interface 35 are previously distributed to the second plastic main body 33 and separated from the USB 3.0 signal interface 36 by a spacing interval, the signal interference between the USB 2.0 signal interface 35 and the USB 3.0 signal interface 36 will be minimized.

Figure 12:
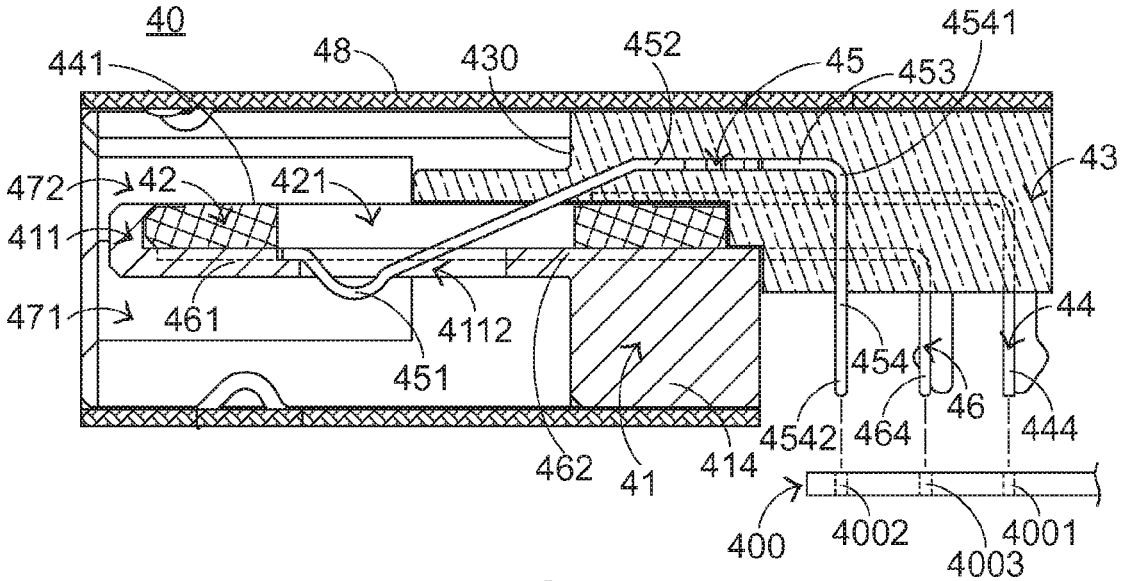
FIG. 12 is a schematic side view illustrating the electrical receptacle to be mounted on a motherboard according to a fourth embodiment of the present invention.

FIG. 12 is a schematic side view illustrating the electrical receptacle to be mounted on a motherboard according to a fourth embodiment of the present invention. As shown in FIG. 12, the electrical receptacle 40 comprises a first plastic main body 41, a plastic tongue plate 411, a circuit board 42, and a second plastic main body 43. The first plastic main body 41 has a first docking space 471 and a second docking space 472. The plastic tongue plate 411 is fixed on a sidewall of a bottom part 414 of the first plastic main body 41 and extended toward the front side. Moreover, the circuit board 42 is disposed over the plastic tongue plate 411.

From front to back, the signal interface structure segments of the first signal interface 44 (e.g. an eSATA signal interface) successively comprise a plurality of contact pads 441, a plurality of extension wires, a plurality of fixture segments 443, and a plurality of pin segments 444. From front to back, the signal interface structure segments of the second signal interface 45 (e.g. a USB 2.0 signal interface) successively comprise a plurality of contact resilience arm segments 451, a plurality of extension segments 452, a plurality of fixture segments 453, and a plurality of pin segments 454. That is, the USB 2.0 signal interface 45 comprises a plurality of USB 2.0 metallic terminals.

From front to back, the signal interface structure segments of the third signal interface 46 (e.g. a USB 3.0 signal interface) successively comprise a plurality of contact segments 461, a plurality of extension segments 462, a plurality of fixture segments 463, and a plurality of pin segments 464. That is, the USB 3.0 signal interface 46 comprises a plurality of USB 3.0 metallic terminals.

In this embodiment, the eSATA signal interface 44 is installed on the top surface of the circuit board 42. The extension segments 452, the fixture segments 453 and the pin segments 454 of the USB 2.0 signal interface 45 are arranged beside the eSATA signal interface 44. The contact resilience arm segments 451 are penetrated downwardly from the top surface of the circuit board 42 and through four grooves 421 of the circuit board 42 and four slots 4112 of the plastic tongue plate 411, and exposed to the first docking space 471 beside the plastic tongue plate 411.

In this embodiment, the circuit board 42 and the plastic tongue plate 411 may be collaboratively defined as a composite tongue plate structure. The contact pads 441 of the eSATA signal interface 44 are located at the top side of the composite tongue plate structure and exposed to the second docking space 472. Moreover, the contact resilience arm segments 451 of the USB 2.0 signal interface 45 and the contact segments 461 of the third signal interface 46 are located at the bottom side of the composite tongue plate structure and exposed to the first docking space 471.

Moreover, in this embodiment, a sidewall 430 of the second plastic main body 43 (i.e. the rear cover) is exposed to or arranged beside the second docking space 472.

In this embodiment, the electrical receptacle 40 further comprises a metallic casing 48, which is sheathed around the outer periphery of the combination of the first plastic main body 41 and the second plastic main body 43.

In accordance with a key feature of the present invention, the second plastic main body 43 is a rear cover with a plurality of structure segment fixing spaces. For example, the structure segment fixing spaces are a plurality of fixing recesses with position-limiting structures (see also the third embodiment). The structure segment fixing spaces are used for accommodating and fixing the fixture segments 453 of the USB 2.0 signal interface 45 that are installed on the second plastic main body 43.

Moreover, a motherboard 400 is shown in FIG. 12. The motherboard 400 has a plurality of insertion holes 4001, 4002 and 4003. The pin segments 444 of the first signal interface 44 (i.e. the eSATA signal interface), the pin segments 454 of the second signal interface 45 (i.e. the USB 2.0 signal interface) and the pin segments 464 of the USB 3.0 signal interface 46 are inserted into the insertion holes 4001, 4002 and 4003, respectively. After the pin segments 444, 454 and 464 are welded to the insertion holes 4001, 4002 and 4003, the electrical receptacle 40 is welded on the motherboard 400.

Moreover, after the second signal interface 45 is fixed on the second plastic main body 43 (i.e. the rear cover), no additional structural member is arranged between the pin segments 454 of the second signal interface 45 and the motherboard 400. In other words, a first end 4541 of the pin segment 454 is connected to the fixture segment 453, and a second end 4542 of the pin segment 454 is inserted into the motherboard 400.

Hereinafter, some variants of the electrical receptacle of the present invention will be illustrated in more details. The functions or arrangements which are similar to the above embodiments will not be described herein.

Figure 13:
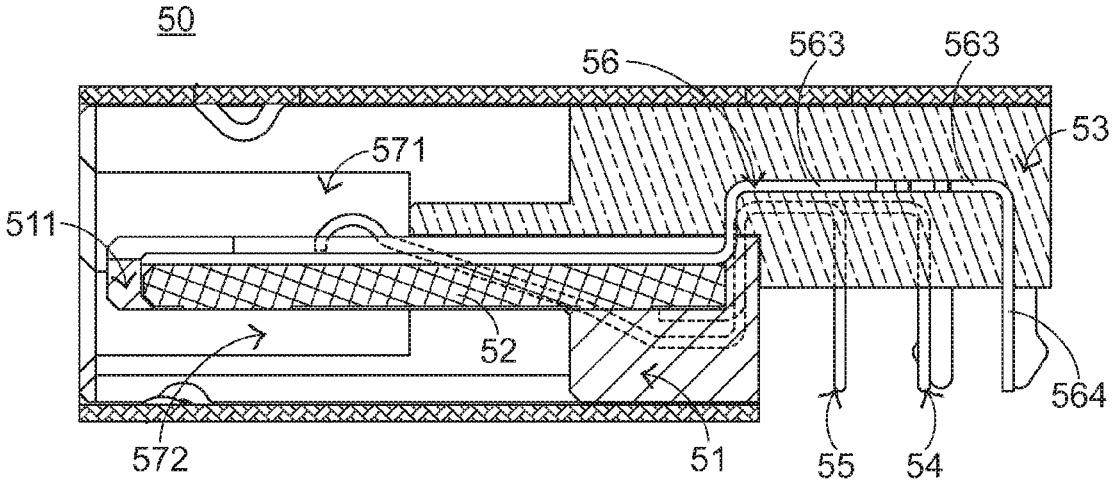
FIG. 13 is a schematic side view illustrating the electrical receptacle according to a fifth embodiment of the present invention.

FIG. 13 is a schematic side view illustrating the electrical receptacle according to a fifth embodiment of the present invention. Like the third embodiment, the electrical receptacle 50 as shown in FIG. 13 comprises a first plastic main body 51, a plastic tongue plate 511, a circuit board 52, a second plastic main body 53, a first signal interface 54 (e.g. an eSATA signal interface), a second signal interface 55 (e.g. a USB 2.0 signal interface), and a third signal interface 56 (e.g. a USB 3.0 signal interface). The first plastic main body 51 has a first docking space 571 and a second docking space 572. The plastic tongue plate 511 is fixed on a sidewall of a bottom part of the first plastic main body 51 and extended toward the front side. Moreover, the circuit board 52 is disposed under the plastic tongue plate 511.

In this embodiment, the fixture segments 563 of the USB 3.0 signal interface 56 are installed on the second plastic main body 53. Consequently, for assembling the electrical receptacle 50, the circuit board 52 and the second plastic main body 53 with the USB 3.0 signal interface 56 are moved forwardly to be combined with the first plastic main body 51.

Of course, after the USB 3.0 signal interface 56 is fixed on the second plastic main body 53, no additional structural member is arranged between the pin segments 564 of the USB 3.0 signal interface 56 and the motherboard (not shown).

Figure 14:
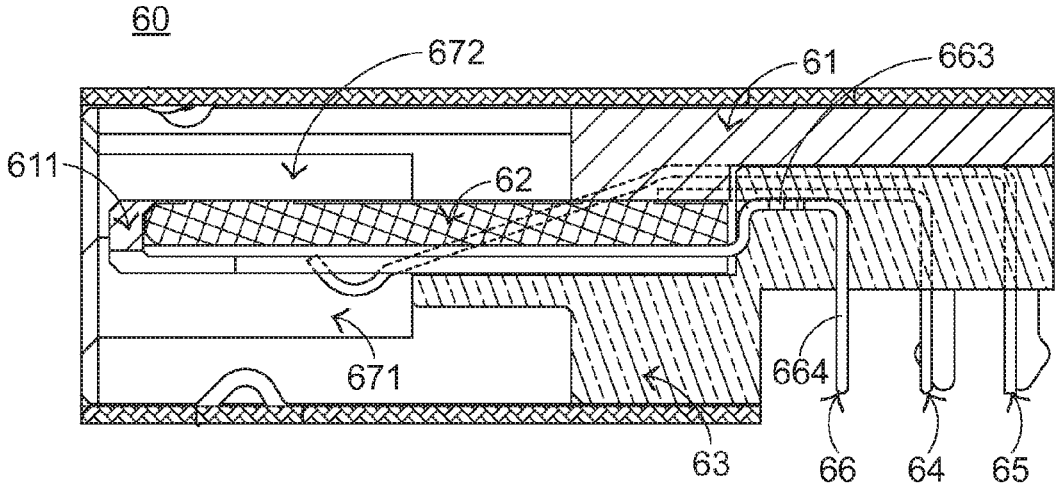
FIG. 14 is a schematic side view illustrating the electrical receptacle according to a sixth embodiment of the present invention.

FIG. 14 is a schematic side view illustrating the electrical receptacle according to a sixth embodiment of the present invention. Like the fifth embodiment, the electrical receptacle 60 as shown in FIG. 14 comprises a first plastic main body 61, a plastic tongue plate 611, a circuit board 62, a second plastic main body 63, a first signal interface 64 (e.g. an eSATA signal interface), a second signal interface 65 (e.g. a USB 2.0 signal interface), and a third signal interface 66 (e.g. a USB 3.0 signal interface). The first plastic main body 561 has a first docking space 671 and a second docking space 672. The plastic tongue plate 611 is fixed on a sidewall of a bottom part of the first plastic main body 61 and extended toward the front side. Moreover, the circuit board 62 is disposed over the plastic tongue plate 611. Like the fifth embodiment, the fixture segments 663 of the USB 3.0 signal interface 66 are installed on the second plastic main body 63. Consequently, for assembling the electrical receptacle 60, the circuit board 62 and the second plastic main body 53 with the USB 3.0 signal interface 66 are moved forwardly to be combined with the first plastic main body 61.

Of course, after the USB 3.0 signal interface 66 is fixed on the second plastic main body 63, no additional structural member is arranged between the pin segments 664 of the USB 3.0 signal interface 66 and the motherboard (not shown).

The following embodiments will be illustrated by referring to the electrical receptacle with the composite tongue plate structure including a fixed plastic tongue plate or a removable plastic tongue plate and at least one circuit board. In addition, each signal interface unit of any signal interface is composed of three structure segments, including a metallic contact part (e.g. a contact resilience arm segment or a contact pad or a contact segment), an extension segment (or an extension wire), and a pin segment.

Figure 15:
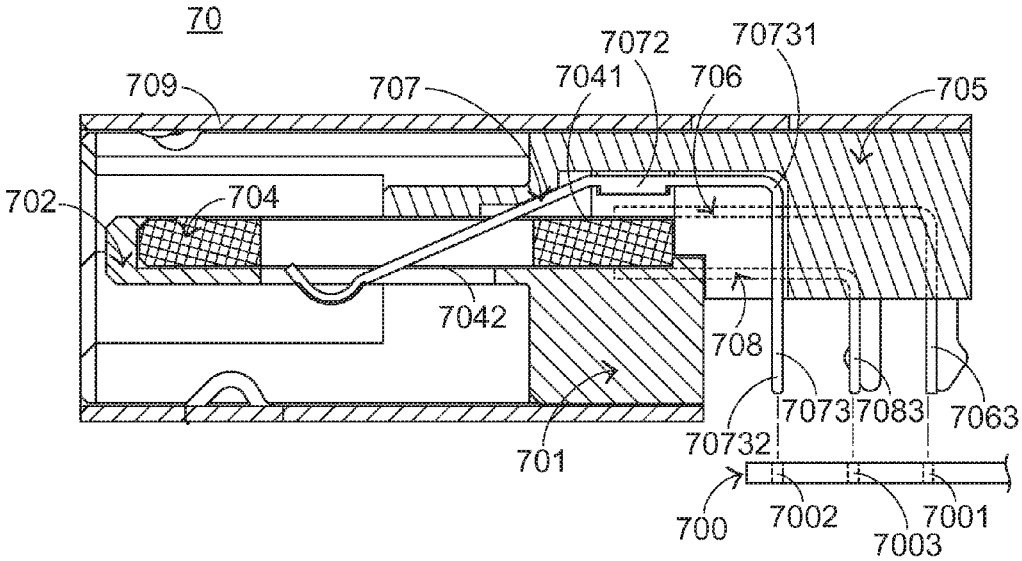
FIG. 15 is a schematic side view illustrating the electrical receptacle to be mounted on a motherboard according to a seventh embodiment of the present invention.

FIG. 15 is a schematic side view illustrating the electrical receptacle to be mounted on a motherboard according to a seventh embodiment of the present invention. Except for the following items, the other components and mechanisms of the electrical receptacle of this embodiment are similar to those of the fourth embodiment, and are not redundantly described herein.

In this embodiment, the extension segments 7072 of the second signal interface 707 of the electrical receptacle 70 are previously installed and fixed on the rear cover 705. In comparison with the fourth embodiment, the first signal interface 706 and the third signal interface 708 are welded on a first surface 7041 and a second surface 7042 of the circuit board 706, respectively. A process of assembling the electrical receptacle 70 will be illustrated as follows. Firstly, the circuit board 704 is accommodated within the receiving space of the tongue plate 702, which is installed on the plastic main body 701. That is, the circuit board 704 with the first signal interface 706 and the third signal interface 708 welded thereon is accommodated within the receiving space of the tongue plate 702. Then, the rear cover 7055 along with the second signal interface 707 is installed on the plastic main body 701. After the metallic casing 709 is sheathed around the outer periphery of the plastic main body 701, the electrical receptacle 70 is assembled.

In this embodiment, the USB 2.0 signal interface 707 is installed on the rear cover 705. In addition, a first end 70731 of the pin segment 7073 of the USB 2.0 signal interface 707 is connected to the extension segment 7072, and a second end 70732 of the pin segment 7073 is inserted into the motherboard 700. Moreover, no additional structural member is arranged between the pin segments 7073 of the USB 2.0 signal interface 707 and the motherboard 700. Moreover, the pin segments 7063 of the first signal interface 706, the pin segments 7073 of the second signal interface 707 and the pin segments 7083 of the USB 3.0 signal interface 708 are inserted into the insertion holes 7001, 7002 and 7003 of the motherboard 700, respectively.

Figure 16:
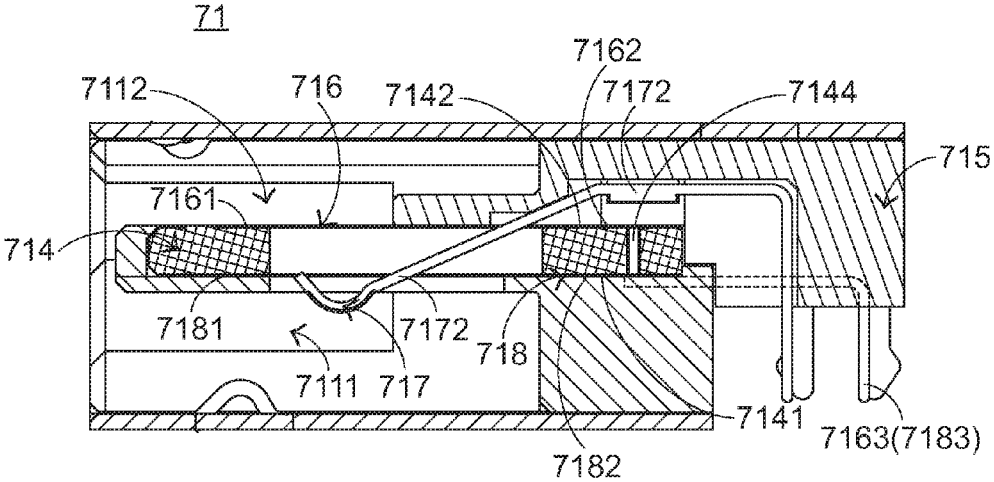
FIG. 16 is a schematic side view illustrating the electrical receptacle according to an eighth embodiment of the present invention.

FIG. 16 is a schematic side view illustrating the electrical receptacle according to an eighth embodiment of the present invention. Except for the following items, the other components and mechanisms of the electrical receptacle of this embodiment are similar to those of the seventh embodiment, and are not redundantly described herein.

In comparison with the seventh embodiment, the circuit board 714 of the electrical receptacle 71 has a plurality of conductive holes 7144 running through the first surface 7141 and the second surface 7142 of the circuit board 714. The contact pads 7161 and the extension wires 7161 of the first signal interface 716 are disposed on the second surface 7142 of the circuit board 714 or accommodated within the second docking space 7112 beside the second surface 7142 of the circuit board 714. The pin segments 7163 of the first signal interface 716 are welded on the respective soldering regions of the conductive holes 7144 at the first surface 7141 of the circuit board 714. Moreover, the conductive holes 7144 run through the first surface 7141 and the second surface 7142 of the circuit board 714, and are electrically connected with the extension wires 7162. In this embodiment, the pin segments 7163 of the first signal interface 716 and respective pin segments 7183 of the third signal interface 718 are shared with each other.

A portion of the signal interface structure segments of the second signal interface 717 (e.g. the last half of the segment 7172) and the contact pad 7161 and the extension wire 7162 of the first signal interface 716 are arranged beside each other and located at the same side of the circuit board 714 (i.e. disposed on the second surface 7142 of the circuit board 714, or disposed within the second docking space 7112 beside the second surface 7142 of the circuit board 714). Moreover, another portion of the signal interface structure segments of the second signal interface 717 (e.g. the first half of the segment 7172) and the contact pad 7181 and the extension wire 7182 of the third signal interface 718 are arranged beside each other and located at the same side of the circuit board 714 (i.e. disposed on the first surface 7141 of the circuit board 714, or disposed within the first docking space 7111 beside the first surface 7141 of the circuit board 714).

In this embodiment, the extension segments 7072 of the second signal interface 717 are also previously installed and fixed on the rear cover 715.

Figure 17:
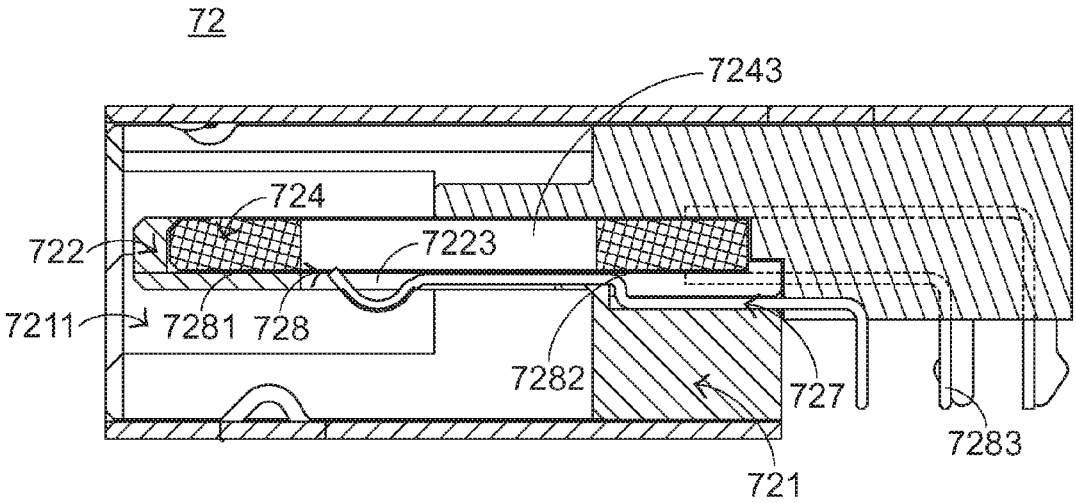
FIG. 17 is a schematic side view illustrating the electrical receptacle according to a ninth embodiment of the present invention.

FIG. 17 is a schematic side view illustrating the electrical receptacle according to a ninth embodiment of the present invention. Except for the following items, the other components and mechanisms of the electrical receptacle of this embodiment are similar to those of the seventh embodiment, and are not redundantly described herein.

In comparison with the seventh embodiment, the second signal interface 727 of the electrical receptacle 72 is directly installed on the plastic main body 721. Moreover, the second signal interface 727 is arranged between the tongue plate 722 and the circuit board 724. Consequently, the second signal interface 727 is not penetrated through the grooves 7243 of the circuit board 724, but only penetrated through the slots 7223 of the tongue plate 722 to be exposed to the first docking space 7211.

Moreover, the contact pads 7281 and the extension wires 7282 of the third signal interface 728 are disposed on the circuit board 724. The pin segments 7283 of the third signal interface 728 are welded on the extension wires 7282 which are disposed on the circuit board 724.

Figure 18:
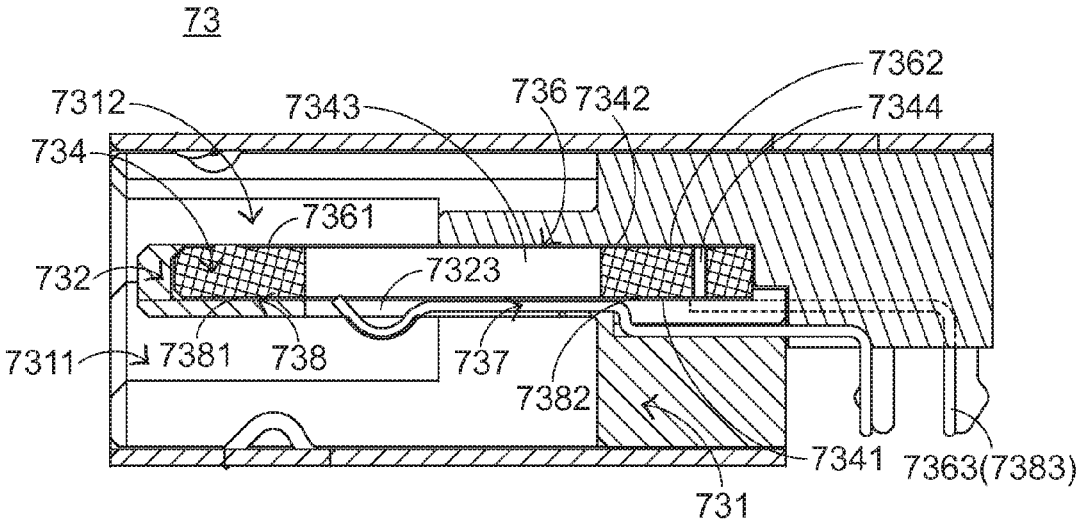
FIG. 18 is a schematic side view illustrating the electrical receptacle according to a tenth embodiment of the present invention.

FIG. 18 is a schematic side view illustrating the electrical receptacle according to a tenth embodiment of the present invention. Except for the following items, the other components and mechanisms of the electrical receptacle of this embodiment are similar to those of the eighth embodiment, and are not redundantly described herein.

In comparison with the eighth embodiment, the second signal interface 737 of the electrical receptacle 73 is directly installed on the tongue plate 732 of the plastic main body 731. Moreover, the second signal interface 737 is arranged between the tongue plate 732 and the circuit board 734. Consequently, the second signal interface 737 is not penetrated through the grooves 7343 of the circuit board 734, but only penetrated through the slots 7323 of the tongue plate 732 to be exposed to the first docking space 7311.

Moreover, the contact pads 7361 and the extension wires 7362 of the first signal interface 736 are disposed on the second surface 7342 of the circuit board 734, or accommodated within the second docking space 7312 beside the second surface 7342 of the circuit board 734. The pin segments 7363 of the first signal interface 736 are welded on respective soldering regions of the conductive holes 7344 at the first surface 7373 of the circuit board 734. Moreover, the conductive holes 7344 run through the first surface 7373 and the second surface 7342 of the circuit board 734, and are electrically connected with the extension wires 7362. In this embodiment, the pin segments 7363 of the first signal interface 736 and respective pin segments 7383 of the third signal interface 738 are shared with each other.

The second signal interface 737 and the pin segment 7363 of the first signal interface 736 are arranged beside each other and located at the same side of the circuit board 734 (i.e. disposed on the first surface 7373 of the circuit board 734, or disposed within the first docking space 7311 beside the first surface 7373 of the circuit board 734). Moreover, the second signal interface 737 and the contact pad 7381 and the extension wire 7382 of the third signal interface 738 are arranged beside each other and exposed to the same docking space (i.e. the first docking space 7311).

Figure 19:
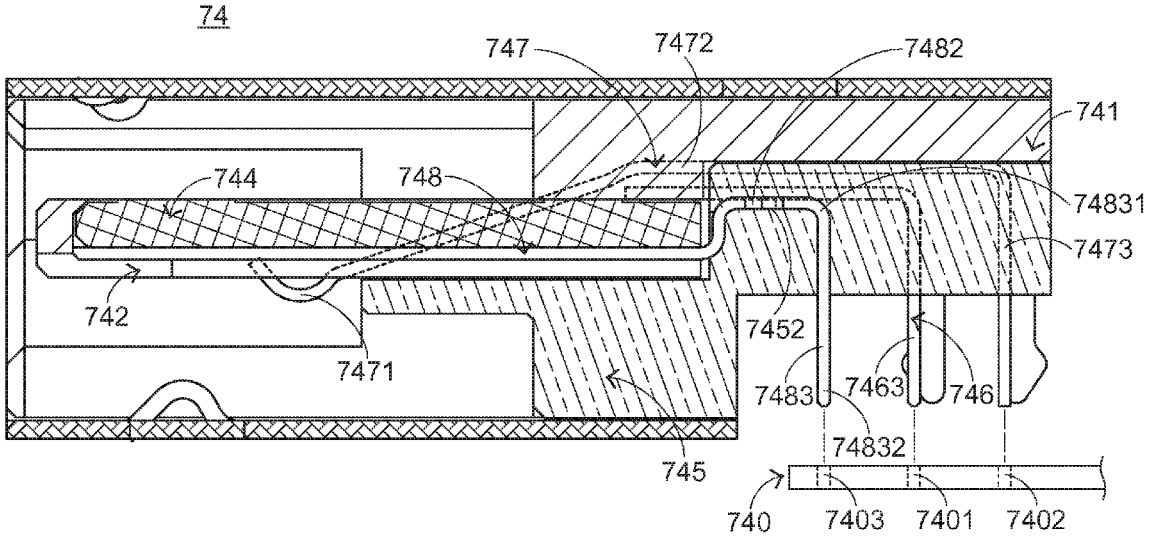
FIG. 19 is a schematic side view illustrating the electrical receptacle to be mounted on a motherboard according to an eleventh embodiment of the present invention.

FIG. 19 is a schematic side view illustrating the electrical receptacle to be mounted on a motherboard according to an eleventh embodiment of the present invention. Except for the following items, the other components and mechanisms of the electrical receptacle of this embodiment are similar to those of the fourth embodiment, and are not redundantly described herein.

In comparison with the fourth embodiment, the rear end of the extension segment 7482 and the pin segment 7483 of the third signal interface 748 are previously installed on the rear cover 745. That is, the rear cover 745 of the electrical receptacle 74 further comprises a plurality of fixing recesses 7452 for previously accommodating and fixing the extension segment 7482 of the third signal interface 748. Alternatively, the second signal interface 747 is not necessarily installed on the rear cover 745 or the circuit board 744. For example, the extension segments 7472 of the second signal interface 747 are installed on the plastic main body 741, and the pin segments 7473 are penetrated through the rear cover 745.

After the third signal interface 748 is fixed on the rear cover 745, no additional structural member is arranged between the pin segment 7483 of the third signal interface 748 and the motherboard 740. In addition, a first end 74831 of the pin segment 7483 of the third signal interface 748 is connected to the extension segment 7482, and a second end 74832 of the pin segment 7483 is inserted into the motherboard 700. Moreover, the pin segments 7463 of the first signal interface 746, the pin segments 7473 of the second signal interface 747 and the pin segments 7483 of the third signal interface 748 are inserted into the insertion holes 7401, 7402 and 7403 of the motherboard 740, respectively.

In this embodiment, the fixed plastic tongue plate 742 and the circuit board 744 are collaboratively defined as a composite tongue plate structure. The contact resilience arm segments 7471 of the second signal interface 747 are penetrated through the slots (not shown) of the fixed plastic tongue plate 742 and the grooves (not shown) of the circuit board 744.

Figure 20:
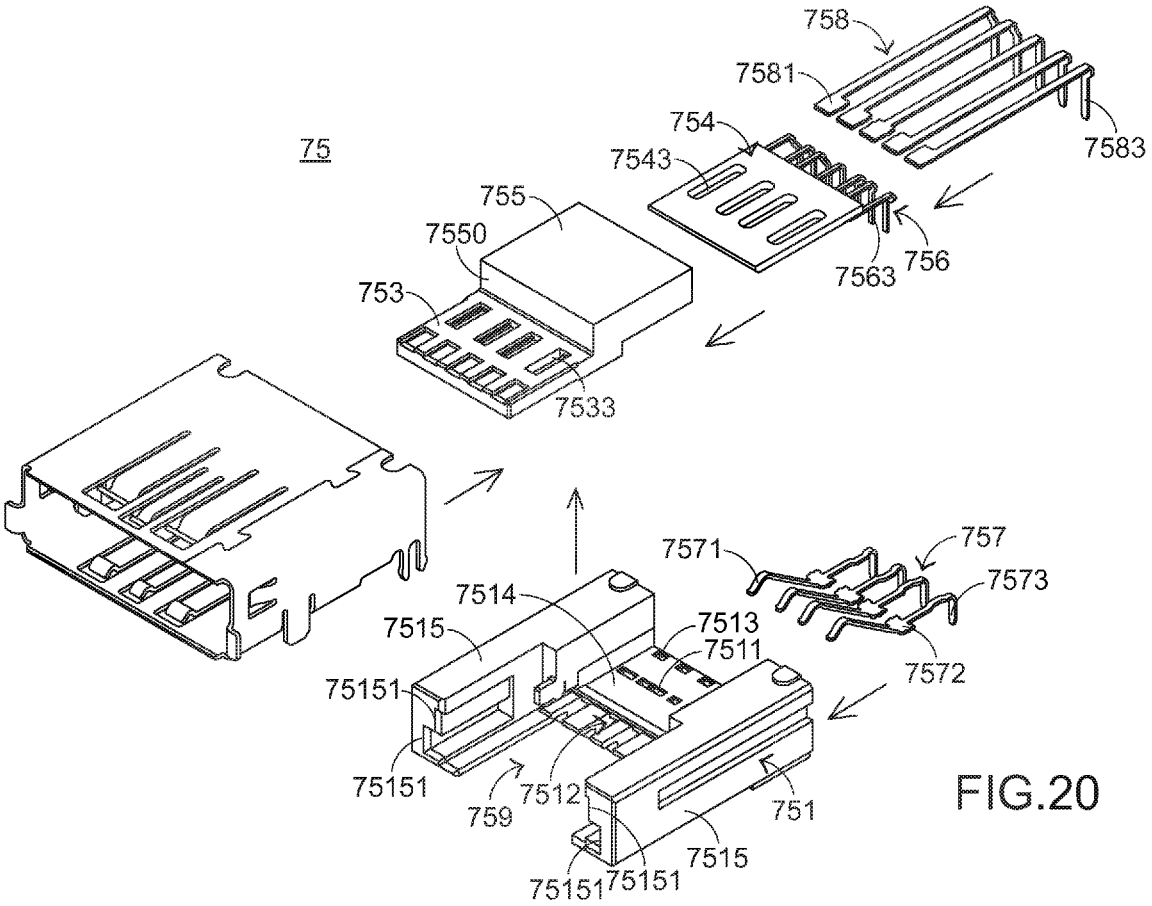
FIG. 20 is a schematic exploded view illustrating an electrical receptacle according to a twelfth embodiment of the present invention.
Figure 21:
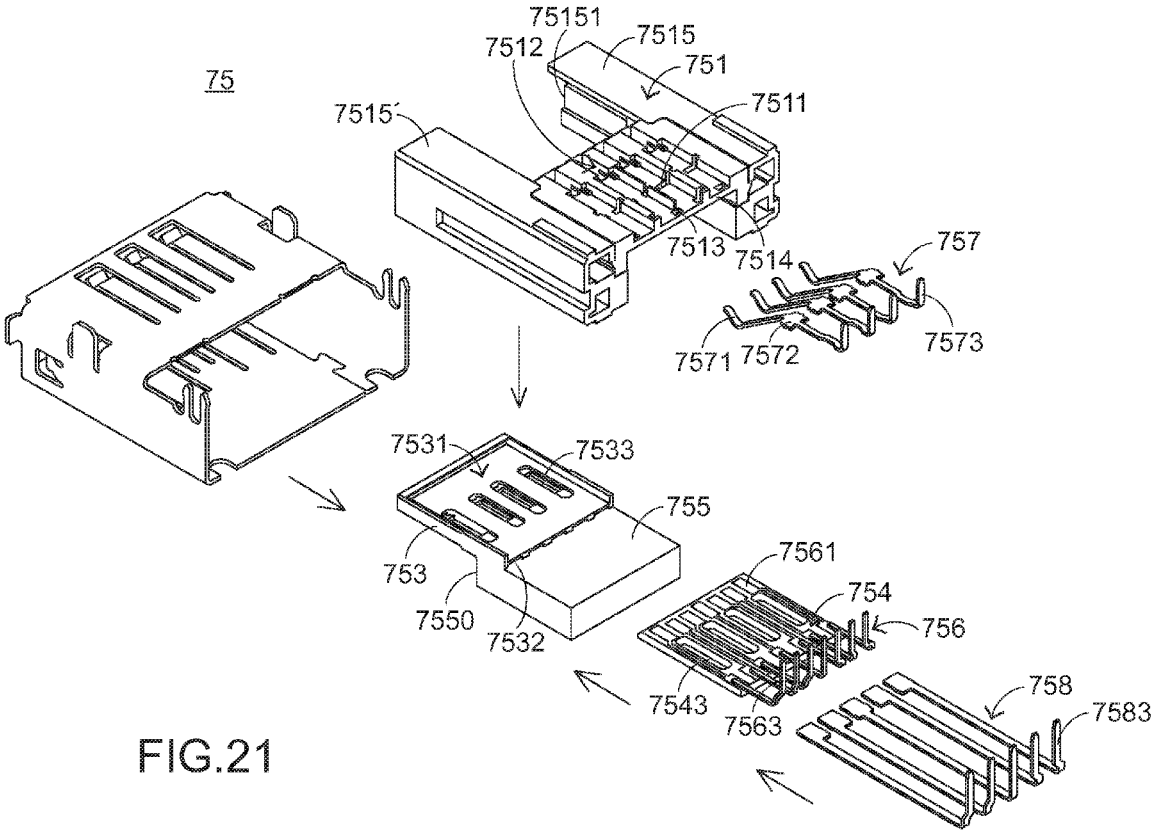
FIG. 21 is a schematic exploded view illustrating the electrical receptacle of the twelfth and taken along another viewpoint.

FIG. 20 is a schematic exploded view illustrating an electrical receptacle according to a twelfth embodiment of the present invention. FIG. 21 is a schematic exploded view illustrating the electrical receptacle of the twelfth and taken along another viewpoint. Except for the following items, the other components and mechanisms of the electrical receptacle of this embodiment are similar to those of the third embodiment, and are not redundantly described herein.

In comparison with the third embodiment, the plastic tongue plate 753 of the electrical receptacle 75 is a removable plastic tongue plate. The plastic tongue plate 753 is integrally formed with the rear cover 755. Moreover, the extension segments 7572 of the second signal interface 757 are previously accommodated within the fixing recesses 7512 of the plastic main body 751, but not installed on the circuit board 754.

Moreover, the plastic main body 751 has a thin bottom part 7515, and a plurality of fixing holes 7511, 7513 and a plurality of fixing recesses 7512 are formed in the bottom part 7515 of the plastic main body 751. Two lateral walls 7515 are disposed on the thin bottom part 7514 of the plastic main body 751 and extended toward the front side. Moreover, a shared profile 75151 mating with various signal interfaces of an electrical plug (see FIG. 61) is located at the front peripheries of the two lateral walls 7515. Consequently, the two lateral walls 7515 can support the plastic main body 751 and provide the shared profile 75151 to achieve the all-in-one electrical receptacle.

In this embodiment, the circuit board 754 with the first signal interface 756 is receiving within a receiving space 7531 of the removable plastic tongue plate 753. The third signal interface 758 is accommodated within the terminal recesses 7532 of the removable plastic tongue plate 753. During the process of assembling the electrical receptacle 75, the pin segments 7563 of the first signal interface 756 and the pin segments 7583 of the third signal interface 758 are accommodated within the receiving holes 7511 and 7513 of the plastic main body 751, and then these pin segments are welded on a motherboard (not shown).

In this embodiment, the removable plastic tongue plate 753 and the circuit board 754 are collaboratively defined as the composite tongue plate structure. The contact resilience arm segments 7571 of the second signal interface 757 are penetrated through the slots 7533 of the removable plastic tongue plate 753 and the grooves 7543 of the circuit board 754.

In this embodiment, the contact resilience arm segments 7571 of the second signal interface 75 are located at the top side of the composite tongue plate structure, and the contact segments 7581 of the third signal interface 758 and the contact pads 5611 of the eSATA signal interface 756 are located at the bottom side of the composite tongue plate structure.

Moreover, a sidewall 7550 of the rear cover 755 is exposed to or arranged beside at least one docking space 759.

Of course, after the second signal interface 757 is fixed on the plastic main body 751, no additional structural member is arranged between the pin segments 7573 of the second signal interface 757 and the motherboard (not shown).

Moreover, the receiving holes 7511 and 7513 of the plastic main body 751 are arranged between the pin segments 7563, 7583 of the first signal interface 756 and the third signal interface 758 and the motherboard (not shown).

Figure 22:
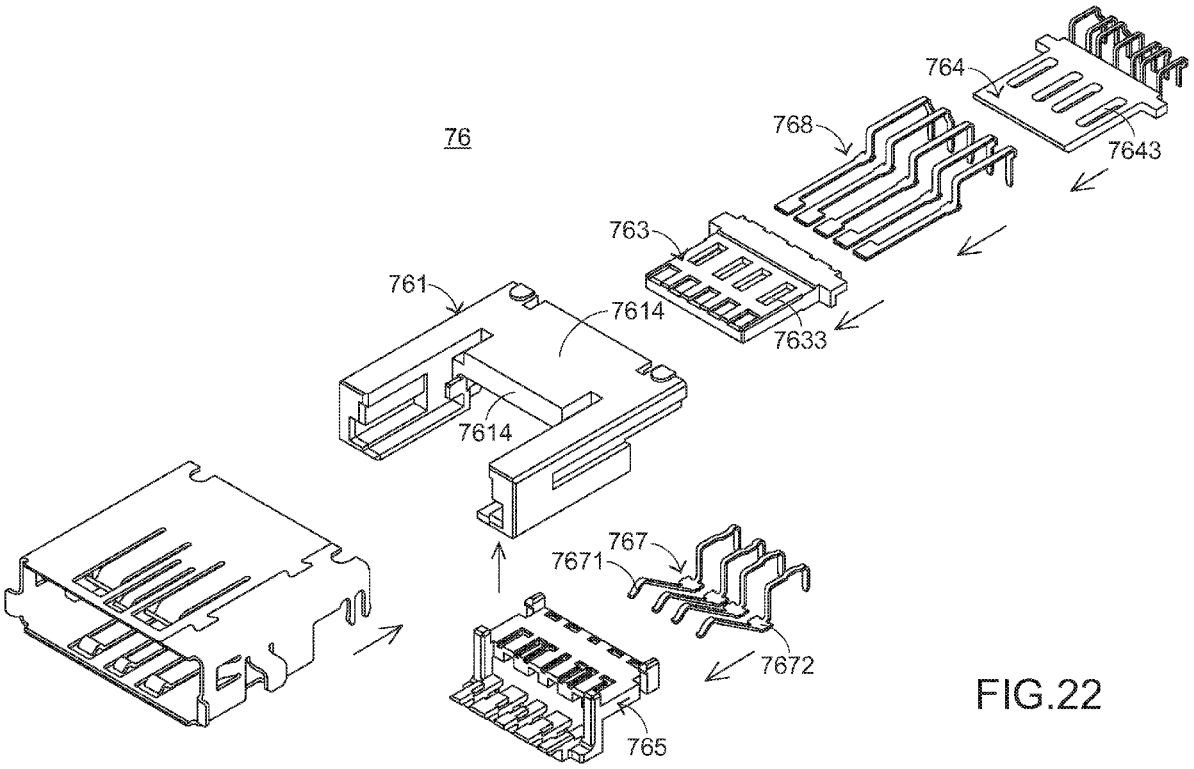
FIG. 22 is a schematic exploded view illustrating an electrical receptacle according to a thirteenth embodiment of the present invention.
Figure 23:
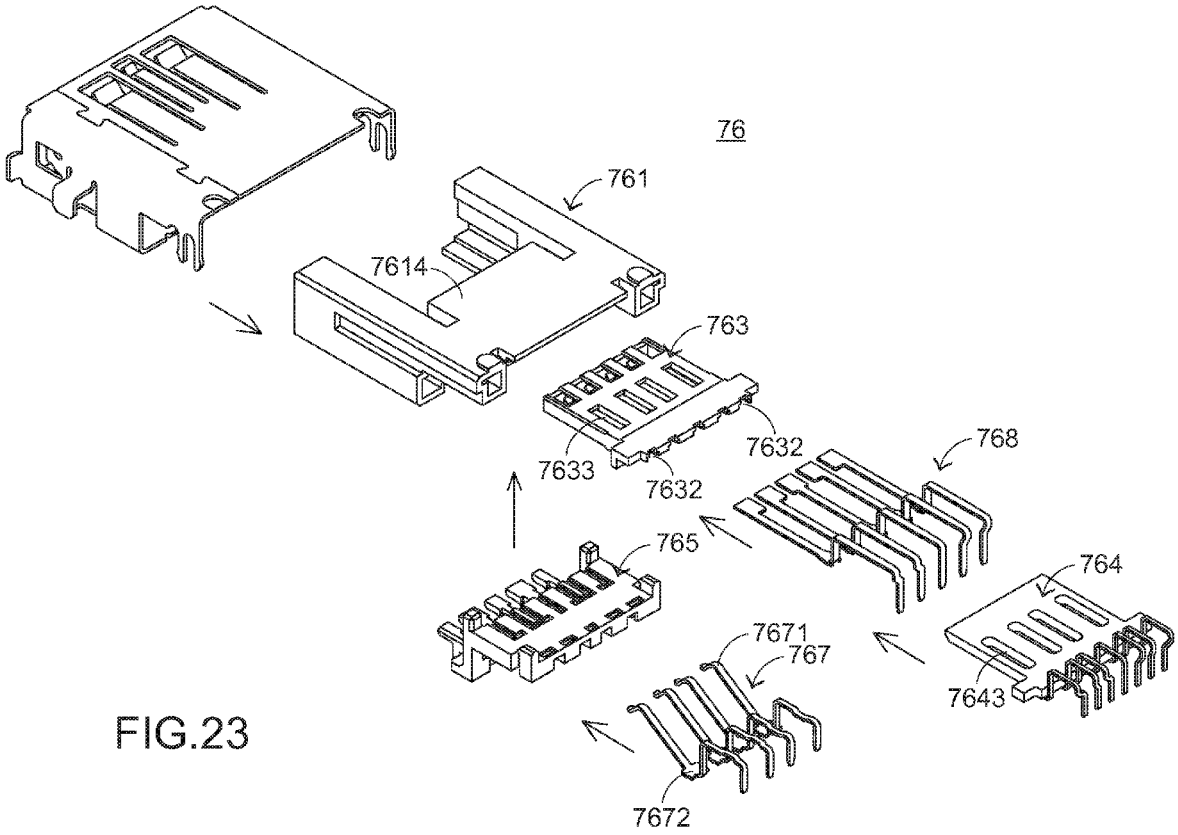
FIG. 23 is a schematic exploded view illustrating the electrical receptacle of the thirteenth and taken along another viewpoint.

FIG. 22 is a schematic exploded view illustrating an electrical receptacle according to a thirteenth embodiment of the present invention. FIG. 23 is a schematic exploded view illustrating the electrical receptacle of the thirteenth and taken along another viewpoint. Except for the following items, the other components and mechanisms of the electrical receptacle of this embodiment are similar to those of the third embodiment, and are not redundantly described herein.

In comparison with the third embodiment, the plastic tongue plate 763 of the electrical receptacle 76 is a removable plastic tongue plate. Moreover, the plastic tongue plate 763 is an individual component to be combined with the plastic main body 761. That is, the plastic tongue plate 763 is not extended from a sidewall of the bottom part 7614 of the plastic main body 761.

In this embodiment, a first signal interface 766 is installed on the circuit board 764. The removable plastic tongue plate 763 and the circuit board 766 are collaboratively defined as the composite tongue plate structure. Moreover, the contact resilience arm segments 7671 of the second signal interface 767 are penetrated through the slots 7633 of the removable plastic tongue plate 763 and the grooves 7643 of the circuit board 764. Moreover, the third signal interface 768 is accommodated within the terminal recesses 7632 of the removable plastic tongue plate 763.

The following embodiments will be illustrated by referring to the electrical receptacle with the composite tongue plate structure including two plastic tongue plates, wherein each of the plastic tongue plates is a fixed plastic tongue plate or a removable plastic tongue plate. In addition, each signal interface unit of any signal interface is composed of three structure segments, including a metallic contact part (e.g. a contact resilience arm segment or a contact pad or a contact segment), an extension segment (or an extension wire), and a pin segment.

Figure 24:
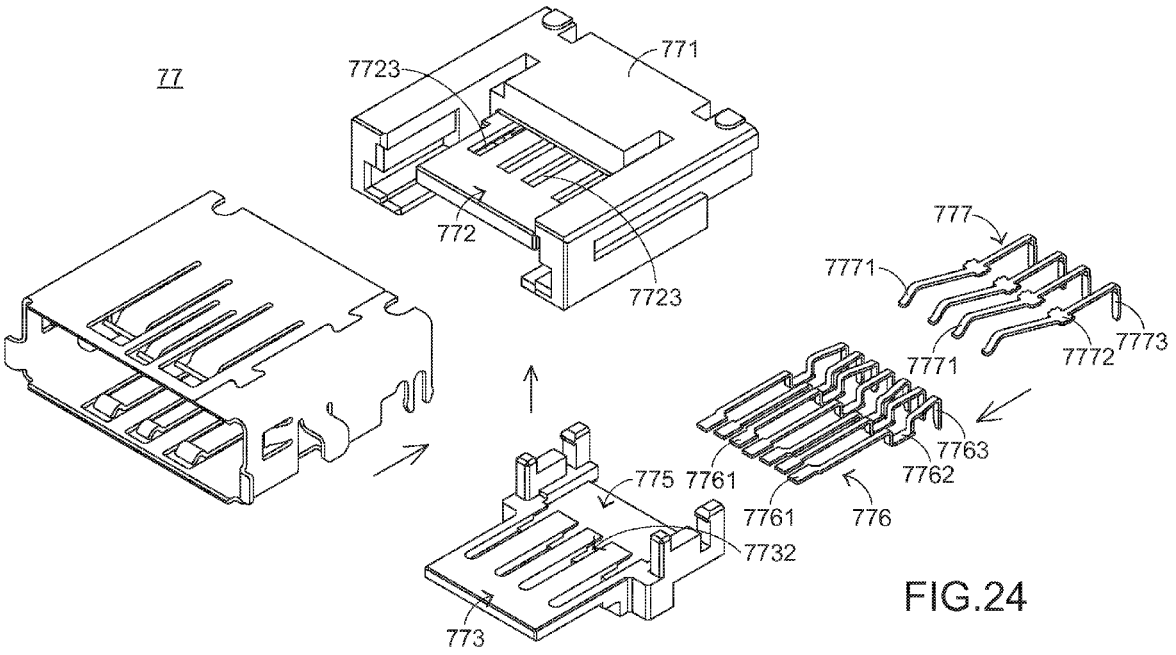
FIG. 24 is a schematic exploded view illustrating an electrical receptacle according to a fourteenth embodiment of the present invention.
Figure 25:
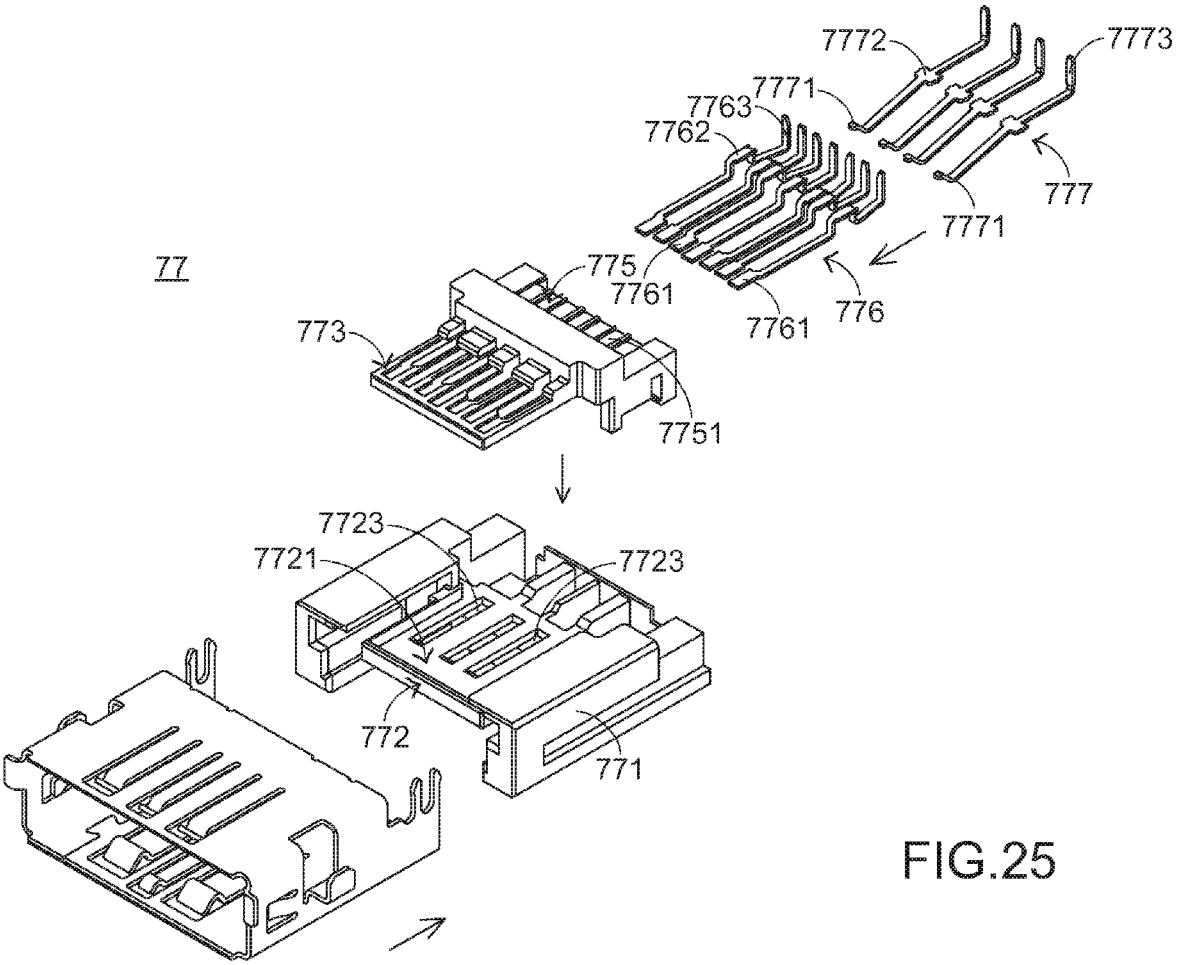
FIG. 25 is a schematic exploded view illustrating the electrical receptacle of the fourteenth and taken along another viewpoint.

FIG. 24 is a schematic exploded view illustrating an electrical receptacle according to a fourteenth embodiment of the present invention. FIG. 25 is a schematic exploded view illustrating the electrical receptacle of the fourteenth and taken along another viewpoint. Except for the following items, the other components and mechanisms of the electrical receptacle of this embodiment are similar to those of the above embodiments, and are not redundantly described herein.

In comparison with the first embodiment, the electrical receptacle 77 of the fourteenth embodiment further comprises a removable plastic tongue plate 773 to replace the circuit board. Moreover, the removable plastic tongue plate 773 is integrally formed with the rear cover 775. The first signal interface 776 and the second signal interface 777 are both accommodated within the removable plastic tongue plate 773 and the rear cover 775. The extension segments 7762 of the first signal interface 776 and the extension segments 7772 of the second signal interface 777 are previously accommodated and fixed within the fixing recesses 7751 and 7732, which are formed in the combined structure of the removable plastic tongue plate 773 and the rear cover 775.

After the first signal interface 776 and the second signal interface 777 are fixed on the combined structure of the removable plastic tongue plate 773 and the rear cover 775, no additional structural member is arranged between the pin segments 7763, 7773 and the motherboard (not shown). Moreover, the first signal interface 776 and the second signal interface 777 are respectively conductive terminal groups. The conductive terminals of each conductive terminal group are separated from each other and not electrically with each other.

In this embodiment, the fixed plastic tongue plate 772 and the removable plastic tongue plate 773 are collaboratively defined as the composite tongue plate structure. The removable plastic tongue plate 773 is accommodated within a receiving space 7721 of the fixed plastic tongue plate 772. Moreover, the contact resilience arm segments 7771 of the second signal interface 777 are penetrated through the slots 7723 of the fixed plastic tongue plate 772 and the slots 7733 of the removable plastic tongue plate 773.

In this embodiment, the first signal interface 776 is an eSATA signal interface, and the second signal interface 777 is a USB 2.0 signal interface. Consequently, the metallic contact part (i.e. the contact resilience arm segments 7771) of the second signal interface 777 is located at the top side of the composite tongue plate structure, and the metallic contact part (i.e. the contact segments 7761) is located at the bottom side of the composite tongue plate structure.

Figure 26:
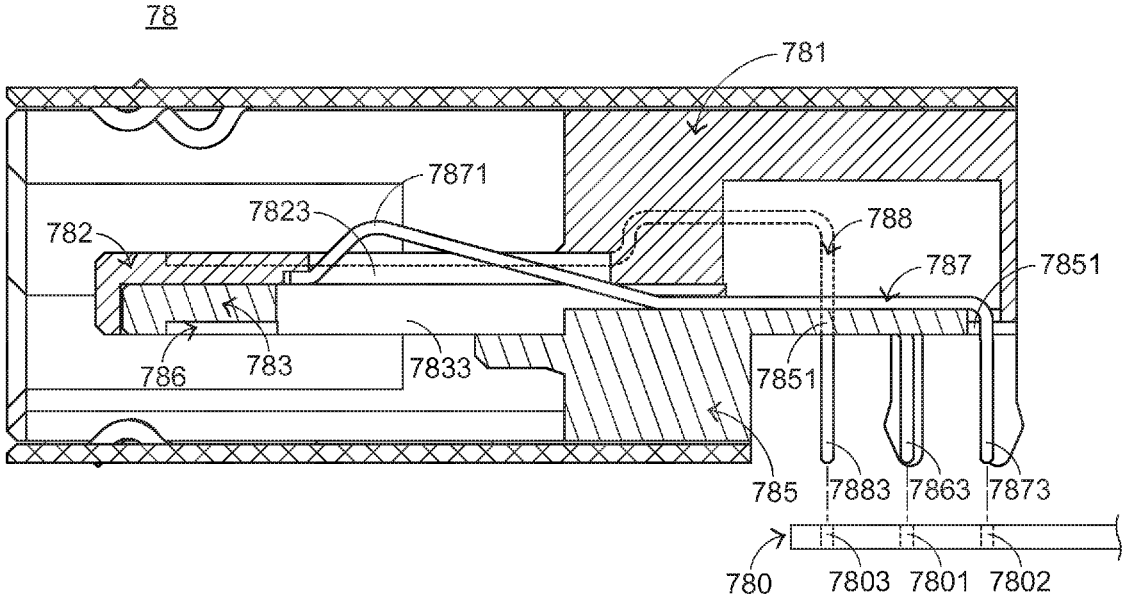
FIG. 26 is a schematic side view illustrating the electrical receptacle to be mounted on a motherboard according to a fifteenth embodiment of the present invention.

FIG. 26 is a schematic side view illustrating the electrical receptacle to be mounted on a motherboard according to a fifteenth embodiment of the present invention. Except for the following items, the other components and mechanisms of the electrical receptacle of this embodiment are similar to those of the third and fourteenth embodiments, and are not redundantly described herein.

In comparison with the fourteenth embodiment, the electrical receptacle 78 of this embodiment further comprises a removable plastic tongue plate 783 to replace the circuit board. Moreover, the removable plastic tongue plate 783 is integrally formed with the rear cover 785. The first signal interface 786 and the second signal interface 787 are both accommodated within the within the fixing recesses (not shown, but may be referred to FIGS. 24 and 25), which are formed in the combined structure of the removable plastic tongue plate 783 and the rear cover 785. The third signal interface 788 is accommodated within the plastic main body 781 and the fixed plastic tongue plate 782, which is extended from the plastic main body 781.

In this embodiment, the fixed plastic tongue plate 782 and the removable plastic tongue plate 783 are collaboratively defined as the composite tongue plate structure. Moreover, the contact resilience arm segments 7871 of the second signal interface 787 are penetrated through the slots 7823 of the fixed plastic tongue plate 782 and the slots 7833 of the removable plastic tongue plate 783.

Moreover, the rear cover 785 has a plurality of receiving holes 7851 for accommodating the pin segments 7833 of the third signal interface 788. The pin segments 7863 of the first signal interface 786 and the pin segments 7873 of the second signal interface 787 are bent downwardly from the bottom side and the top side of the combined structure of the removable plastic tongue plate 783 and the rear cover 785, respectively.

After the first signal interface 786 and the second signal interface 787 are fixed on the combined structure of the removable plastic tongue plate 783 and the rear cover 785, no additional structural member is arranged between the pin segments 7863, 7873 and the motherboard 780. Moreover, the pin segments 7863 of the first signal interface 786, the pin segments 7873 of the second signal interface 787 and the pin segments 7883 of the third signal interface 788 accommodated within the receiving holes 7851 are inserted into the insertion holes 7801, 7802 and 7803 of the motherboard 780, respectively.

Moreover, the first signal interface 786, the second signal interface 787 and the third signal interface 788 are respectively conductive terminal groups. The conductive terminals of each conductive terminal group are separated from each other and not electrically with each other.

Figure 27:
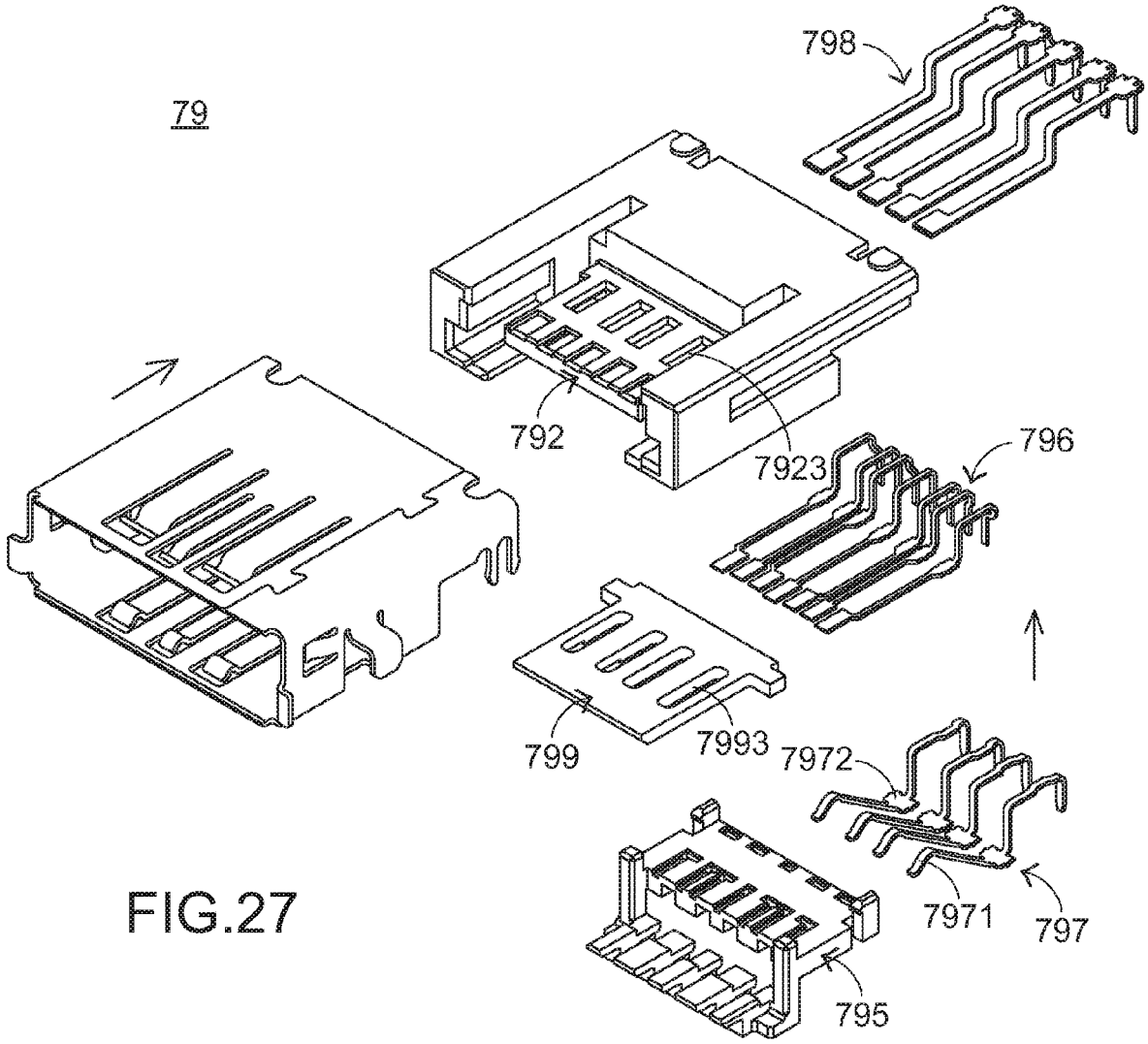
FIG. 27 is a schematic exploded view illustrating an electrical receptacle according to a sixteenth embodiment of the present invention.

FIG. 27 is a schematic exploded view illustrating an electrical receptacle according to a sixteenth embodiment of the present invention. Except for the following items, the other components and mechanisms of the electrical receptacle of this embodiment are similar to those of the fifteenth embodiment, and are not redundantly described herein.

In comparison with the fifteenth embodiment, the removable plastic tongue plate 799 and the rear cover 795 of the electrical receptacle 79 of this embodiment are both individual components. The extension segments 7972 of the second signal interface 797 are previously installed and fixed on the rear cover 795. Moreover, the first signal interface 796 is accommodated within the removable plastic tongue plate 799. Moreover, the third signal interface 798 is accommodated within the fixed plastic tongue plate 792.

In this embodiment, the removable plastic tongue plate 799 and the fixed plastic tongue plate 782 are collaboratively defined as the composite tongue plate structure. Moreover, the contact resilience arm segments 7971 of the second signal interface 797 are penetrated through the slots 7923 of the fixed plastic tongue plate 792 and the slots 7993 of the removable plastic tongue plate 799.

Figure 28:
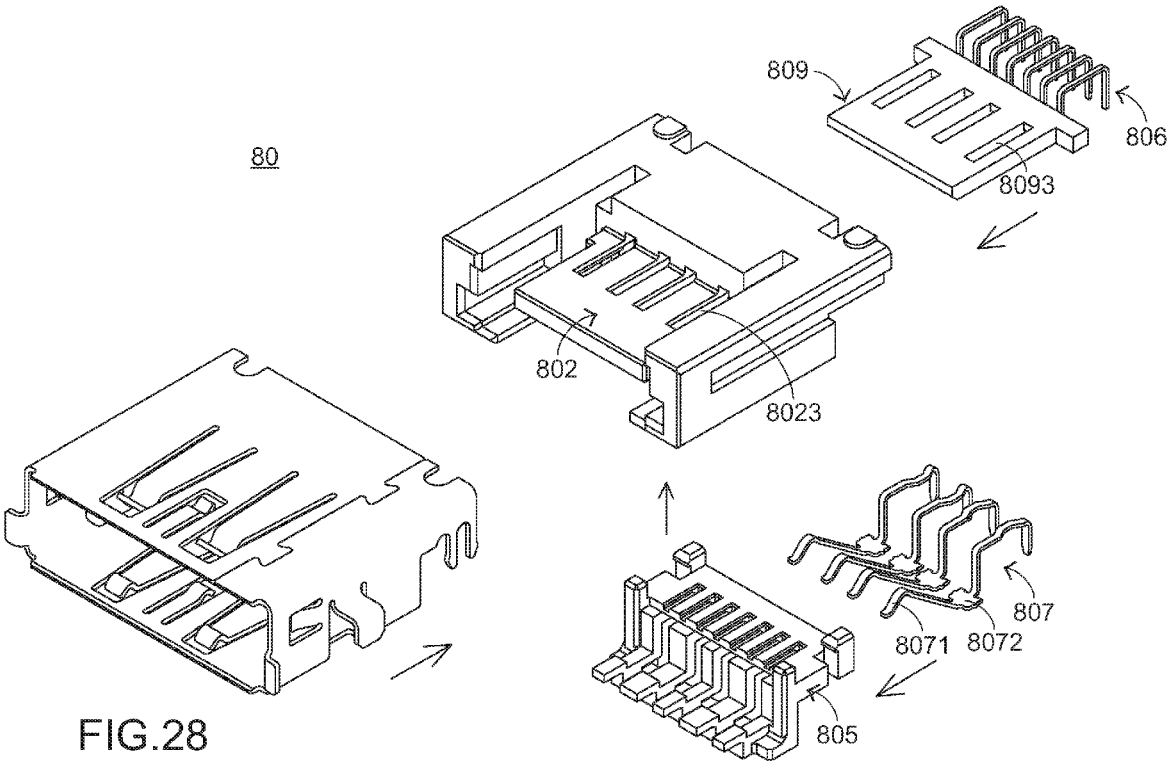
FIG. 28 is a schematic exploded view illustrating an electrical receptacle according to a seventeenth embodiment of the present invention.
Figure 29:
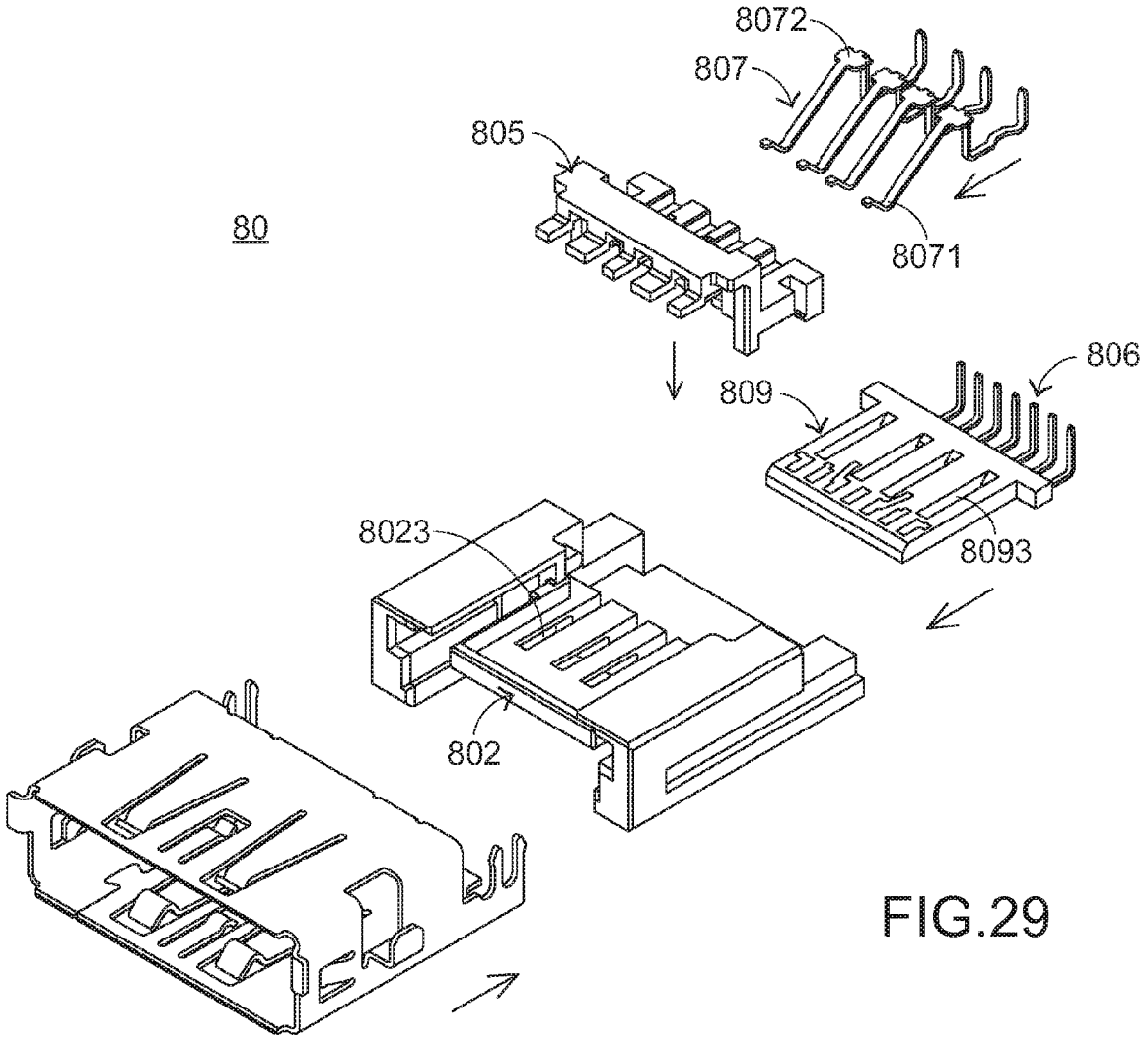
FIG. 29 is a schematic exploded view illustrating the electrical receptacle of the seventeenth and taken along another viewpoint.

The following embodiments will be illustrated by referring to the electrical receptacle with a composite tongue plate structure including two plastic tongue plates. One of these two plastic tongue plates is a fixed plastic tongue plate, and the other is a removable plastic insert molding tongue plate with at least one signal interface structure segment. In addition, each signal interface unit of any signal interface is composed of three structure segments, including a metallic contact part (e.g. a contact resilience arm segment or a contact pad or a contact segment), an extension segment (or an extension wire), and a pin segment FIG. 28 is a schematic exploded view illustrating an electrical receptacle according to a seventeenth embodiment of the present invention. FIG. 29 is a schematic exploded view illustrating the electrical receptacle of the seventeenth and taken along another viewpoint. Except for the following items, the other components and mechanisms of the electrical receptacle of this embodiment are similar to those of the first embodiment, and are not redundantly described herein.

In comparison with the first embodiment, the electrical receptacle 80 of this embodiment further comprises a removable plastic insert molding tongue plate 809 to replace the circuit board. The first signal interface 806 and the removable plastic insert molding tongue plate 809 are combined together by a plastic insert molding process. Moreover, the extension segments 8072 of the second signal interface 807 may be previously installed and fixed on the rear cover 805.

In this embodiment, the fixed plastic tongue plate 802 and the removable plastic insert molding tongue plate 809 are collaboratively defined as the composite tongue plate structure. Moreover, the contact resilience arm segments 8071 of the second signal interface 807 are penetrated through the slots 8023 of the fixed plastic tongue plate 802 and the slots 8093 of the removable plastic tongue plate 809.

Figure 30:
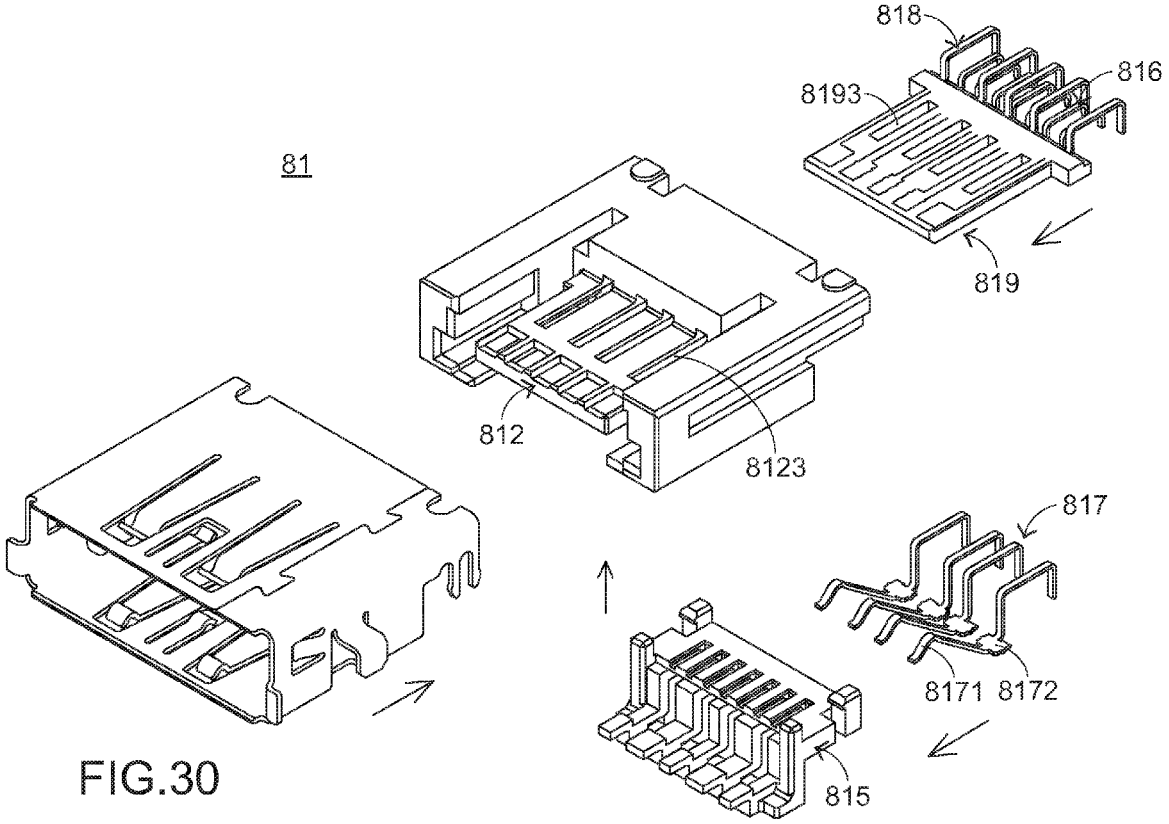
FIG. 30 is a schematic exploded view illustrating an electrical receptacle according to an eighteenth embodiment of the present invention.
Figure 31:
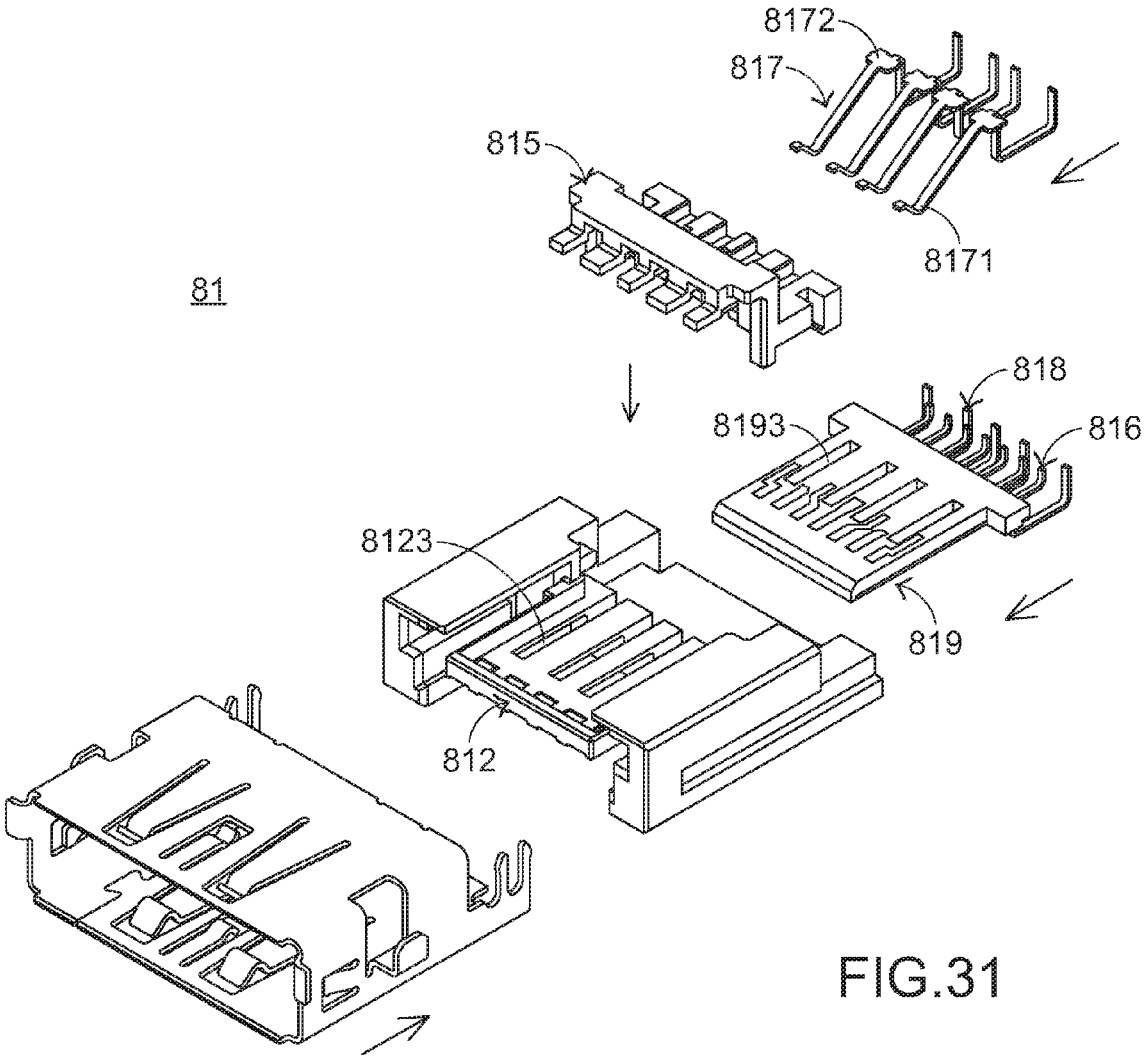
FIG. 31 is a schematic exploded view illustrating the electrical receptacle of the eighteenth and taken along another viewpoint.

FIG. 30 is a schematic exploded view illustrating an electrical receptacle according to an eighteenth embodiment of the present invention. FIG. 31 is a schematic exploded view illustrating the electrical receptacle of the eighteenth and taken along another viewpoint. Except for the following items, the other components and mechanisms of the electrical receptacle of this embodiment are similar to those of the third embodiment, and are not redundantly described herein.

In comparison with the third embodiment, the electrical receptacle 81 of this embodiment further comprises a removable plastic insert molding tongue plate 819 to replace the circuit board. The first signal interface 816, the third signal interface 818 and the removable plastic insert molding tongue plate 819 are combined together by a plastic insert molding process. Moreover, the extension segments 8172 of the second signal interface 817 may be previously installed and fixed on the rear cover 815.

In this embodiment, the fixed plastic tongue plate 812 and the removable plastic insert molding tongue plate 819 are collaboratively defined as the composite tongue plate structure. Moreover, the contact resilience arm segments 8171 of the second signal interface 817 are penetrated through the slots 8123 of the fixed plastic tongue plate 812 and the slots 8193 of the removable plastic tongue plate 819.

Figure 32:
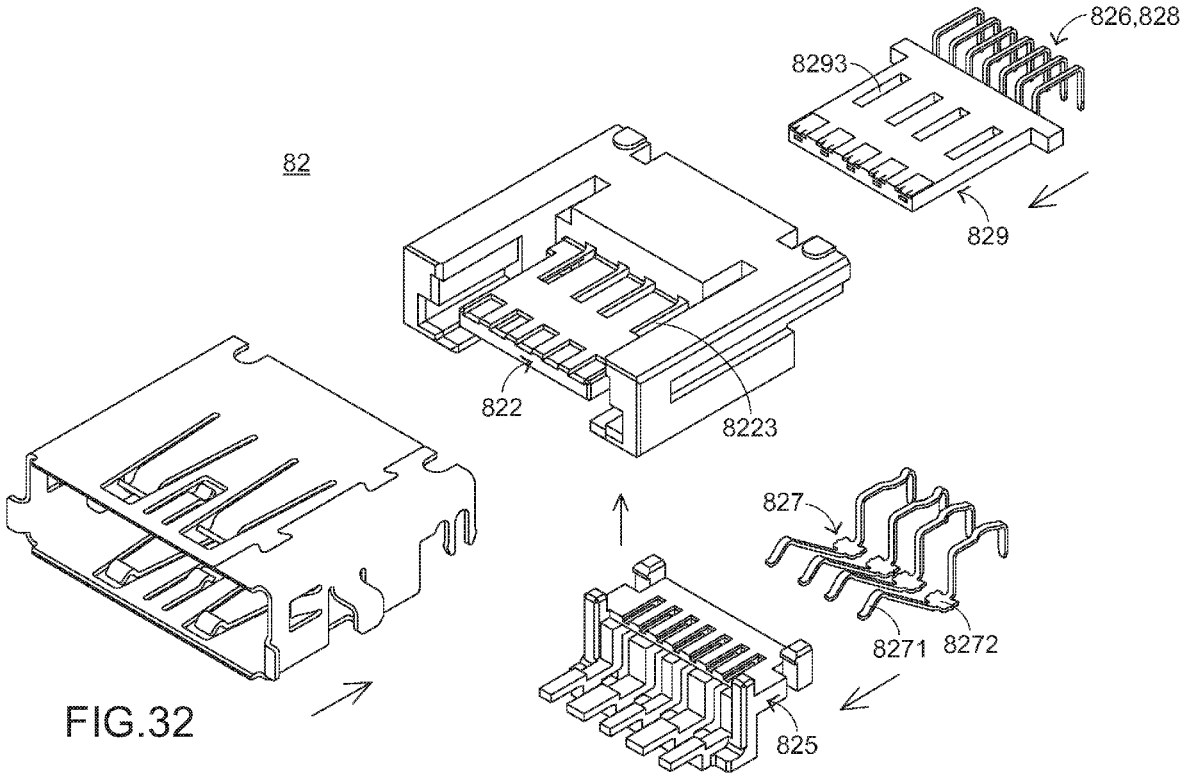
FIG. 32 is a schematic exploded view illustrating an electrical receptacle according to a nineteenth embodiment of the present invention.
Figure 33:
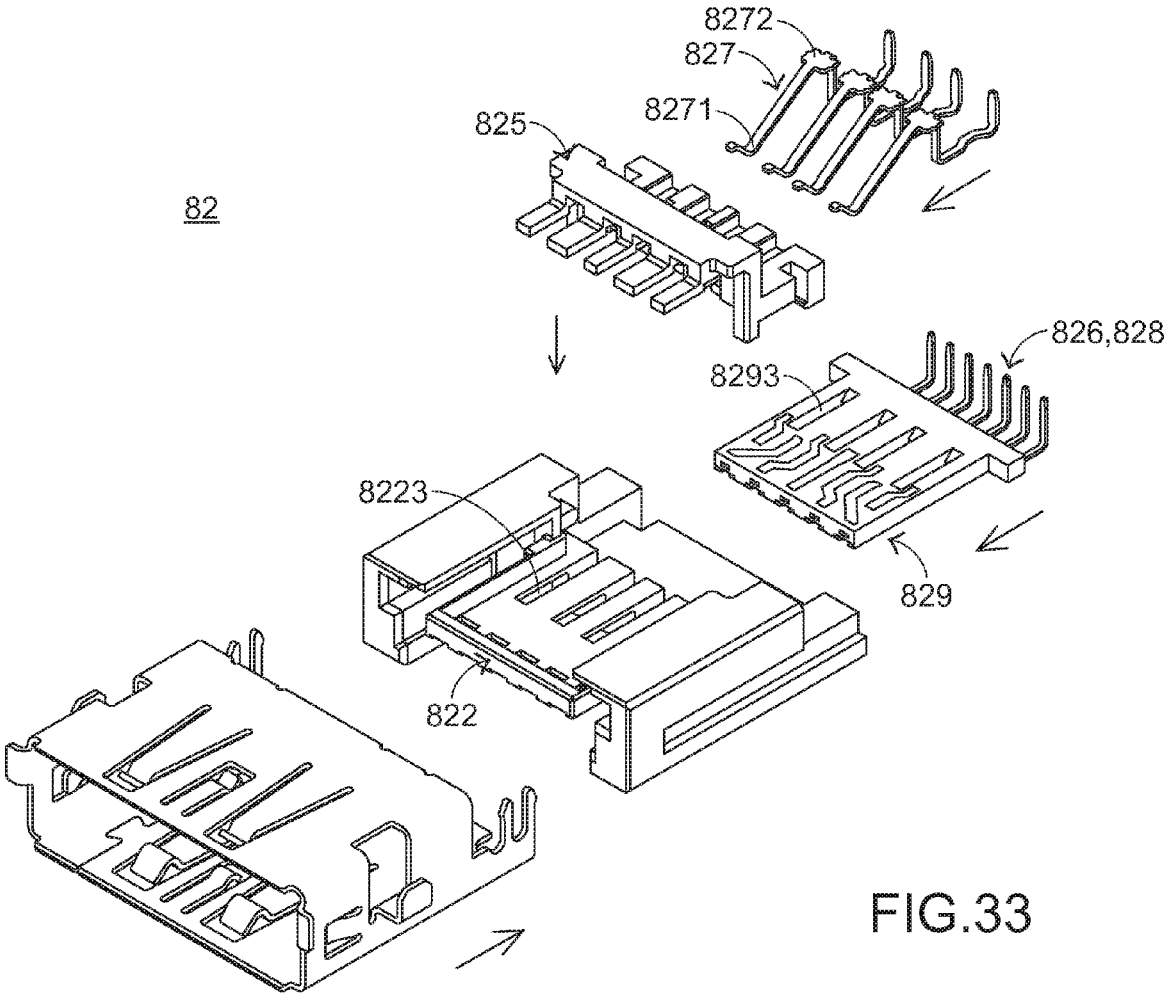
FIG. 33 is a schematic exploded view illustrating the electrical receptacle of the nineteenth and taken along another viewpoint.

FIG. 32 is a schematic exploded view illustrating an electrical receptacle according to a nineteenth embodiment of the present invention. FIG. 33 is a schematic exploded view illustrating the electrical receptacle of the nineteenth and taken along another viewpoint. Except for the following items, the other components and mechanisms of the electrical receptacle of this embodiment are similar to those of the eighteenth embodiment, and are not redundantly described herein.

In comparison with the eighteenth embodiment, the first signal interface 826 and the third signal interface 828 have shared pin segments. The first signal interface 826, the third signal interface 828 and the removable plastic insert molding tongue plate 829 are combined together by a plastic insert molding process.

In this embodiment, the fixed plastic tongue plate 822 and the removable plastic insert molding tongue plate 829 are collaboratively defined as the composite tongue plate structure. Moreover, the contact resilience arm segments 8271 of the second signal interface 827 are penetrated through the slots 8223 of the fixed plastic tongue plate 822 and the slots 8293 of the removable plastic tongue plate 829. Moreover, the extension segments 8272 of the second signal interface 827 may be previously installed and fixed on the rear cover 825.

The following embodiments will be illustrated by referring to the electrical receptacle with the composite tongue plate structure complying with a single communication protocol (e.g. the USB 3.0 communication protocol). Consequently, the electrical plug may be inserted into the electrical receptacle in a forward or reverse docking direction.

Figure 34:
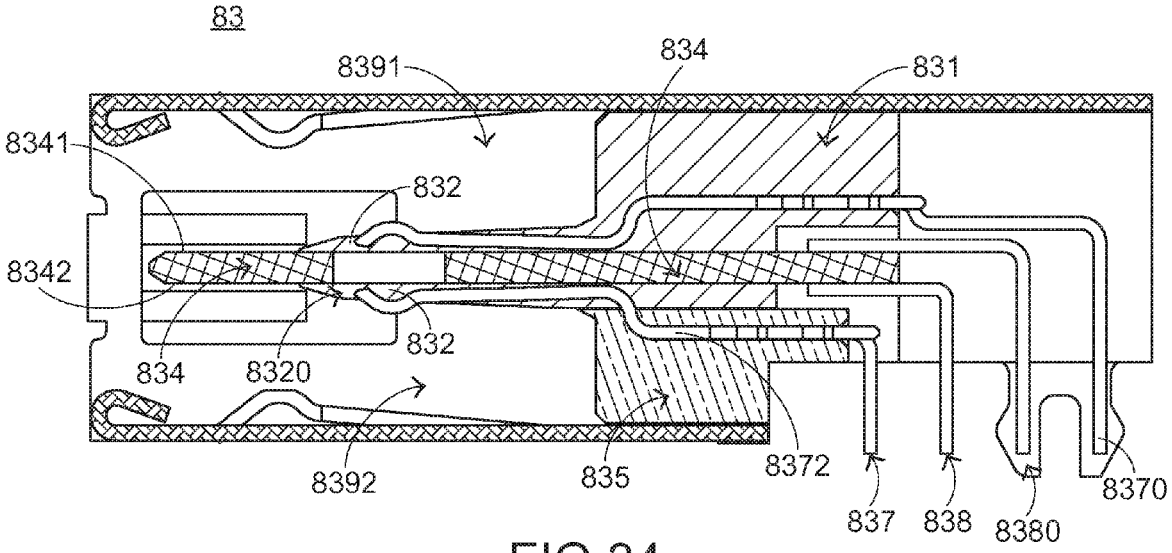
FIG. 34 is a schematic side view illustrating an electrical receptacle to be mounted on a motherboard according to a twentieth embodiment of the present invention.

FIG. 34 is a schematic side view illustrating an electrical receptacle to be mounted on a motherboard according to a twentieth embodiment of the present invention. As shown in FIG. 34, the electrical receptacle 83 comprises a plastic main body 831 (also referred as a first insulating main body), a circuit board 834, two 5-terminal USB 3.0 signal interfaces 8380, 838, and two 4-terminal USB 2.0 signal interfaces 8370, 837 (i.e. the total terminal number is 8). The first plastic main body 831 has a first docking space 8391 and a second docking space 8392. The USB 3.0 signal interfaces 8380 and 838 are located at the top side 8341 and the bottom side 8342 of the circuit board 834, respectively. The USB 2.0 signal interfaces 8370 and 837 are located at the top side 8341 and the bottom side 8342 of the circuit board 834, respectively.

In this embodiment, the tongue plate 832 is fixed on a sidewall of a bottom part of the plastic main body 831 and extended toward the front side. A receiving space 8320 for accommodating the circuit board 834 is arranged between the top surface and the bottom surface of the tongue plate 832.

Moreover, the extension segments 8372 of the USB 2.0 signal interface 837 are previously installed on and fixed on the rear cover 835 (also referred as a second insulating main body). Consequently, for assembling the electrical receptacle 83, the rear cover 835 with the 4-terminal USB 2.0 signal interface 837 is moved upwardly to be combined with the plastic main body 831.

In the following embodiments, the composite tongue plate structure is applied to the electrical receptacle with the signal interfaces other than the eSATA signal interface and the USB signal interface. It is to be noted that the following descriptions of preferred embodiments of this invention are presented herein for purpose of illustration and description only.

Figure 35:
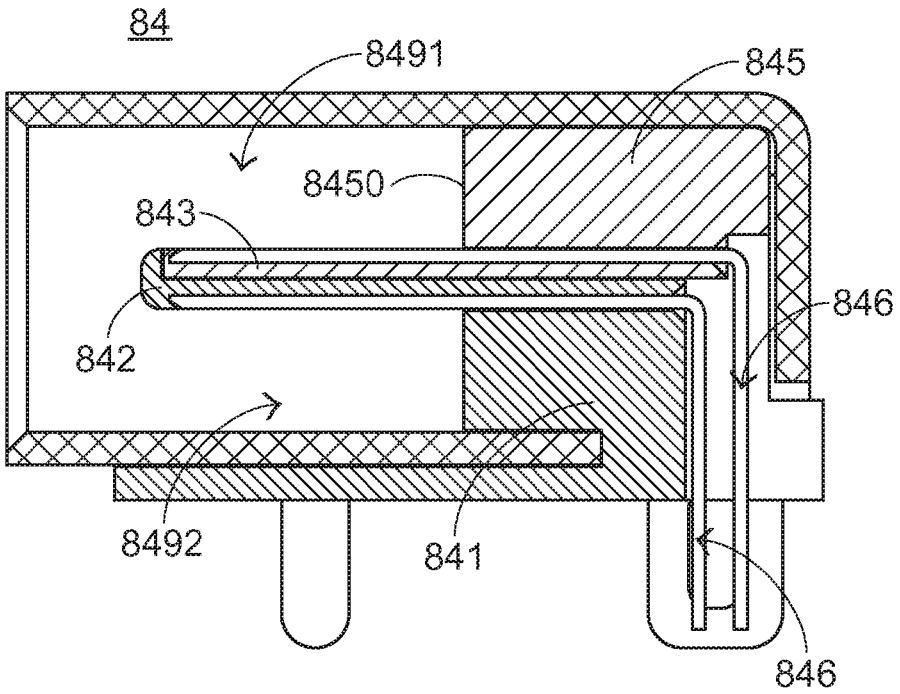
FIG. 35 is a schematic side view illustrating an electrical receptacle to be mounted on a motherboard according to a twenty-first embodiment of the present invention.

FIG. 35 is a schematic side view illustrating an electrical receptacle to be mounted on a motherboard according to a twenty-first embodiment of the present invention. The electrical receptacle 84 is an electrical receptacle complying with a high definition multimedia interface (HDMI) protocol. In this embodiment, a fixed plastic tongue plate 842 is integrally formed with the plastic main body 841. In addition, a removable plastic tongue plate 843 is integrally formed with the rear cover 845. That is, the fixed plastic tongue plate 842 and the removable plastic insert molding tongue plate 843 are collaboratively defined as the composite tongue plate structure. Moreover, a first docking space 8491 and a second docking space 8492 are located at the top side and the bottom side of the composite tongue plate structure, respectively. A sidewall 8450 of the rear cover 845 is exposed to or arranged beside the first docking space 8491.

Moreover, a HDMI signal interface 846 is installed and fixed on the fixed plastic tongue plate 842, and another HDMI signal interface 846 is installed and fixed on the removable plastic insert molding tongue plate 843, which is integrally formed with the rear cover 845. Consequently, the HDMI signal interface structure segment (at least including a metallic contact part and an extension segment) is installed on each of the top side and the bottom side of the composite tongue plate structure.

Of course, no additional structural member is arranged between the pin segments of the HDMI signal interface 846 and the motherboard (not shown).

Figure 36:
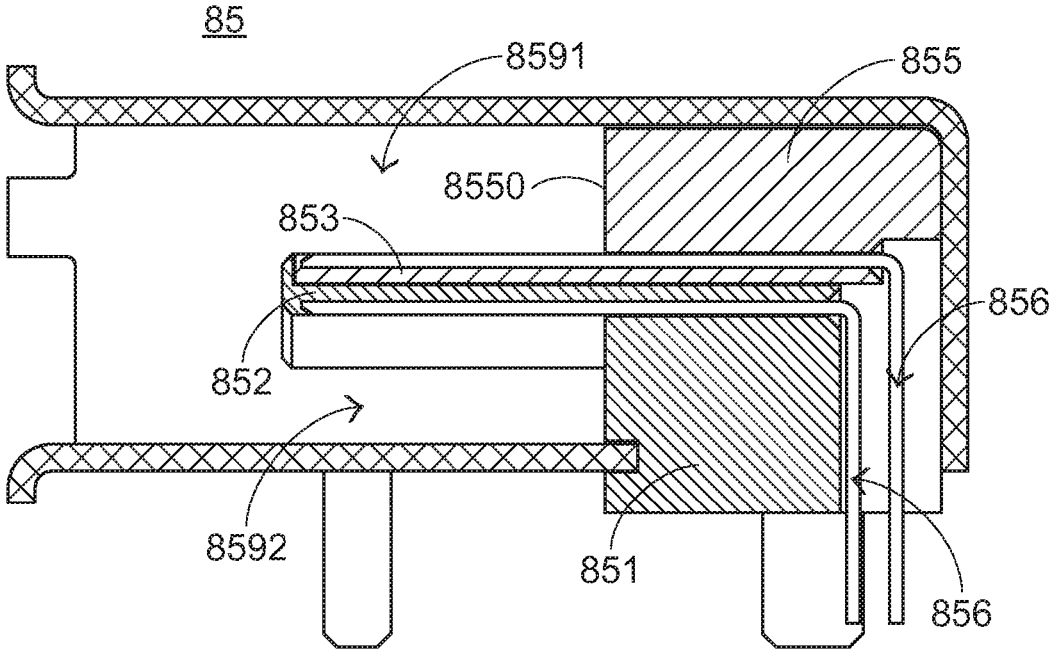
FIG. 36 is a schematic side view illustrating an electrical receptacle according to a twenty-second embodiment of the present invention.

FIG. 36 is a schematic side view illustrating an electrical receptacle according to a twenty-second embodiment of the present invention. The electrical receptacle 85 is an electrical receptacle complying with a display port protocol. In this embodiment, a fixed plastic tongue plate 852 is integrally formed with the plastic main body 851. In addition, a removable plastic tongue plate 853 is integrally formed with the rear cover 855. That is, the fixed plastic tongue plate 852 and the removable plastic insert molding tongue plate 853 are collaboratively defined as the composite tongue plate structure. Moreover, a first docking space 8591 and a second docking space 8592 are located at the top side and the bottom side of the composite tongue plate structure, respectively. A sidewall 8550 of the rear cover 855 is exposed to or arranged beside the first docking space 8591.

Moreover, a display port signal interface 856 is installed and fixed on the fixed plastic tongue plate 852, and another display port signal interface 856 is installed and fixed on the removable plastic insert molding tongue plate 853, which is integrally formed with the rear cover 855. Consequently, the display port signal interface structure segment (at least including a metallic contact part and an extension segment) is installed on each of the top side and the bottom side of the composite tongue plate structure.

Of course, no additional structural member is arranged between the pin segments of the display port signal interface 856 and the motherboard (not shown).

The following embodiments will be illustrated by referring to the electrical receptacle with the single tongue plate structure. The single tongue plate structure is a fixed plastic tongue plate or a removable plastic tongue plate. Moreover, the single tongue plate structure may be a plastic tongue plate or a plastic insert molding tongue plate.

Figure 37:
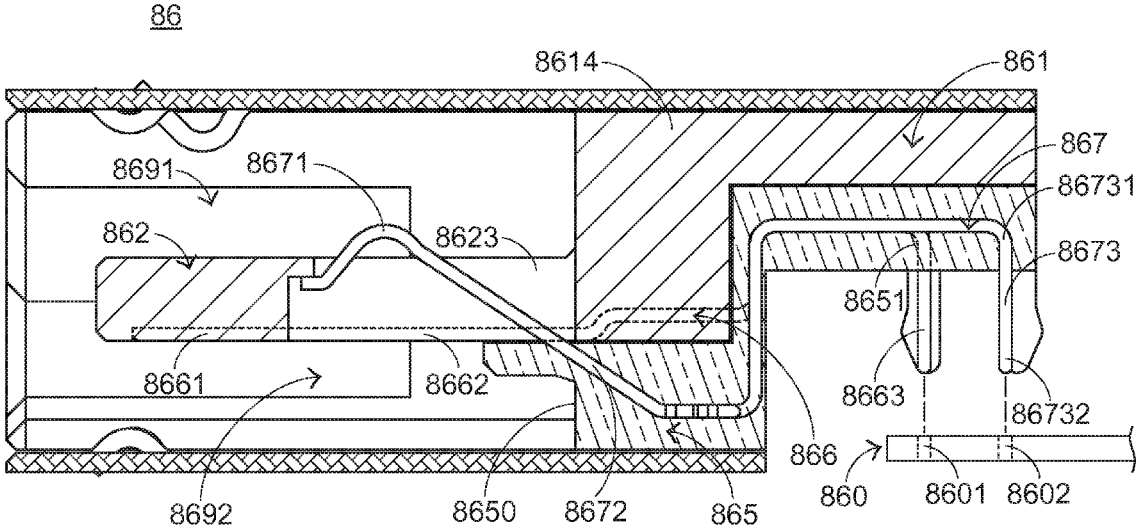
FIG. 37 is a schematic side view illustrating an electrical receptacle to be mounted on a motherboard according to a twenty-third embodiment of the present invention.

FIG. 37 is a schematic side view illustrating an electrical receptacle to be mounted on a motherboard according to a twenty-third embodiment of the present invention. Except for the following items, the other components and mechanisms of the electrical receptacle of this embodiment are similar to those of the first embodiment, and are not redundantly described herein.

In comparison with the first embodiment, the electrical receptacle 86 of this embodiment has no circuit board. Consequently, the tongue plate structure 862 is a single fixed plastic tongue plate. In addition, the tongue plate structure 862 is fixed on a sidewall of a bottom part 8614 of the plastic main body 861 and extended toward the front side. Moreover, a first docking space 8691 and a second docking space 8692 are located at the top side and the bottom side of the tongue plate structure 862, respectively.

The electrical receptacle 86 further comprises a rear cover 865. A second signal interface 867 is previously installed and fixed on the rear cover 865. Moreover, the contact resilience arm segments 8671 of the second signal interface 867 are penetrated through the slots 8623 of the tongue plate structure 862. The sidewall 8650 of the rear cover 865 is exposed to or arranged beside the second docking space 8692.

Moreover, the contact segments 8661 and the front ends of the extension segments 8662 of the first signal interface 866 are fixed on the plastic main body 861. The pin segments 8663 of the first signal interface 866 are accommodated within the receiving holes 8651 of the rear cover 865.

In this embodiment, the first signal interface 866 is an eSATA signal interface, and the second signal interface 867 is a USB 2.0 signal interface. Consequently, the metallic contact part (i.e. the contact segments 8661) of the first signal interface 866 is located at the bottom side of the single tongue plate structure, and the metallic contact part (i.e. contact resilience arm segments 8671) of the second signal interface 867 is located at the top side of the single tongue plate structure. Moreover, the contact resilience arm segments 8671 and the extension segments 8672 of the second signal interface 867 are penetrated through the slots 8623 of the tongue plate structure 862 and exposed to the first docking space 8691.

Moreover, the first signal interface 866 and the second signal interface 867 are respectively conductive terminal groups. The conductive terminals of each conductive terminal group are separated from each other and not electrically with each other. Moreover, no additional structural member is arranged between the pin segments 8673 of the second signal interface 867 and the motherboard 860. In other words, a first end 86731 of the pin segment 8673 is connected to the fixture segment 8672, and a second end 86732 of the pin segment 8673 is inserted into the motherboard 860. Moreover, the pin segments 8663 of the first signal interface 866 and the pin segments 8673 of the second signal interface 867 are inserted into the insertion holes 8601 and 8602 of the motherboard 860, respectively.

Figure 38:
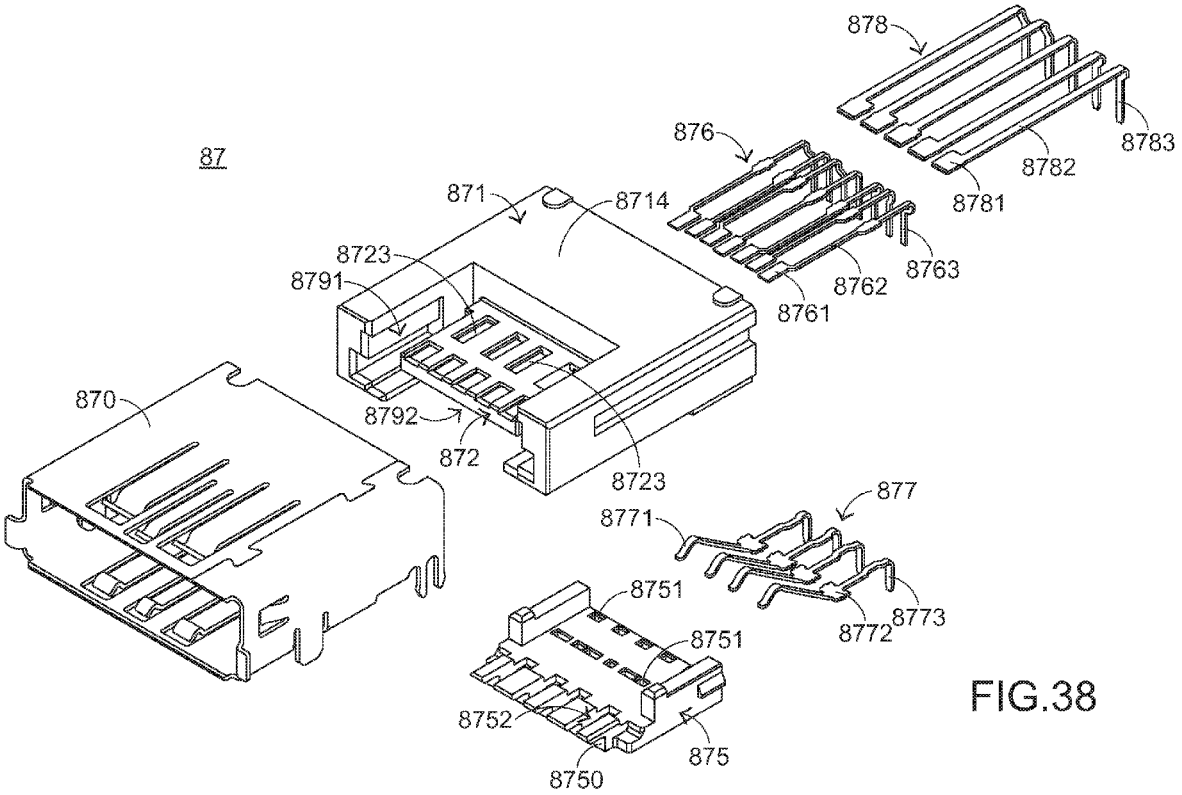
FIG. 38 is a schematic exploded view illustrating an electrical receptacle according to a twenty-fourth embodiment of the present invention.
Figure 39:
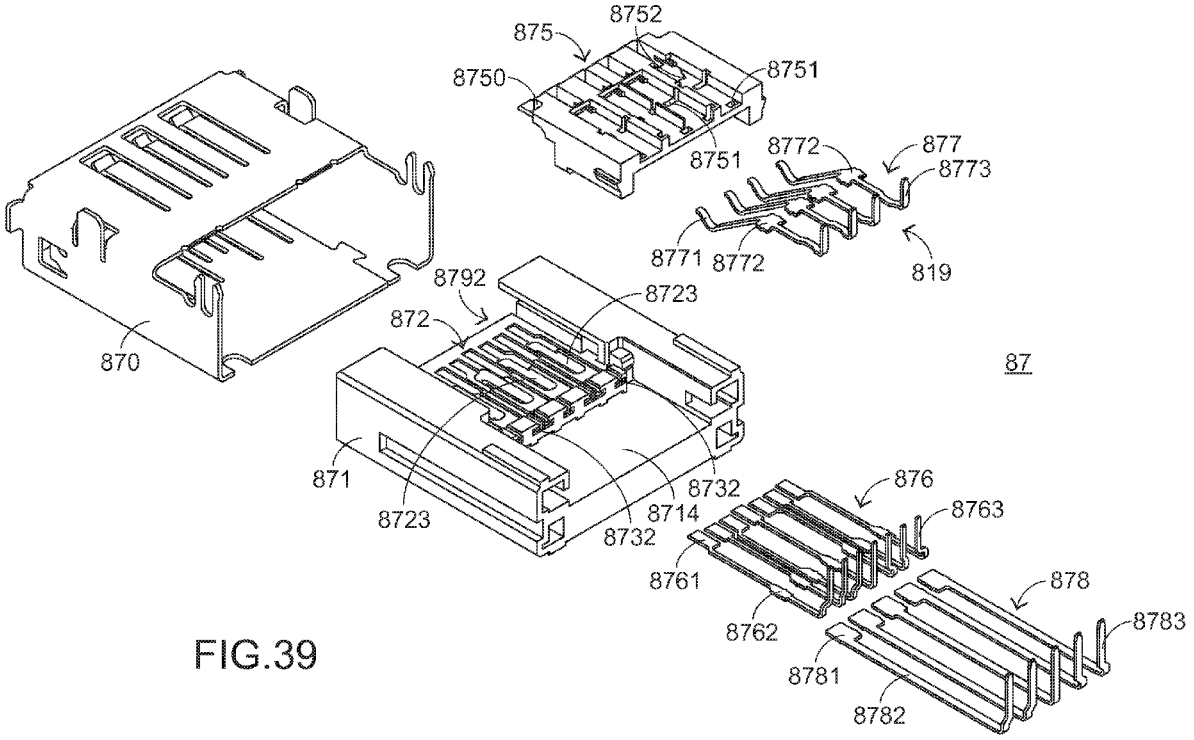
FIG. 39 is a schematic exploded view illustrating the electrical receptacle of the twenty-fourth and taken along another viewpoint.

FIG. 38 is a schematic exploded view illustrating an electrical receptacle according to a twenty-fourth embodiment of the present invention. FIG. 39 is a schematic exploded view illustrating the electrical receptacle of the twenty-fourth and taken along another viewpoint. Except for the following items, the other components and mechanisms of the electrical receptacle of this embodiment are similar to those of the third embodiment, and are not redundantly described herein.

In comparison with the third embodiment, the electrical receptacle 87 of this embodiment has no circuit board. Consequently, the tongue plate structure 872 is a single fixed plastic tongue plate. In addition, the tongue plate structure 872 is fixed on a sidewall of a bottom part 8714 of the plastic main body 871 and extended toward the front side. Moreover, a first docking space 8791 and a second docking space 8792 are located at the top side and the bottom side of the tongue plate structure 872, respectively.

The electrical receptacle 87 further comprises a rear cover 875. A second signal interface 877 (e.g. a USB 2.0) is previously installed and fixed on the rear cover 875. Moreover, the contact resilience arm segments 8771 of the second signal interface 877 are penetrated through the slots 8723 of the tongue plate structure 872. The sidewall 8750 of the rear cover 875 is exposed to or arranged beside the second docking space 8792.

Moreover, the contact segments 8761 of the first signal interface 876 (e.g. an eSATA signal interface), the contact segments 8781 of the third signal interface 878 (e.g. a USB 3.0 signal interface), the front ends of the extension segments 8762 of the first signal interface 876 and the front ends of the extension segments 8782 of the third signal interface 878 are fixed on the plastic main body 871 and the tongue plate structure 872 through the terminal recesses 8732. Moreover, the pin segments 8763 of the first signal interface 876 and the pin segments 8783 of the third signal interface 878 are accommodated within the receiving holes 8751 of the rear cover 875. Moreover, the extension segments 8782 of the third signal interface 878 are previously accommodated and fixed within the fixing recesses 8572 of the rear cover 875. That is, the rear cover 875 comprises both the receiving holes 8751 and the fixing recesses 8572.

Moreover, the first signal interface 876, the second signal interface 877 and the third signal interface 878 are respectively conductive terminal groups. The conductive terminals of each conductive terminal group are separated from each other and not electrically with each other. Moreover, no additional structural member is arranged between the pin segments 8773 of the second signal interface 877 and the motherboard (not shown).

Figure 40:
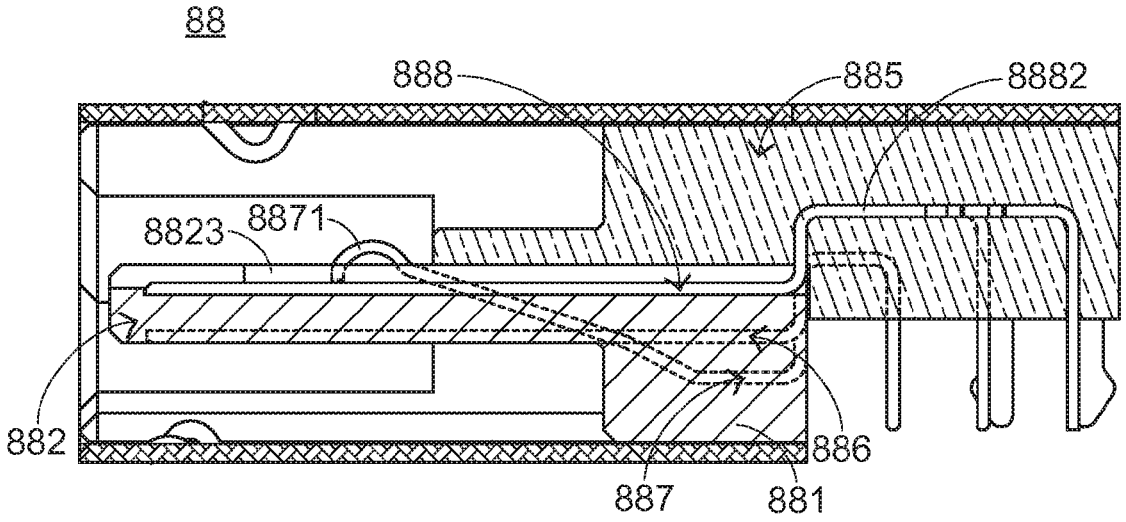
FIG. 40 is a schematic side view illustrating an electrical receptacle according to a twenty-fifth embodiment of the present invention.

FIG. 40 is a schematic side view illustrating an electrical receptacle according to a twenty-fifth embodiment of the present invention. Except for the following items, the other components and mechanisms of the electrical receptacle of this embodiment are similar to those of the twenty-fourth embodiment, and are not redundantly described herein.

In comparison with the twenty-fourth embodiment, the extension segments 8882 of the third signal interface 888 (e.g. a USB 3.0 signal interface) are previously installed and fixed on the rear cover 885 of the electrical receptacle 88 of this embodiment. In addition, the first signal interface 886 (e.g. an eSATA signal interface) and the second signal interface 887 (e.g. a USB 2.0 signal interface) are installed on the plastic main body 881. Moreover, the contact resilience arm segments 8871 of the second signal interface 887 are penetrated through the slots 8823 of the tongue plate structure 882.

Figure 41:
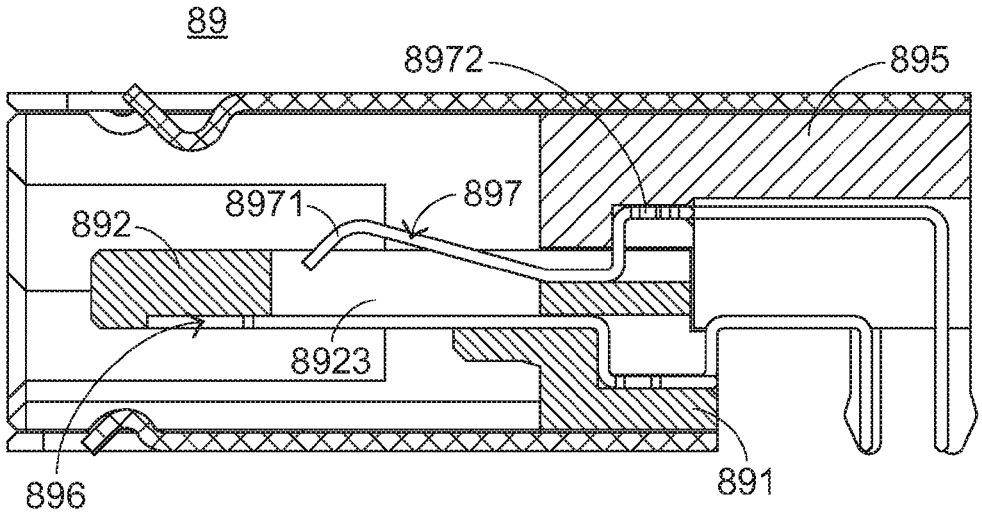
FIG. 41 is a schematic side view illustrating an electrical receptacle according to a twenty-sixth embodiment of the present invention.

FIG. 41 is a schematic side view illustrating an electrical receptacle according to a twenty-sixth embodiment of the present invention. Except for the following items, the other components and mechanisms of the electrical receptacle of this embodiment are similar to those of the twenty-third embodiment, and are not redundantly described herein.

In comparison with the twenty-third embodiment, the extension segments 8972 of the second signal interface 872 are previously installed and fixed on the rear cover 895 of the electrical receptacle 89 of this embodiment. Whereas, the contact resilience arm segments 8971 of the second signal interface 897 are not penetrated through the slots 8923 of the plastic tongue plate 892, which is extended from and integrally formed with the plastic main body 891. Of course, the first signal interface 896 is installed on the plastic main body 891 and the plastic tongue plate 892.

Figure 42:
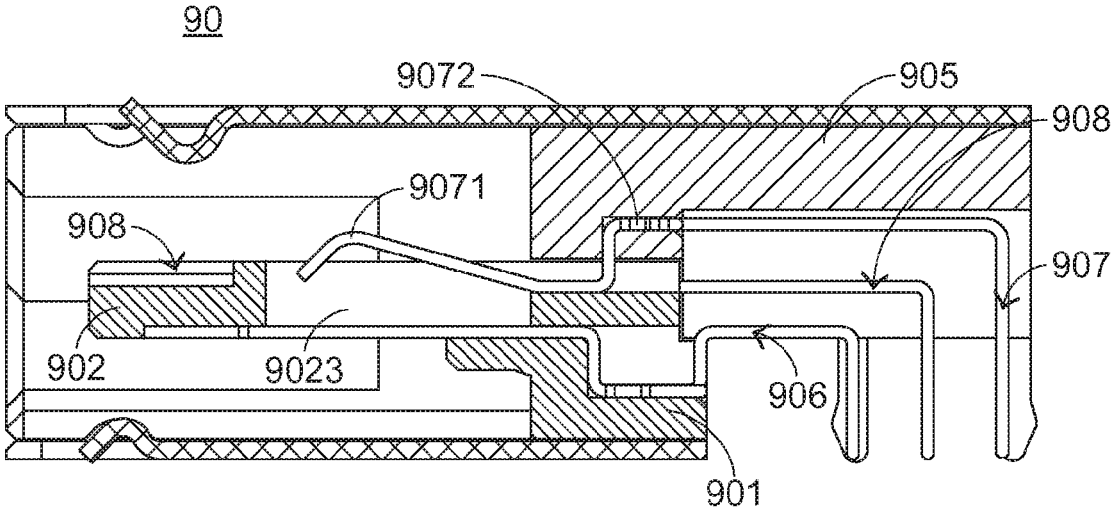
FIG. 42 is a schematic side view illustrating an electrical receptacle according to a twenty-seventh embodiment of the present invention.

FIG. 42 is a schematic side view illustrating an electrical receptacle according to a twenty-seventh embodiment of the present invention. Except for the following items, the other components and mechanisms of the electrical receptacle of this embodiment are similar to those of the twenty-sixth embodiment, and are not redundantly described herein.

The electrical receptacle 90 of this embodiment further comprises a third signal interface 908. Moreover, the firsts signal interface 906 and the third signal interface 908 are both installed on the plastic main body 901 and the plastic tongue plate 902. The extension segments 9072 of the second signal interface 907 are previously installed and fixed on the rear cover 905. Moreover, the contact resilience arm segments 9071 of the second signal interface 907 are not penetrated through the slots 9023 of the plastic tongue plate 902, which is extended from and integrally formed with the plastic main body 901.

Figure 43:
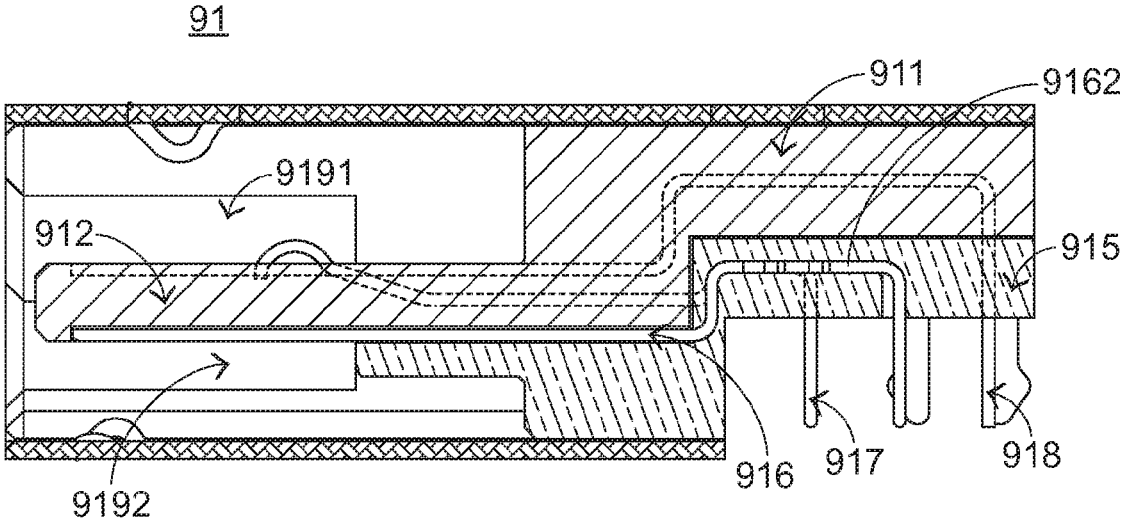
FIG. 43 is a schematic side view illustrating an electrical receptacle according to a twenty-eighth embodiment of the present invention.

FIG. 43 is a schematic side view illustrating an electrical receptacle according to a twenty-eighth embodiment of the present invention. In this embodiment, a single plastic tongue plate is employed. As shown in FIG. 43, the electrical receptacle 91 comprises a first plastic main body 911 (also referred as a first insulating main body), an (insulating) plastic tongue plate 912, a rear cover 915 (also referred as a second insulating main body), a first signal interface 916 (e.g. an eSATA signal interface), a second signal interface 917 (e.g. a USB 2.0 signal interface), and a third signal interface 918 (e.g. a USB 3.0 signal interface). The first plastic main body 911 has a first docking space 9191 and a second docking space 9192. The plastic tongue plate 912 is fixed on a sidewall of a bottom part of the first plastic main body 911 and extended toward the front side.

In this embodiment, the extension segments 9162 of the eSATA signal interface 916 are previously installed and fixed on the rear cover 915. Consequently, for assembling the electrical receptacle 81, the rear cover 915 with the eSATA signal interface 916 is moved forwardly to be combined with the plastic main body 911.

In accordance with the present invention, the electrical receptacle with a single tongue plate can support a single communication protocol (e.g. USB 2.0 or USB 3.0 communication protocol).

Figure 44:
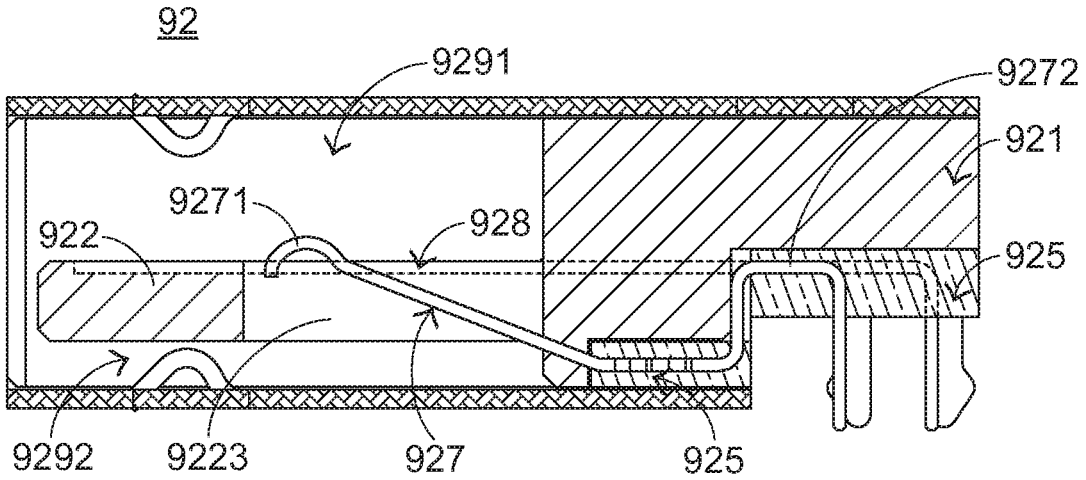
FIG. 44 is a schematic side view illustrating an electrical receptacle according to a twenty-ninth embodiment of the present invention.

FIG. 44 is a schematic side view illustrating an electrical receptacle according to a twenty-ninth embodiment of the present invention. As shown in FIG. 44, the electrical receptacle 92 comprises a first plastic main body 921 (also referred as a first insulating main body), an (insulating) plastic tongue plate 922, a rear cover 925 (also referred as a second insulating main body), a second signal interface 927 (e.g. a four-terminal USB 2.0 signal interface), and a third signal interface 928 (e.g. a five-terminal USB 3.0 signal interface). The first plastic main body 921 has a first docking space 9291 and a second docking space 9292. The plastic tongue plate 922 is fixed on a sidewall of a bottom part of the first plastic main body 921 and extended toward the front side.

In this embodiment, the extension segments 9272 of the USB 2.0 signal interface 927 are previously installed and fixed on the rear cover 925. Consequently, for assembling the electrical receptacle 91, the rear cover 925 with the four-terminal USB 2.0 signal interface 927 is moved forwardly to be combined with the plastic main body 921 while the contact resilience arm segments 9271 are penetrated through the slots 9223 of the plastic tongue plate 922.

Figure 45:
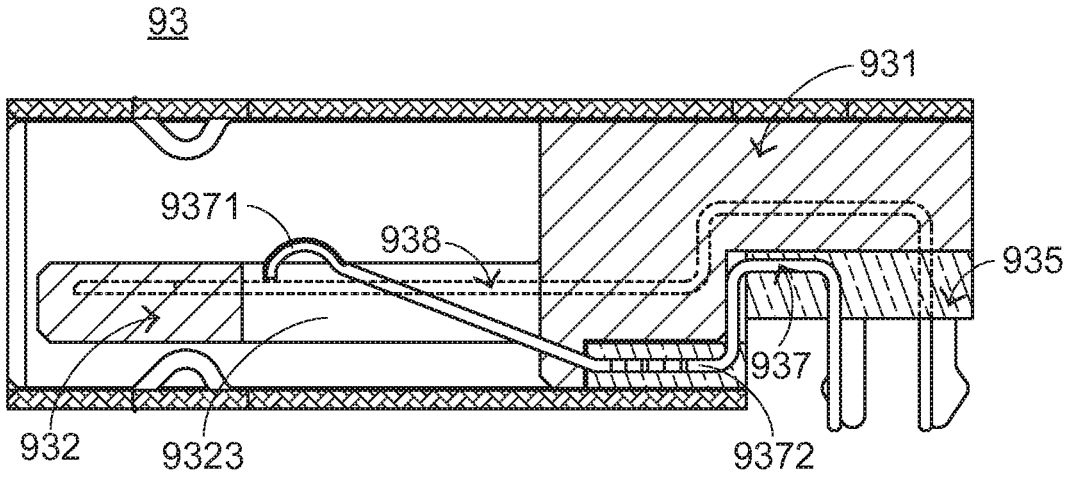
FIG. 45 is a schematic side view illustrating an electrical receptacle according to a thirtieth embodiment of the present invention.

FIG. 45 is a schematic side view illustrating an electrical receptacle according to a thirtieth embodiment of the present invention. Except for the following items, the other components and mechanisms of the electrical receptacle of this embodiment are similar to those of the twenty-ninth embodiment, and are not redundantly described herein.

In comparison with the twenty-ninth embodiment, the plastic main body 931, the plastic tongue plate 932 and the third signal interface 938 (e.g. a USB 3.0 signal interface) of the electrical receptacle 93 of this embodiment are combined as a single structural body by a plastic insert molding process. Moreover, in this embodiment, the contact resilience arm segments 9371 of the second signal interface 937 are penetrated through the slots 9323 of the plastic tongue plate 932, and the extension segments 9372 of the second signal interface 937 are installed and fixed on the rear cover 935.

Figure 46:
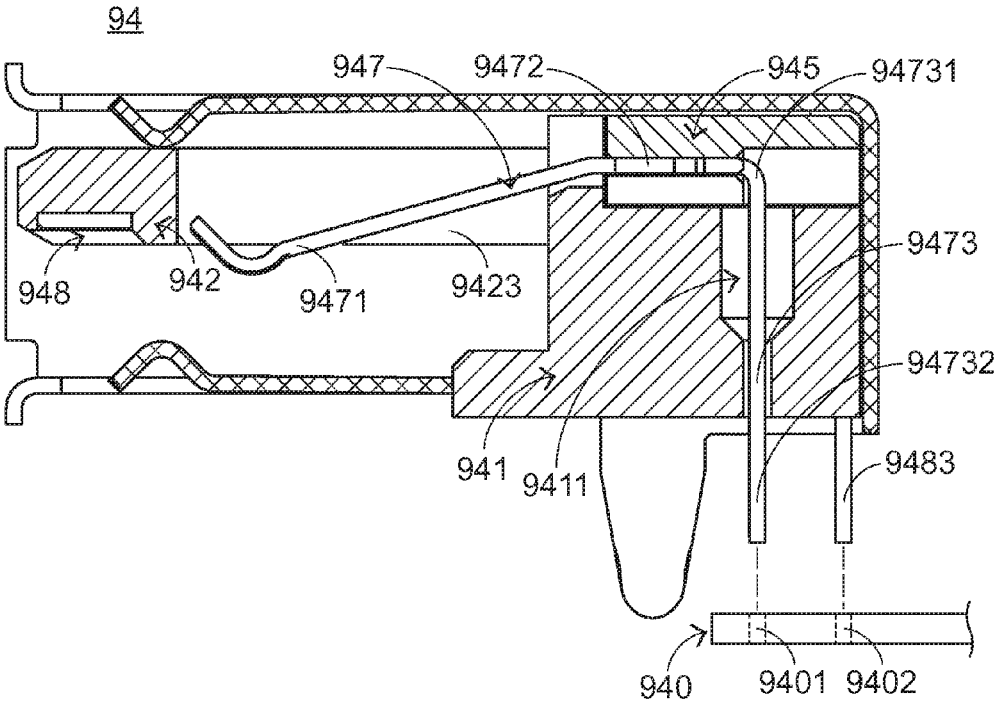
FIG. 46 is a schematic side view illustrating the electrical receptacle to be mounted on a motherboard according to a thirty-first embodiment of the present invention.

FIG. 46 is a schematic side view illustrating the electrical receptacle to be mounted on a motherboard according to a thirty-first embodiment of the present invention. Except for the following items, the other components and mechanisms of the electrical receptacle of this embodiment are similar to those of the twenty-ninth embodiment, and are not redundantly described herein.

In comparison with the twenty-ninth embodiment, the rear cover 945 of the electrical receptacle 94 of this embodiment is disposed over the plastic main body 941. Moreover, the extension segments 9472 of the second signal interface 947 are installed on the rear cover 945, and the contact resilience arm segments 9471 of the second signal interface 937 are extended downwardly from the extension segments 9472 and then penetrated through the slots 9423 of the tongue plate structure 942. In addition, the pin segments 9473 of the second signal interface 947 are penetrated through the receiving holes 9411 of the plastic main body 941.

In this embodiment, the third signal interface 948 is installed on the plastic main body 941 and the tongue plate structure 942.

Moreover, a first end 94731 of the pin segment 9473 of the second signal interface 947 is connected to the extension segment 9472, and a second end 94732 of the pin segment 9473 is inserted into the motherboard 940. That is, the pin segments 9483 of the third signal interface 948 and the pin segments 9473 of the second signal interface 947 which are penetrated through the receiving holes 9411 of the plastic main body 941 are inserted into the insertion holes 9401 and 9402 of the motherboard 940, respectively.

In this embodiment, the second signal interface 947 and the third signal interface 948 are respectively conductive terminal groups. The conductive terminals of each conductive terminal group are separated from each other and not electrically with each other.

Figure 47:
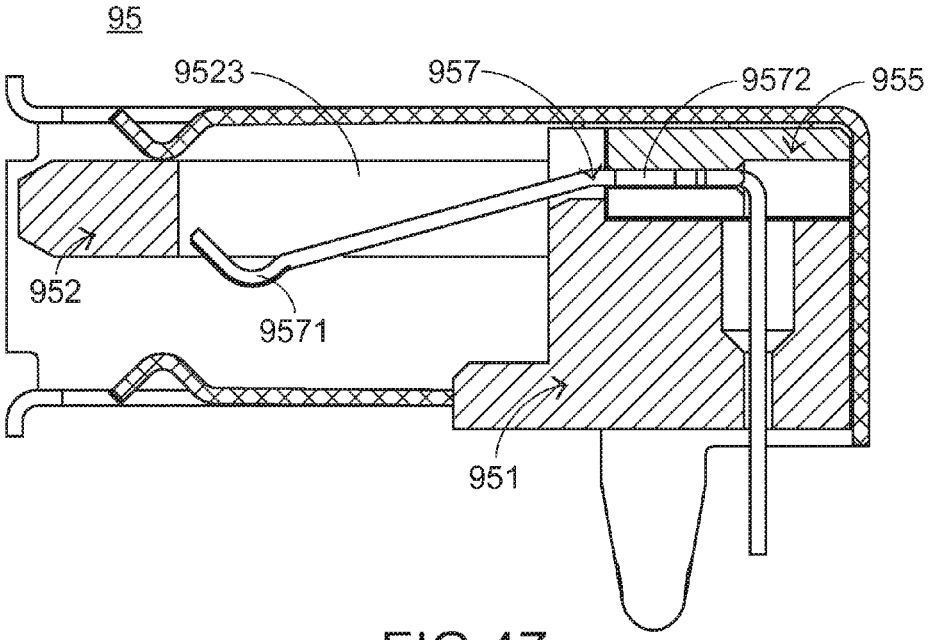
FIG. 47 is a schematic side view illustrating the electrical receptacle according to a thirty-second embodiment of the present invention.

FIG. 47 is a schematic side view illustrating the electrical receptacle according to a thirty-second embodiment of the present invention. Except for the following items, the other components and mechanisms of the electrical receptacle of this embodiment are similar to those of the thirty-first embodiment, and are not redundantly described herein.

In comparison with the thirty-first embodiment, the third signal interface 948 is not included in the electrical receptacle 95 of this embodiment. In this embodiment, the extension segments 9572 of the second signal interface 957 are previously installed and fixed on the rear cover 955, and the contact resilience arm segments 9571 of the second signal interface 957 are penetrated through the slots 9523 of the plastic tongue plate 952.

The following embodiments will be illustrated by referring to the electrical receptacle with a single tongue plate structure which is also the removable plastic tongue plate.

Figure 48:
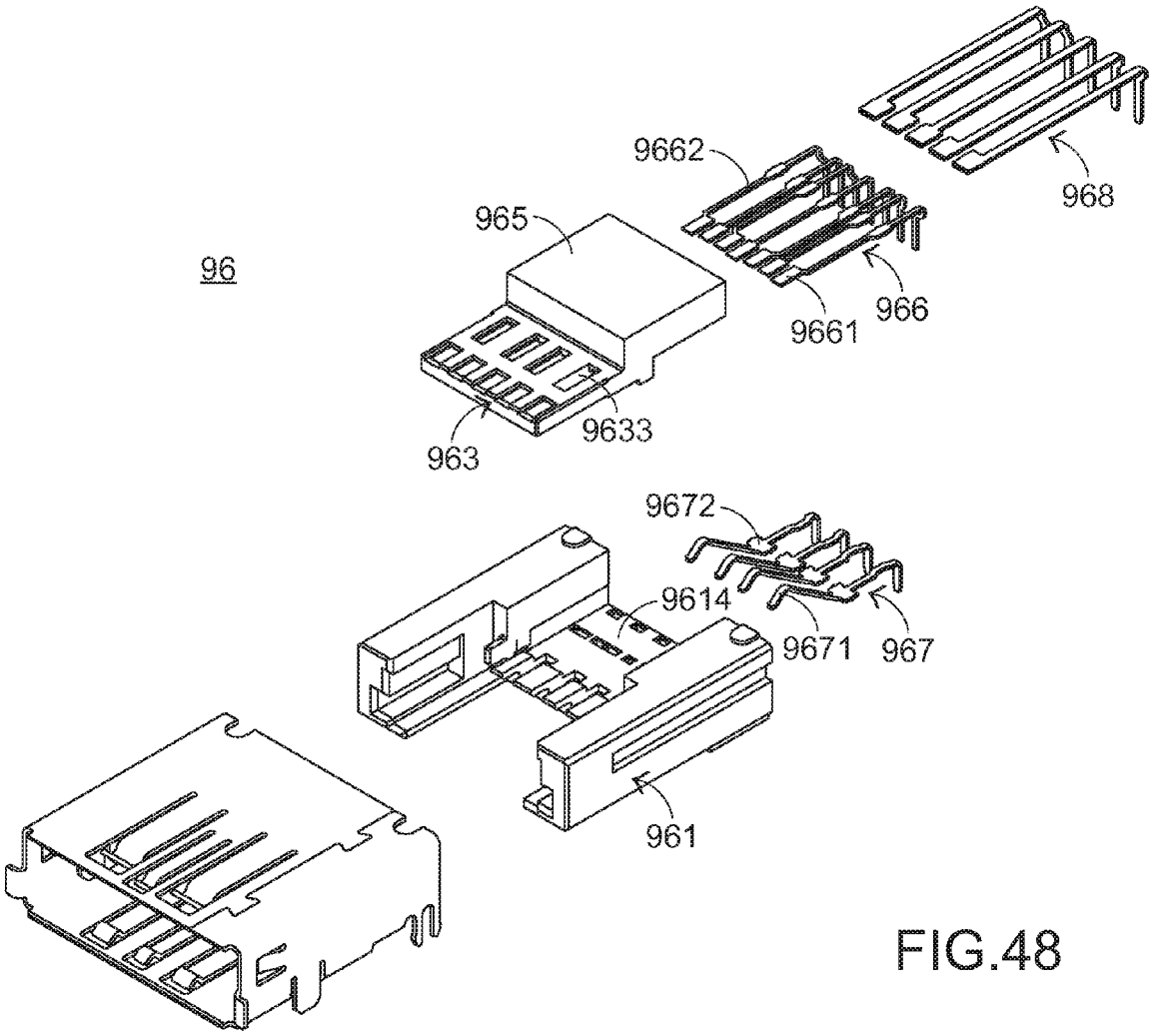
FIG. 48 is a schematic exploded view illustrating an electrical receptacle according to a thirty-third embodiment of the present invention.
Figure 49:
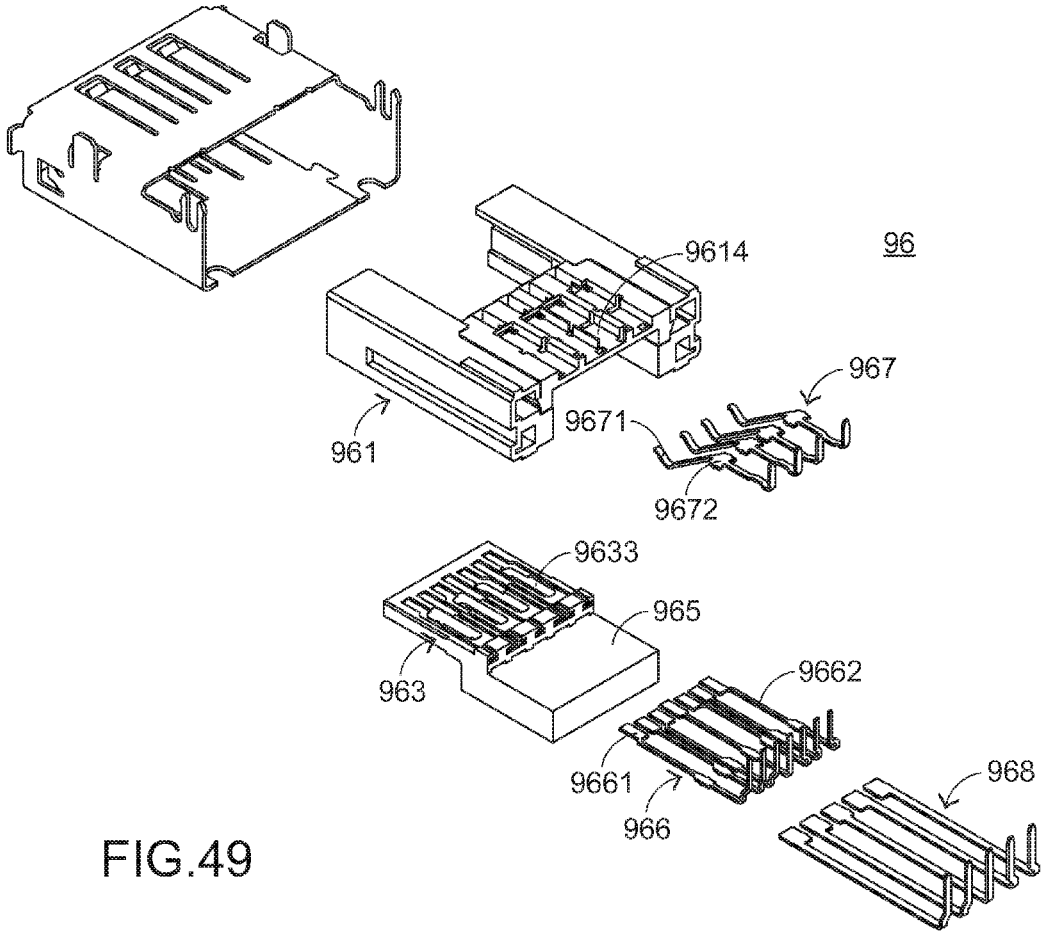
FIG. 49 is a schematic exploded view illustrating the electrical receptacle of the thirty-third and taken along another viewpoint

FIG. 48 is a schematic exploded view illustrating an electrical receptacle according to a thirty-third embodiment of the present invention. FIG. 49 is a schematic exploded view illustrating the electrical receptacle of the thirty-third and taken along another viewpoint. Except for the following items, the other components and mechanisms of the electrical receptacle of this embodiment are similar to those of the twelfth embodiment, and are not redundantly described herein.

In comparison with the twelfth embodiment, the electrical receptacle 96 of this embodiment has no circuit board. Consequently, the tongue plate structure 963 is a removable plastic tongue plate, and the tongue plate structure 963 is integrally formed with the rear cover 965. Moreover, the contact segments 9661 and the front ends of the extension segments 9662 of the first signal interface 966 and the third signal interface 968 are accommodated within the combination of the tongue plate structure 963 and the rear cover 965. Moreover, in this embodiment, the extension segments 9672 of the second signal interface 967 are installed on a bottom part 9614 (e.g. a thin slab) of the plastic main body 961, and the contact resilience arm segments 9671 of the second signal interface 967 are penetrated through the slots 9633 of the tongue plate structure 963.

Figure 50:
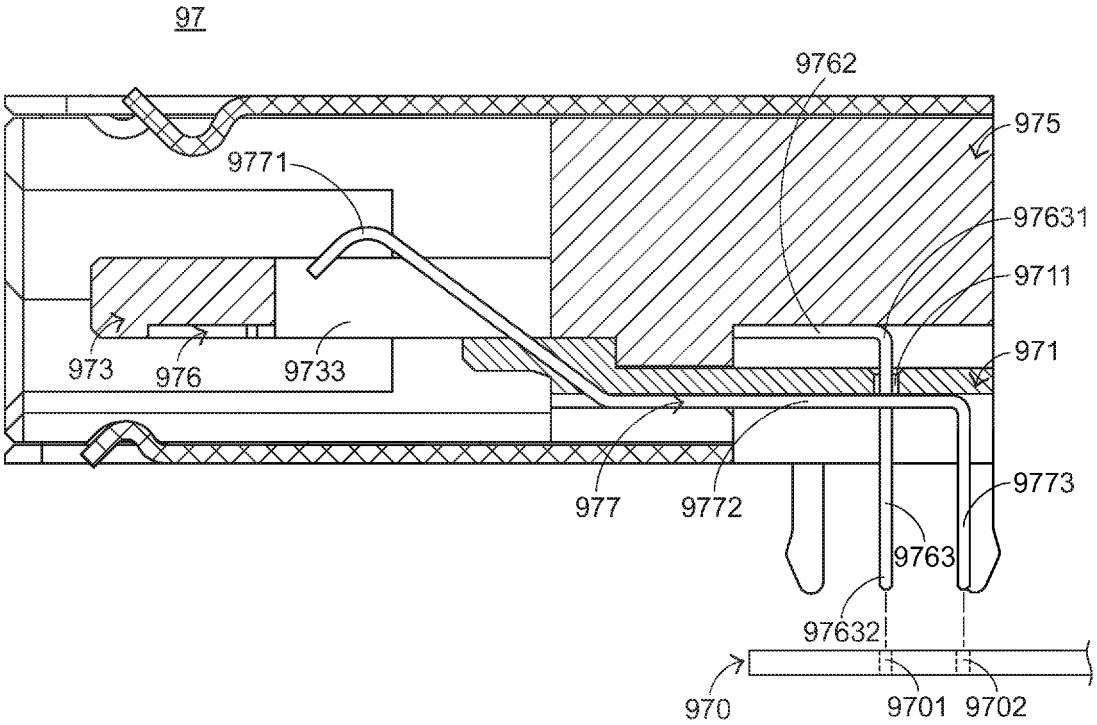
FIG. 50 is a schematic side view illustrating the electrical receptacle to be mounted on a motherboard according to a thirty-fourth embodiment of the present invention.

FIG. 50 is a schematic side view illustrating the electrical receptacle to be mounted on a motherboard according to a thirty-fourth embodiment of the present invention. Except for the following items, the other components and mechanisms of the electrical receptacle of this embodiment are similar to those of the thirty-third embodiment, and are not redundantly described herein.

In comparison with the thirty-third embodiment, the third signal interface 968 is not included in the electrical receptacle 97 of this embodiment. Moreover, in this embodiment, the extension segments 9772 of the second signal interface 977 (i.e. the USB 2.0 signal interface) are installed on the plastic main body 971, and the contact resilience arm segments 9771 of the second signal interface 977 are penetrated through the slots 9733 of the single removable plastic tongue plate 973. Moreover, the first signal interface 976 (i.e. the eSATA signal interface) is installed on the combination of the plastic tongue plate 973 and the rear cover 975, and the pin segments 9763 of the first signal interface 976 are penetrated through the receiving holes 9711 of the plastic main body 971.

Moreover, a first end 97631 of the pin segment 9763 of the first signal interface 976 is connected to the extension segment 9762, and a second end 97632 of the pin segment 9763 is inserted into the motherboard 970. The pin segments 9763 of the first signal interface 976 (i.e. the eSATA signal interface) and the pin segments 9773 of the second signal interface 977 (i.e. the USB 2.0 signal interface) are inserted into the insertion holes 9701 and 9702 of the motherboard 970, respectively.

In this embodiment, the first signal interface 976 and the second signal interface 977 are respectively conductive terminal groups. The conductive terminals of each conductive terminal group are separated from each other and not electrically with each other.

Figure 51:
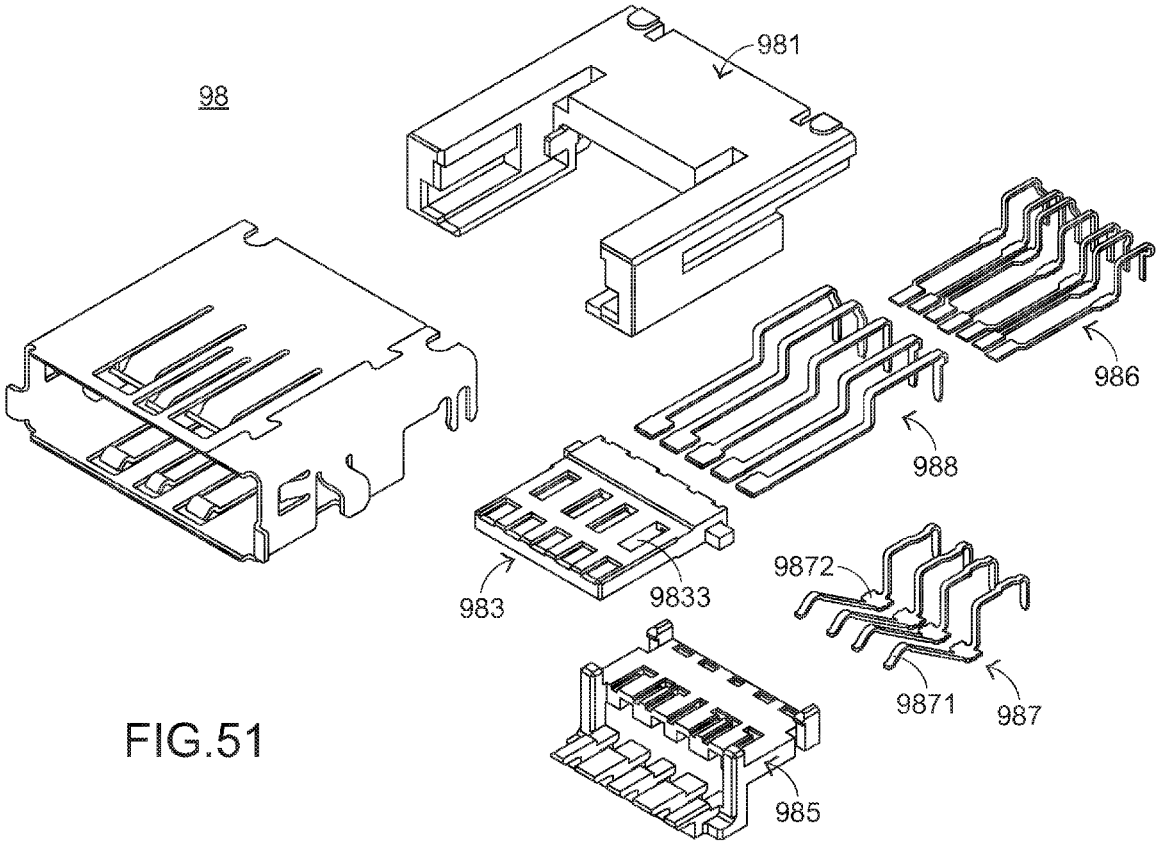
FIG. 51 is a schematic exploded view illustrating an electrical receptacle according to a thirty-fifth embodiment of the present invention.

FIG. 51 is a schematic exploded view illustrating an electrical receptacle according to a thirty-fifth embodiment of the present invention. Except for the following items, the other components and mechanisms of the electrical receptacle of this embodiment are similar to those of the twenty-fourth embodiment, and are not redundantly described herein.

In comparison with the twenty-fourth embodiment, the tongue plate structure 983 of the electrical receptacle 98 is not fixed on the bottom part of the plastic main body 981. That is, the tongue plate structure 983 is an individual component (i.e. a single removable plastic tongue plate). The tongue plate structure 983 is used for accommodating the first signal interface 986 and the third signal interface 988.

Moreover, in this embodiment, the extension segments 9872 of the second signal interface 987 are previously installed and fixed on the rear cover 985, and the contact resilience arm segments 9871 of the second signal interface 987 are penetrated through the slots 9833 of the single removable plastic tongue plate 983.

Figure 52:
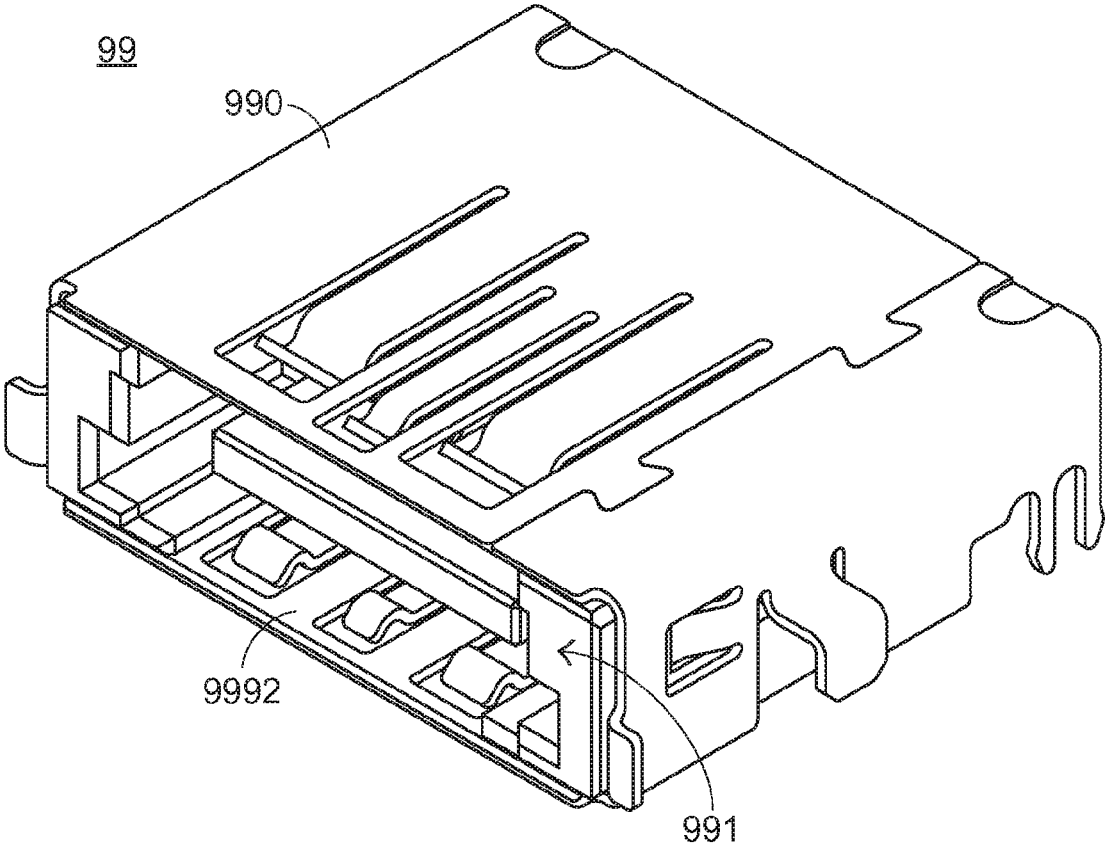
FIG. 52 is a schematic assembled view illustrating an electrical receptacle according to a thirty-sixth embodiment of the present invention.
Figure 53:
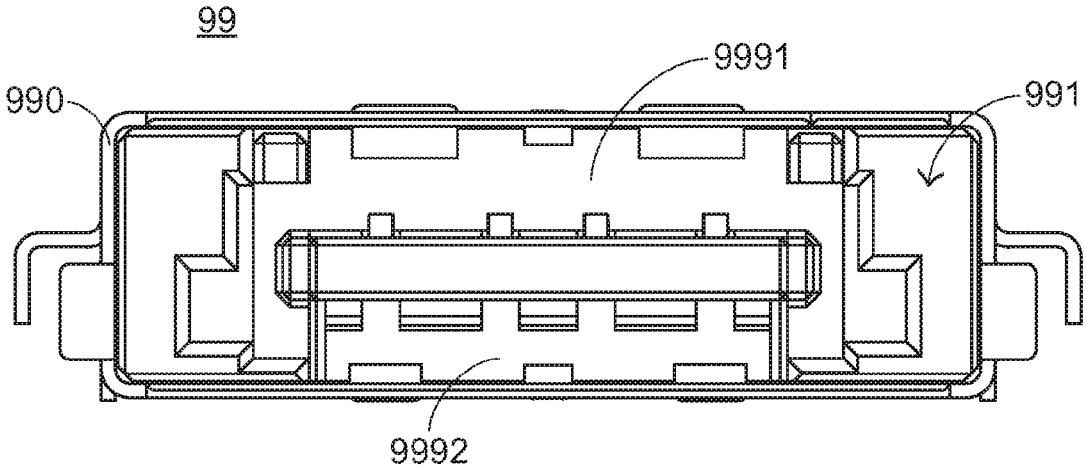
FIG. 53 is a schematic front view illustrating the electrical receptacle of the thirty-sixth embodiment.
Figure 54:
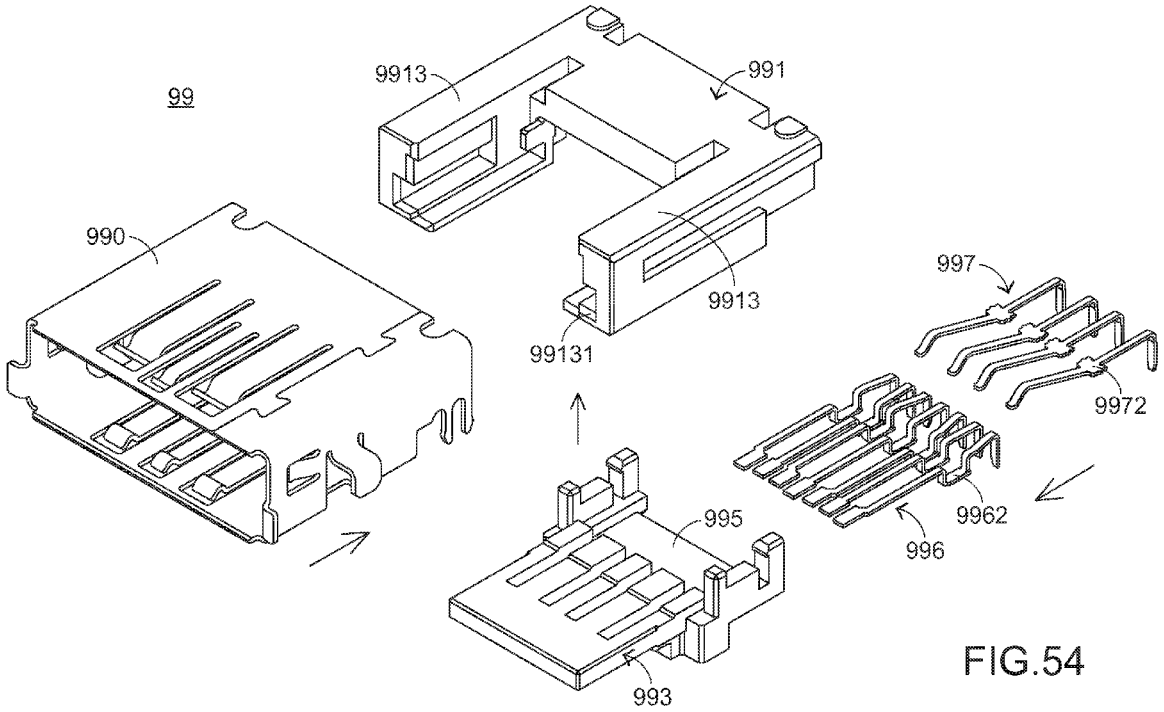
FIG. 54 is a schematic exploded view illustrating the electrical receptacle of the thirty-sixth embodiment.
Figure 55:
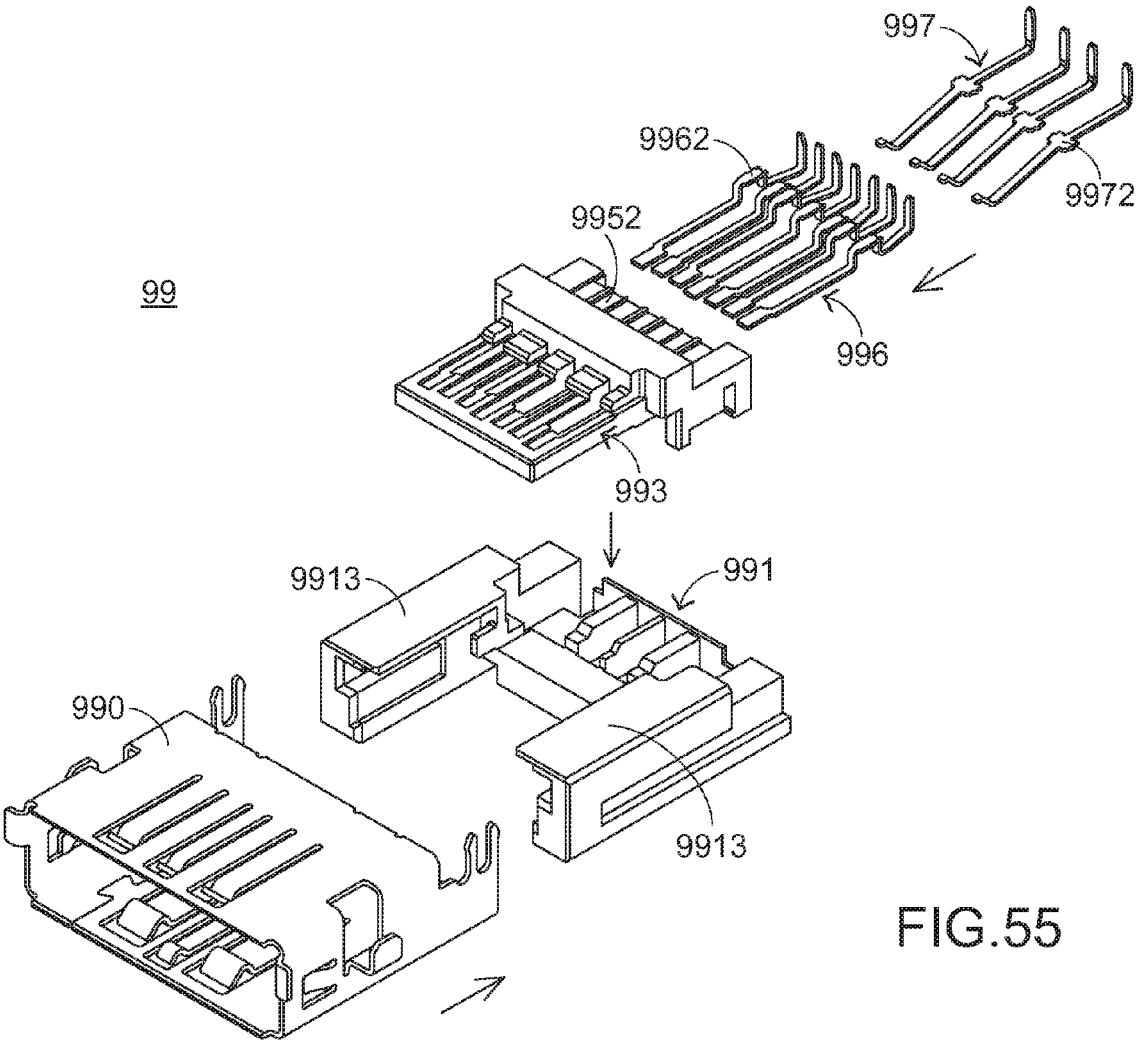
FIG. 55 is a schematic exploded view illustrating the electrical receptacle of the thirty-sixth embodiment and taken along another viewpoint.

FIG. 52 is a schematic assembled view illustrating an electrical receptacle according to a thirty-sixth embodiment of the present invention. FIG. 53 is a schematic front view illustrating the electrical receptacle of the thirty-sixth embodiment. FIG. 54 is a schematic exploded view illustrating the electrical receptacle of the thirty-sixth embodiment. FIG. 55 is a schematic exploded view illustrating the electrical receptacle of the thirty-sixth embodiment and taken along another viewpoint.

In this embodiment, the electrical receptacle 99 comprises a plastic main body 991, a removable plastic tongue plate 993 combined with a rear cover 995, a first signal interface 996, a second signal interface 997, and a metallic casing 990.

Moreover, after the removable plastic tongue plate 993 with the rear cover 995 and the plastic main body 991 are combined together, a first docking space 9991 and a second docking space 9992 are defined by the removable plastic tongue plate 993 and the plastic main body 991.

In this embodiment, the plastic main body 991 is an integral plastic main body. Moreover, two lateral walls 9913 are located at bilateral sides of the plastic main body 991 and extended toward the front side. A shared profile 99131 is located at the front peripheries of the two lateral walls 9913. Moreover, no any fixed plastic tongue plate is installed on the plastic main body 991, and the first signal interface 996 and the second signal interface 997 are not included in the plastic main body 991. Due to the shared profile 99131, an electrical plug (not shown) with the first signal interface or the second signal interface can be coupled with the electrical receptacle 99.

Moreover, the first signal interface 996 and the second signal interface 997 are installed on the removable plastic tongue plate 993. The removable plastic tongue plate 993 is integrally formed with the rear cover 995. The rear cover 995 has a plurality of fixing recesses 9952. The extension segments 9962 of the first signal interface 996 and/or the extension segments 9972 of the second signal interface 997 are previously accommodated and fixed within the fixing recesses 9952.

Moreover, each of the first signal interface 996 and the second signal interface 997 comprises a plurality of signal interface units (also referred as terminals). The first signal interface 996 is accommodated within the second docking space 9992. The extension segment 9962 of each signal interface unit of the first signal interface 996 is partially or completely fixed in a corresponding fixing recess 9952. It is noted that the fixing recesses 9952 may be formed on the other side of the rear cover 995 for fixing the extension segments 9972 of the signal interface units of the second signal interface 9991 that are accommodated within the first docking space 9991.

Moreover, in this embodiment, the first signal interface 996 and the second signal interface 997 are an e-SATA signal interface and a USB 2.0 signal interface.

Figure 56:
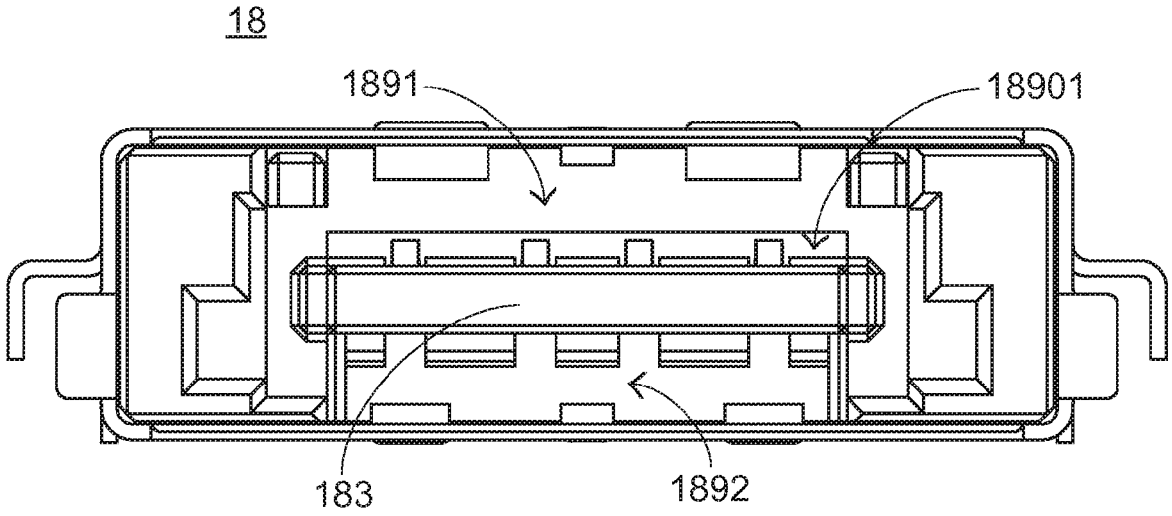
FIG. 56 is a schematic front view illustrating the electrical receptacle according to a thirty-seventh embodiment of the present invention.
Figure 57:
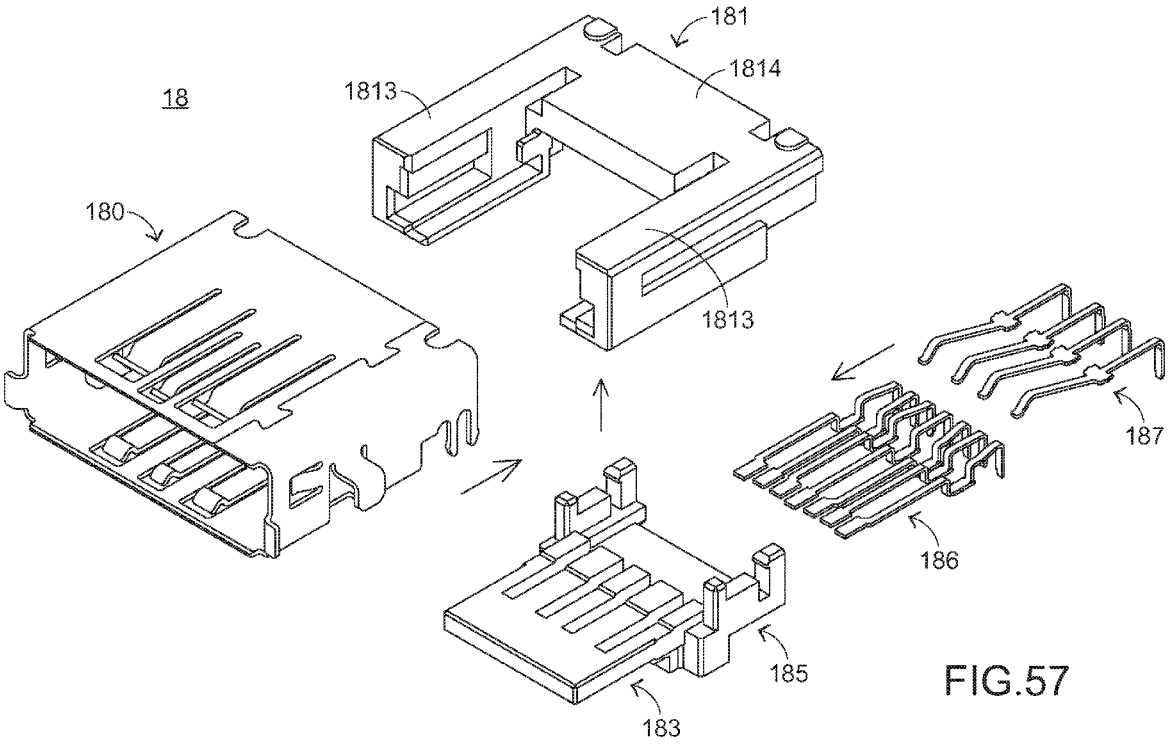
FIG. 57 is a schematic exploded view illustrating the electrical receptacle of the thirty-seventh embodiment.
Figure 58:
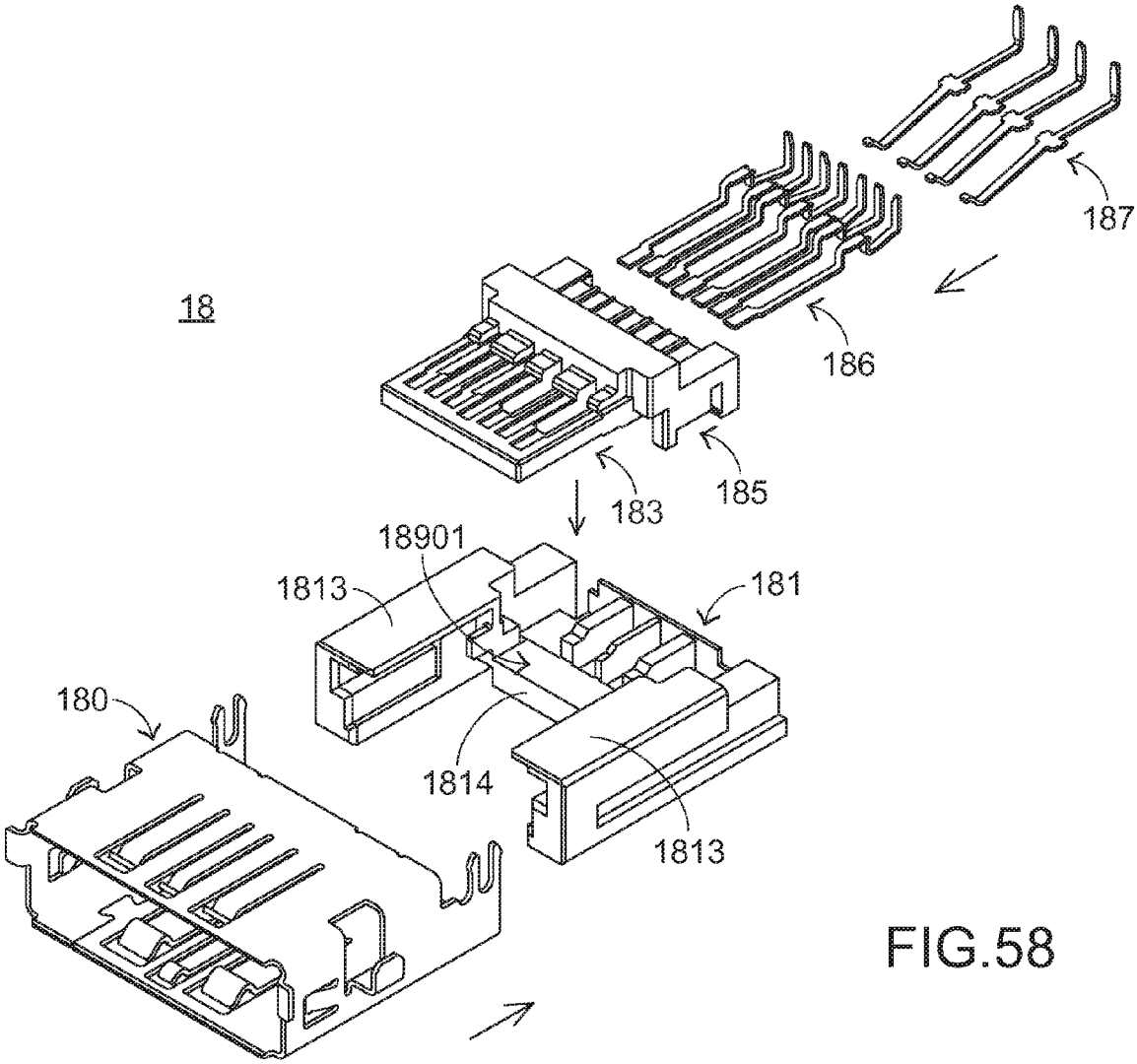
FIG. 58 is a schematic exploded view illustrating the electrical receptacle of the thirty-seventh embodiment and taken along another viewpoint.

FIG. 56 is a schematic front view illustrating the electrical receptacle according to a thirty-seventh embodiment of the present invention. FIG. 57 is a schematic exploded view illustrating the electrical receptacle of the thirty-seventh embodiment. FIG. 58 is a schematic exploded view illustrating the electrical receptacle of the thirty-seventh embodiment and taken along another viewpoint.

In this embodiment, the electrical receptacle 18 comprises a plastic main body 181, a rear cover 185, a removable plastic tongue plate 183, a first signal interface 186, a second signal interface 187, and a metallic casing 180. Like the thirty-sixth embodiment, after the removable plastic tongue plate 183 with the rear cover 185 and the plastic main body 181 are combined together, a first docking space 1891 and a second docking space 1892 are defined by the removable plastic tongue plate 183 and the plastic main body 181. The first signal interface 186 is accommodated within the second docking space 1892, which is arranged beside a surface of the removable plastic tongue plate 183. The second signal interface 187 is accommodated within the first docking space 1891, which is arranged beside another surface of the removable plastic tongue plate 183.

In this embodiment, the plastic main body 181 is an integral plastic main body. Moreover, two lateral walls 1813 are located at bilateral sides of the plastic main body 181 and extended toward the front side. In comparison with the thirty-sixth embodiment, after the electrical receptacle 18 is assembled, a gap 18901 is created between the bottom part 1814 of the plastic main body 181 and the removable plastic tongue plate 183.

In the following embodiments, the single tongue plate structure is applied to the signal interfaces other than the eSATA signal interface and the USB signal interface. It is to be noted that the following descriptions of preferred embodiments of this invention are presented herein for purpose of illustration and description only.

Figure 59:
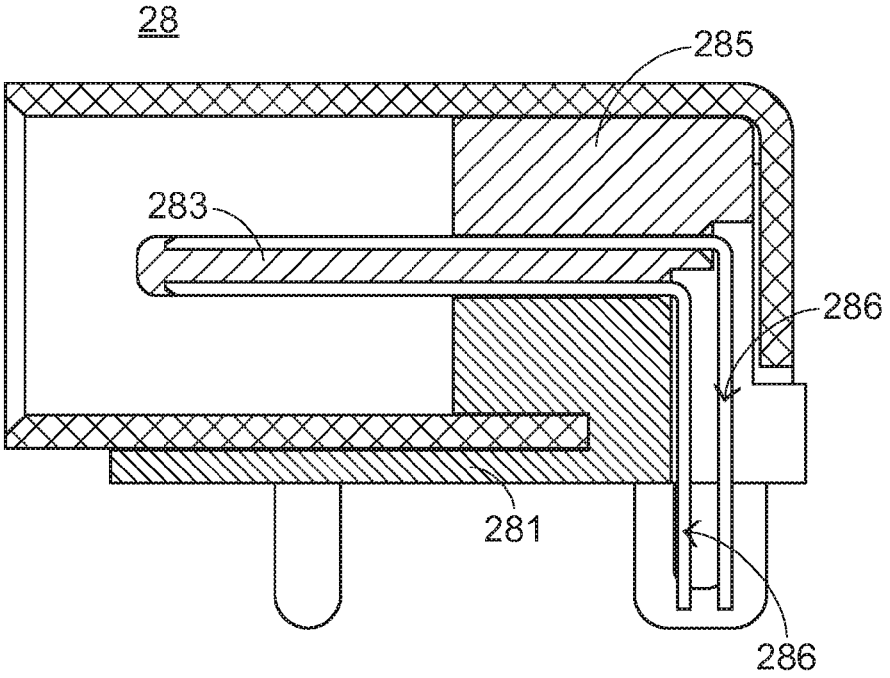
FIG. 59 is a schematic cross-sectional view illustrating the electrical receptacle according to a thirty-eighth embodiment of the present invention.
Figure 60:
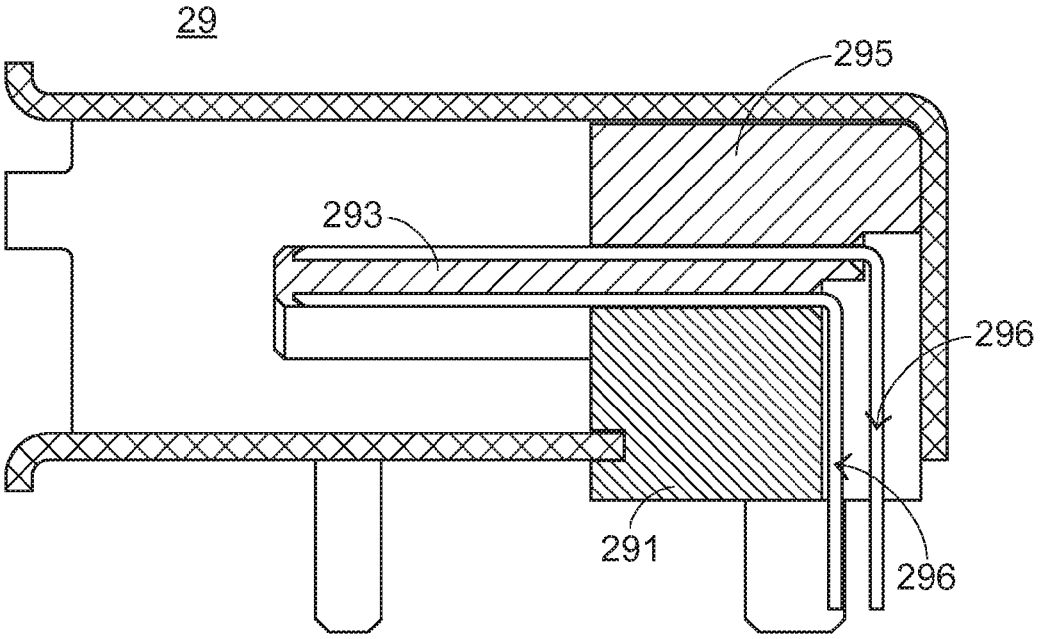
FIG. 60 is a schematic cross-sectional view illustrating the electrical receptacle according to a thirty-ninth embodiment of the present invention.

FIG. 59 is a schematic cross-sectional view illustrating the electrical receptacle according to a thirty-eighth embodiment of the present invention. FIG. 60 is a schematic cross-sectional view illustrating the electrical receptacle according to a thirty-ninth embodiment of the present invention. As shown in FIG. 59, the electrical receptacle 28 is an electrical receptacle with a high definition multimedia interface (HDMI) signal interface 286. As shown in FIG. 60, the electrical receptacle 29 is an electrical receptacle with a display port signal interface 296. In these two embodiments, the tongue plate structures are installed on the plastic main body 281 and the plastic main body 291. Moreover, the removable plastic tongue plates 283 and 293 may be integrally formed with the rear covers 285 and 295, respectively.

Moreover, the HDMI signal interface 286 as shown in FIG. 59 is installed on the combination of the removable plastic tongue plate 283 and the rear cover 285. Similarly, the display port signal interface 296 as shown in FIG. 60 is installed on the combination of the removable plastic tongue plate 293 and the rear cover 295.

Figure 61:
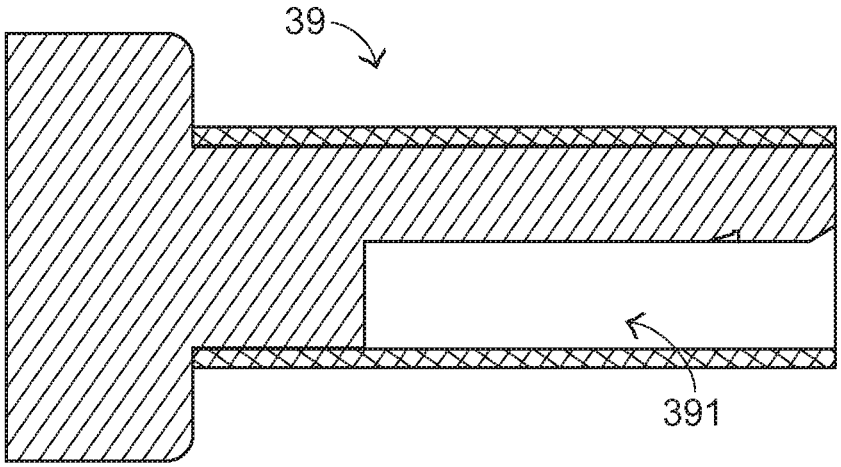
FIG. 61 is a schematic side view illustrating an electrical plug applied to the electrical receptacle of the present invention.

FIG. 61 is a schematic side view illustrating an electrical plug applied to the electrical receptacle of the present invention. The electrical plug 39 may comply with the above-mentioned communication protocols (e.g. the eSATA signal interface, the USB 2.0 signal interface and/or the USB 3.0 signal interface). The electrical plug 39 has a tongue plate receiving space 391 for accommodating various tongue plate structures that are described in the above embodiment.

From the above description, the electrical receptacle of the present invention can be easily assembled. In the electrical receptacle of the present invention, the signal interface structure segments are not excessively centralized to a single plastic main body, and thus the drawbacks encountered from the prior art will be eliminated. Especially for the high-speed signal interfaces, the distributed arrangement of the signal interface structure segments is effective to reduce the signal interference between adjacent signal interfaces. Consequently, the electrical receptacle of the present invention is industrially valuable.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An electrical receptacle, comprising:

a first plastic main body;

a tongue plate structure with a plurality of slots;

a plurality of signal interface structure segments, comprising a contact resilience arm segment accommodated within a corresponding slot of said plurality of slots of said tongue plate structure, wherein a front end of said contact resilience arm segment protrudes from a top side of said tongue plate structure, and at least two of said plural signal interface structure segments are located at said top side and a bottom side of said tongue plate structure, respectively; and a second plastic main body having at least one pre-formed structure segment fixing space, wherein at least a first portion of said plural signal interface structure segments are subsequently accommodated and fixed within said at least one structure segment fixing space, wherein after said second plastic main body with said first portion of said plural signal interface structure segments and said first plastic main body are combined together, said second plastic main body, said first plastic main body, said tongue plate structure and a second portion of said plural signal interface structure segments are assembled into said electrical receptacle.

2. The electrical receptacle according to claim 1 wherein said tongue plate structure is combined with or integrally formed with said first plastic main body, and said tongue plate structure is a single tongue plate structure or a composite tongue plate structure including at least two plates.

3. The electrical receptacle according to claim 2 wherein said composite tongue plate structure is at least composed of two plastic tongue plates, or said composite tongue plate structure is at least composed of one plastic tongue plate and one circuit board, or said composite tongue plate structure is at least composed of two plastic insert molding tongue plates with at least one signal interface structure segment each, or said composite tongue plate structure is at least composed of one plastic tongue plate and one plastic insert molding tongue plate with at least one signal interface structure segment.

4. The electrical receptacle according to claim 2 wherein said single tongue plate structure is a removable plastic tongue plate.

5. The electrical receptacle according to claim 1 wherein said second portion of said plural signal interface structure segments are installed on said first plastic main body, or installed on said tongue plate structure, or installed in a first docking space beside said first surface of said tongue plate structure, or installed in a second docking space beside a second surface of said tongue plate structure, or installed on said second plastic main body, or installed in said at least one docking space including at least one of said first docking space and said second docking space.

6. The electrical receptacle according to claim 5 wherein said at least two signal interface structure segments located at said top side and said bottom side of said tongue plate structure are respectively exposed to or arranged beside said first docking space and said second docking space, wherein said at least two signal interface structure segments are both metallic contact segments, or at least one of said at least two signal interface structure segments is a metallic contact segment, and said metallic contact segment belongs to said second portion of said plural signal interface structure segments.

7. The electrical receptacle according to claim 6 wherein a rear end of said contact resilience arm segment protrudes from said second surface of said tongue plate structure.

8. The electrical receptacle according to claim 7 wherein an extension segment or a fixture segment of said plural signal interface structure segments electrically connected with said contact resilience arm segment belongs to said first portion of said plural signal interface structure segments and is previously accommodated and fixed within said at least one structure segment fixing space.

9. The electrical receptacle according to claim 1 wherein an extension segment or a fixture segment belongs to said first portion of said plural signal interface structure segments, wherein a pin segment or a welding segment connected to a rear end of said extension segment or said fixture segment is not penetrated through or accommodated within any structural member or only penetrated through or accommodated within one of said first plastic main body and said second plastic main body.

10. The electrical receptacle according to claim 9 wherein a first end of said pin segment or a first end of said welding segment is electrically connected with said extension segment or electrically connected with said fixture segment, and a second end of said pin segment or a second end of said welding segment is welded to a motherboard, so that none of said structural member is arranged between said first portion of said plural signal interface structure segments and said motherboard or said first portion of said plural signal interface structure segments are only installed on one of said first plastic main body and said second plastic main body.

11. The electrical receptacle according to claim 1 wherein a contact pad or a contact resilience arm segment or a contact segment, or an extension wire or an extension segment, or a fixture segment, or a pin segment or a welding segment belongs to said second portion of said plural signal interface structure segments, wherein said second portion of said plural signal interface structure segments which are installed on said first plastic main body exclude said pin segment or said welding segment.

12. The electrical receptacle according to claim 1 wherein said first portion of said plural signal interface structure segments and said second portion of said plural signal interface structure segments are collaboratively defined as plural signal interfaces, wherein each signal interface unit of said plural signal interfaces is composed of four structure segments: (1) a contact pad or a contact resilience arm segment or a contact segment, (2) an extension wire or an extension segment, (3) a fixture segment, and (4) a pin segment or a welding segment, or each signal interface unit of said plural signal interfaces is composed of three structure segments: (1) a contact pad or a contact resilience arm segment or a contact segment, (2) an extension wire or an extension segment, and (3) a pin segment or a welding segment, or each signal interface unit of said plural signal interfaces is composed of two structure segment: (1) a contact and extension segment or a contact and extension wire, and (2) a pin segment or a welding segment, wherein each of said signal interfaces comprises plural conductive terminals, which are separated from each other and not electrically with each other.

13. The electrical receptacle according to claim 1 wherein said second plastic main body is a rear cover, which is combined with said first plastic main body or said tongue plate structure or integrally formed with said tongue plate structure, wherein said rear cover has at least one sidewall exposed to or arranged beside at least one docking space mating with an electrical plug, or said rear cover has at least one position-limiting fixing recess for previously accommodating and fixing said first portion of said plural signal interface structure segments, or said rear cover has at least one receiving hole for accommodating at least one pin segment of said first portion of said plural signal interface structure segments or said second portion of said plural signal interface structure segments, or said rear cover has at least one fixing recess for previously accommodating and fixing said first portion of said plural signal interface structure segments and at least one receiving hole for accommodating at least one pin segment of said first portion of said plural signal interface structure segments or said second portion of said plural signal interface structure segments.

14. The electrical receptacle according to claim 1 further comprising a metallic casing, wherein said metallic casing is sheathed around said first plastic main body, or said metallic casing is sheathed around an outer periphery of a combination of said first plastic main body and said second plastic main body, wherein no signal interface structure segment is installed on said first plastic main body, or no any other protrusion plate parallel with and separated from said plastic tongue plate is arranged under said plastic tongue plate, or said first plastic main body has two lateral walls extended toward a front side thereof, or said first plastic main body is not integrally formed with said tongue plate structure, wherein a shared profile mating with various signal interfaces of an electrical plug is defined by front peripheries of said two lateral walls.

15. The electrical receptacle according to claim 1 wherein said plural signal interface structure segments are collaboratively defined as a signal interface complying with an USB 2.0 or USB 3.0 communication protocol and an eSATA communication protocol, or said plural signal interface structure segments are collaboratively defined as a single-type USB signal interface complying with an USB 2.0 or USB 3.0 communication protocol, or said plural signal interface structure segments are collaboratively defined as a signal interface complying with a high definition multimedia interface (HDMI) communication protocol, or said plural signal interface structure segments are collaboratively defined as a signal interface complying with a display port communication protocol.

16. An electrical receptacle having at least one docking space for accommodating an electrical plug, said electrical receptacle comprising:

a plastic main body;

a tongue plate structure to be accommodated within a tongue plate receiving space of said electrical plug;

plural signal interface structure segments; and a rear cover having at least one pre-formed structure segment fixing space, wherein at least a first portion of said plural signal interface structure segments are previously accommodated and fixed within said at least one structure segment fixing space, wherein said tongue plate structure is combined with or integrally with said one of said plastic main body and said rear cover, wherein said rear cover with said first portion of said plural signal interface structure segments, said plastic main body, said tongue plate structure and a second portion of said plural signal interface structure segments are assembled into said electrical receptacle.

17. The electrical receptacle according to claim 16 wherein said tongue plate structure is combined with or integrally formed with said plastic main body, and said tongue plate structure is a single tongue plate structure or a composite tongue plate structure including at least two plates, wherein said single tongue plate structure or said composite tongue plate structure is an only tongue plate structure of said electrical receptacle.

18. The electrical receptacle according to claim 17 wherein said composite tongue plate structure is at least composed of two plastic tongue plates, or said composite tongue plate structure is at least composed of one plastic tongue plate and one circuit board, or said composite tongue plate structure is at least composed of two plastic insert molding tongue plates with at least one signal interface structure segment each, or said composite tongue plate structure is at least composed of one plastic tongue plate and one plastic insert molding tongue plate with at least one signal interface structure segment.

19. The electrical receptacle according to claim 17 wherein said single tongue plate structure is a removable plastic tongue plate.

20. The electrical receptacle according to claim 16 wherein at least two of said plural signal interface structure segments are located at a top side and a bottom side of said tongue plate structure, respectively.

21. The electrical receptacle according to claim 20 wherein said second portion of said plural signal interface structure segments are installed on said plastic main body, or installed on said tongue plate structure, or installed in a first docking space beside a first surface of said tongue plate structure, or installed in a second docking space beside a second surface of said tongue plate structure, or installed on said rear cover, or installed in said at least one docking space including at least one of said first docking space and said second docking space.

22. The electrical receptacle according to claim 21 wherein said at least two signal interface structure segments located at said top side and said bottom side of said tongue plate structure are respectively exposed to or arranged beside said first docking space and said second docking space, wherein said at least two signal interface structure segments are both metallic contact segments, or at least one of said at least two signal interface structure segments is a metallic contact segment, and said metallic contact segment belongs to said second portion of said plural signal interface structure segments.

23. The electrical receptacle according to claim 22 wherein said plural signal interface structure segments comprise at least one contact resilience arm segment, which is accommodated within at least one corresponding slot of said tongue plate structure, wherein a front end and a rear end of said contact resilience arm segment are respectively protruded from said first surface and said second surface of said tongue plate structure.

24. The electrical receptacle according to claim 23 wherein an extension segment or a fixture segment of said plural signal interface structure segments electrically connected with said contact resilience arm segment belongs to said first portion of said plural signal interface structure segments and is previously accommodated and fixed within said at least one structure segment fixing space.

25. The electrical receptacle according to claim 16 wherein an extension segment or a fixture segment belongs to said first portion of said plural signal interface structure segments, wherein a pin segment or a welding segment connected to a rear end of said extension segment or said fixture segment is not penetrated through or accommodated within any structural member or only penetrated through or accommodated within one of said plastic main body and said rear cover.

26. The electrical receptacle according to claim 25 wherein a first end of said pin segment or a first end of said welding segment is electrically connected with said extension segment or electrically connected with said fixture segment, and a second end of said pin segment or a second end of said welding segment is welded to a motherboard, so that none of said structural member is arranged between said first portion of said plural signal interface structure segments and said motherboard or said first portion of said plural signal interface structure segments are only installed on one of said plastic main body and said rear cover.

27. The electrical receptacle according to claim 16 wherein a contact pad or a contact resilience arm segment or a contact segment, or an extension wire or an extension segment, or a fixture segment, or a pin segment or a welding segment belongs to said second portion of said plural signal interface structure segments, wherein said second portion of said plural signal interface structure segments which are installed on said first plastic main body exclude said pin segment or said welding segment.

28. The electrical receptacle according to claim 16 wherein said first portion of said plural signal interface structure segments and said second portion of said plural signal interface structure segments are collaboratively defined as plural signal interfaces, wherein each signal interface unit of said plural signal interfaces is composed of four structure segments: (1) a contact pad or a contact resilience arm segment or a contact segment, (2) an extension wire or an extension segment, (3) a fixture segment, and (4) a pin segment or a welding segment, or each signal interface unit of said plural signal interfaces is composed of three structure segments: (1) a contact pad or a contact resilience arm segment or a contact segment, (2) an extension wire or an extension segment, and (3) a pin segment or a welding segment, or each signal interface unit of said plural signal interfaces is composed of two structure segment: (1) a contact and extension segment or a contact and extension wire, and (2) a pin segment or a welding segment, wherein each of said signal interfaces comprises plural conductive terminals, which are separated from each other and not electrically with each other.

29. The electrical receptacle according to claim 16 wherein said rear cover is combined with said plastic main body or said tongue plate structure or integrally formed with said tongue plate structure, wherein said rear cover has at least one sidewall exposed to or arranged beside said at least one docking space, or said rear cover has at least one position-limiting fixing recess for previously accommodating and fixing said first portion of said plural signal interface structure segments, or said rear cover has at least one receiving hole for accommodating at least one pin segment of said first portion of said plural signal interface structure segments or said second portion of said plural signal interface structure segments, or said rear cover has at least one fixing recess for previously accommodating and fixing said first portion of said plural signal interface structure segments and at least one receiving hole for accommodating at least one pin segment of said first portion of said plural signal interface structure segments or said second portion of said plural signal interface structure segments.

30. The electrical receptacle according to claim 29 wherein said plural signal interface structure segments are collaboratively defined as a first signal interface complying with an eSATA communication protocol, and collaboratively defined as a second signal interface having plural contact resilience arm segments and complying with a USB 2.0 communication protocol, or said plural signal interface structure segments are collaboratively defined as said second signal interface and a third signal interface so as to comply with a USB 3.0 communication protocol.

31. The electrical receptacle according to claim 16 further comprising a metallic casing, wherein said metallic casing is sheathed around said plastic main body, or said metallic casing is sheathed around an outer periphery of a combination of said plastic main body and said rear cover, wherein no signal interface structure segment is installed on said plastic main body, or no any other protrusion plate parallel with and separated from said plastic tongue plate is arranged under said plastic tongue plate, or said plastic main body has two lateral walls extended toward a front side thereof, or said plastic main body is not integrally formed with said tongue plate structure, wherein a shared profile mating with various signal interfaces of said electrical plug is defined by front peripheries of said two lateral walls.

* * * * *